US006167965B1

(12) United States Patent
Bearden et al.

(10) Patent No.: US 6,167,965 B1
(45) Date of Patent: Jan. 2, 2001

(54) ELECTRICAL SUBMERSIBLE PUMP AND METHODS FOR ENHANCED UTILIZATION OF ELECTRICAL SUBMERSIBLE PUMPS IN THE COMPLETION AND PRODUCTION OF WELLBORES

(75) Inventors: John L. Bearden, Claremore, OK (US); John W. Harrell, Spring, TX (US); Jerald R. Rider, Catossa; Gordon L. Besser, Claremore, both of OK (US); Michael H. Johnson, Spring, TX (US); Paulo S. Tubel, The Woodlands, TX (US); Larry A. Watkins, Houston, TX (US); Daniel J. Turick; Joseph F. Donovan, both of Spring, TX (US); J. V. Henry; Dick L. Knox, both of Claremore, OK (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/029,732

(22) PCT Filed: Aug. 29, 1996

(86) PCT No.: PCT/US96/13504

§ 371 Date: Feb. 8, 1999

§ 102(e) Date: Feb. 8, 1999

(87) PCT Pub. No.: WO97/08459

PCT Pub. Date: Mar. 6, 1997

Related U.S. Application Data

(60) Provisional application No. 60/002,895, filed on Aug. 30, 1995.

(51) Int. Cl.[7] ..... E21B 47/00

(52) U.S. Cl. ..... 166/250.15; 166/265; 166/53; 166/105.5; 166/106; 417/14; 417/18

(58) Field of Search ..... 166/250.15, 265, 166/53, 105.5, 106; 417/14, 18, 19, 20, 32, 42, 43, 44.2

(56) References Cited

U.S. PATENT DOCUMENTS

| | | | | |
|---|---|---|---|---|
| 3,929,399 | * | 12/1975 | Aronson | 417/54 |
| 4,370,098 | * | 1/1983 | McClain et al. | 417/18 |
| 4,718,824 | * | 1/1988 | Cholet et al. | 417/14 |
| 5,201,848 | * | 4/1993 | Powers | 415/199.1 |
| 5,293,937 | * | 3/1994 | Schultz et al. | 166/250 |
| 5,314,016 | * | 5/1994 | Dunham | 166/250.15 |
| 5,318,409 | * | 6/1994 | London et al. | 417/53 |
| 5,605,193 | * | 2/1997 | Bearden et al. | 166/370 |
| 5,823,262 | * | 10/1998 | Dutton | 166/250.15 |
| 5,868,201 | * | 2/1999 | Bussear et al. | 166/53 |

* cited by examiner

*Primary Examiner*—William Neuder
(74) *Attorney, Agent, or Firm*—Felsman, Bradley, Vaden, Gunter & Dillon, LLP

(57) ABSTRACT

An improved electrical submersible pump is disclosed in which a processor downhole is utilized to monitor one or more subsurface conditions, to record data, and to alter at least one operating condition of the electrical submersible pump. Novel uses are described for downhole gas compression, the delivery of particulate matter to wellbore sites, and for the disposal of waste.

35 Claims, 58 Drawing Sheets

INFLOW PERFORMANCE REFERENCE CURVE

Generalized IPR Curve

ELECTRICAL SUBMERSIBLE PUMP AND METHODS FOR ENHANCED UTILIZATION OF ELECTRICAL SUBMERSIBLE PUMPS IN THE COMPLETION AND PRODUCTION OF WELLBORES

This application is a 371 of PCT/US96/13504, filed Aug. 29, 1996.

This application claims benefit of provisional application Ser. No. 60/002,895, filed Aug. 30, 1995.

TECHNICAL FIELD

The present invention relates in general to the completion and production of oil and gas wellbores, and in particular to the utilization of electrical submersible pumps to control the flow of fluids in the completion and production of oil and gas wellbores.

BACKGROUND ART

In the prior art, electrical submersible pumps have been entirely controlled from the surface, largely based upon conclusions reached about downhole operation and wellbore conditions from meager amounts of transmitted data. The electrical submersible pumps have been utilized primarily for lifting wellbore fluids to the surface or for injecting water into formations during water-flooding operations.

In general, the oil and gas industry is moving toward more complex wellbore geometrics, in offshore locations, where equipment failure can be extraordinarily expensive, so any improvement in the electrical submersible pumps is likely to be warmly received by the industry. The present application includes a number of significant improvements in electrical submersible pumps and their uses.

DISCLOSURE OF INVENTION

The main features of the present application can be summarized as follows:

1. An improved electrical submersible pump (ESP) which is extensively instrumented with sensors, local processors, and local memory (see FIGS. 1L and 1M).
2. Each portion of the improved ESP (electrical motor, rotary gas separator, and centrifugal pump) may be instrumented.
3. Signal processing, data analysis, communication operations, and control operations may be performed with the improved ESP.
4. A variety of monitoring and data processing operations are described, including:
   a. local monitoring and control of the improved ESP;
   b. the operating conditions of the improved ESP components may be monitored;
   c. downhole separation operations can be controlled, utilizing the improved ESP;
   d. pump efficiency for the improved ESP can be monitored and dangerous operating conditions for the improved ESP can be monitored and avoided; and
   e. preprogrammed control or operating instructions can be recorded in memory and executed at appropriate times or events by the improved ESP;
5. Some particular control operations for the improved ESP which are depicted and described include:
   FIG. 2A: monitoring actual pump intake pressure and comparing it to required pump intake pressure, and providing local control or communication.
   FIG. 2B: monitoring actual pump flow rates and comparing them to desired pump flow rates and providing local control or communication.

FIG. 2D & FIG. 2E: monitoring actual pump efficiency and comparing it to desired pump efficiency, and providing local control or communication.
   FIG. 2F & FIG. 2G: monitoring the ESP productivity index and providing local control or communication.
   FIG. 2J & FIG. 2K: determining the inflow performance relationship and communicating it or a command.
   FIG. 2L & FIG. 2M: monitoring electrical motor power factor and communicating it or a command.
   FIG. 2N & FIG. 2O: determining electrical motor efficiency and communicating it or a command.
   FIG. 2P & FIG. 2Q: monitoring vibration and communicating data or a command.
   FIG. 2V & FIG. 2W: monitoring viscosity and specific gravity and communicating data or a command.
   FIG. 2X: monitoring bearing temperature.
   FIG. 2Y: monitoring motor temperature.
   FIG. 2Z: monitoring insulation resistance.
   FIG. 2AA: monitoring the electrical properties of the clean fluid in the electric motor.
   FIG. 2BB: monitoring the electrical properties of the wellbore fluid.
   FIG. 2CC: monitoring spectrometer data.
   FIG. 2DD: monitoring flow rates.
6. The use of the improved ESP in conventional uses is discussed, such as: shrouded configurations, booster pump configurations, subsurface water reinjections, use with a packer, use with a "Y" tool.
7. A variety of novel uses for the improved ESP are discussed, including:
   a. use of the improved ESP as a downhole compressor;
   b. use of the improved ESP as a subsurface waste water injector;
   c. use of the improved ESP for the delivery of particulate matter and completion fluids, such as cement, fracturing fluid, emulsifiers, etc.;
   d. use of the improved ESP in combination with local processors and clutches to dynamically alter compression operations; and
   e. use of the improved ESP for subsurface waste disposal.
8. The use of the improved ESP in complex control during completion and production operations is discussed.

BRIEF DESCRIPTION OF DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

FIG. 2I is a graphical representation of an inflow performance reference curve which has been scaled to represent an exemplary oil and gas well;

FIGS. 2N and 2O are a flowchart representation of data processing implemented determination of the electric motor efficiency for electrical submersible pumps, in accordance with the present invention;

FIG. 2AA is a flowchart representation of the data processing implemented steps of monitoring the electrical properties of the clean fluid in the electric motor.

FIG. 2BB is a flowchart representation of the data processing implemented steps of monitoring the electrical properties of the wellbore fluid.

FIG. 2CC is a flowchart representation of the data processing implemented steps of monitoring spectrometer data.

FIG. 2DD is a flowchart representation of the data processing implemented steps of monitoring flow rates.

FIG. 3O depicts the simultaneous separation, pumping, and compression operations in a wellbore which produces wellbore fluids such as oil and water, and wellbore gases;

BEST MODE FOR CARRYING OUT THE INVENTION

The present invention will now be described with reference to the following topic headings:

1. OPERATING COMPONENTS AND INSTRUMENTATION OF ELECTRICAL SUBMERSIBLE PUMPS IN ACCORDANCE WITH THE PRESENT INVENTION;
2. MONITORING AND DATA PROCESSING IN ACCORDANCE WITH THE PRESENT INVENTION;
3. USES OF ELECTRICAL SUBMERSIBLE PUMPS IN ACCORDANCE WITH THE PRESENT INVENTION;
4. COMPLEX CONTROL DURING COMPLETION AND PRODUCTION OPERATIONS IN ACCORDANCE WITH THE PRESENT INVENTION.

1. OPERATING COMPONENTS AND INSTRUMENTATION OF ELECTRICAL SUBMERSIBLE PUMPS IN ACCORDANCE WITH THE PRESENT INVENTION

Figure 1A:
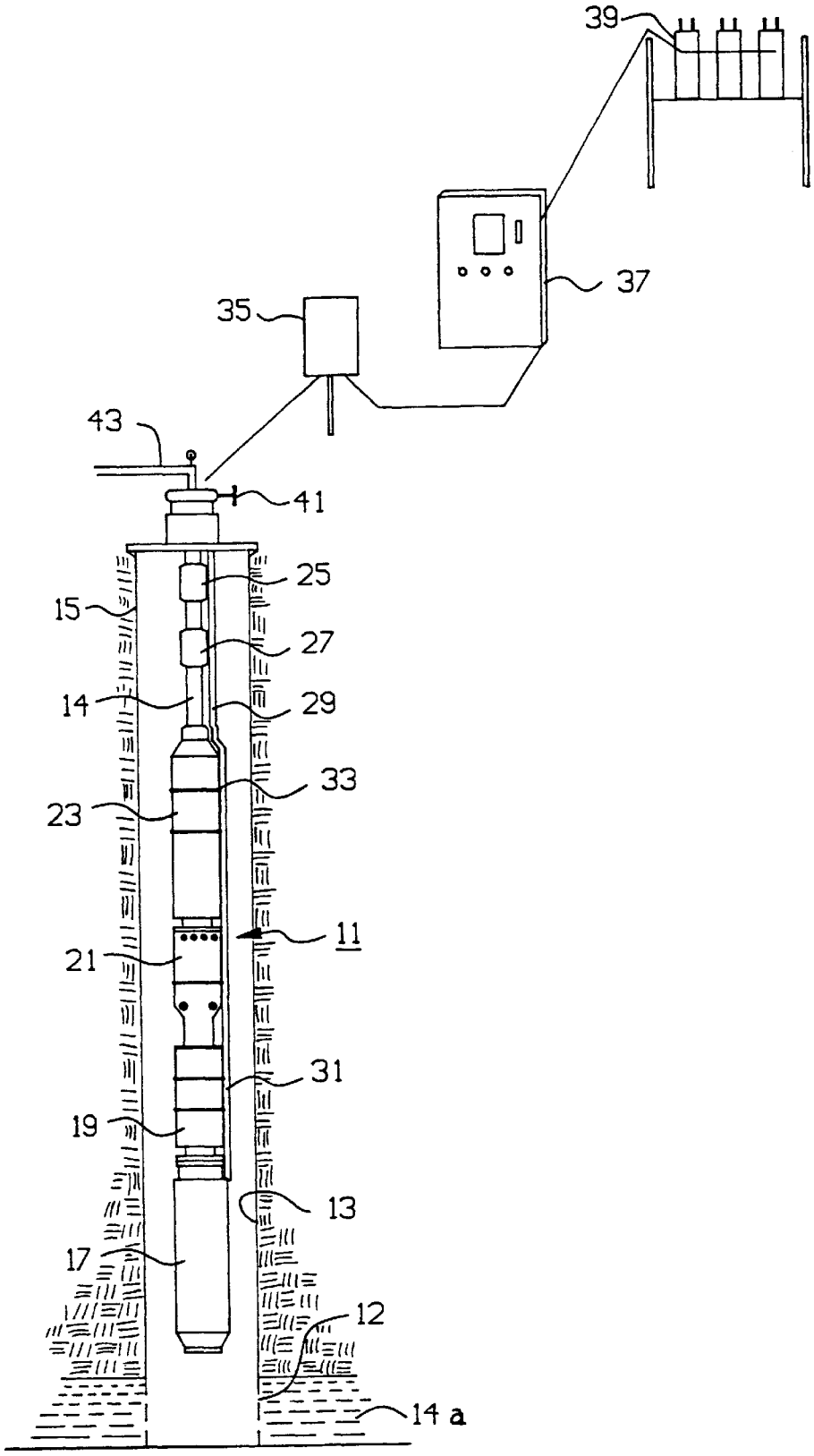
FIG. 1A is a simplified pictorial representation of an electrical submersible pump.

FIG. 1A is a simplified pictorial representation of an electrical submersible pump. As is shown, electrical submersible pump 11 is disposed within wellbore 13 which is cased by casing 15. The electrical submersible pump 11 is carried by tubing string 14. Typically, electrical submersible pump 11 is utilized to lift wellbore fluids 14*a* which enter wellbore 13 through perforations 12. The wellbore fluid 14*a* is directed upward through tubing string 14, and through wellhead 41 to a production flowline 43 for storage in storage tanks (which are not depicted).

Electrical submersible pump 11 includes electrical motor 17 which drives the lifting operations. Electrical motor 17 is energized by power cable 29 and flat cable 31 which extend downward from the earth's surface, and which are secured into position on the outside of tubing string 14 and electrical submersible pump 11 by cable bands 33. Electrical motor 17 includes a fluid-tight housing which houses the electrical motor devices. Seal section 19 serves to further isolate and seal the electric motor housing. Electric motor 17 powers the operation of rotary gas separator 21 and centrifugal pump 23. As is conventional, a check valve 27 is provided to prevent the back flow of production fluid. Additionally, drain valve 25 is provided at an uppermost portion of tubing string 14 to allow drainage and to prevent backflow. Electrical power is provided to electric motor 17 from transmission lines (not shown) through transformers 39, motor controller 37, and junction box 35, in a conventional manner.

Figure 1C:
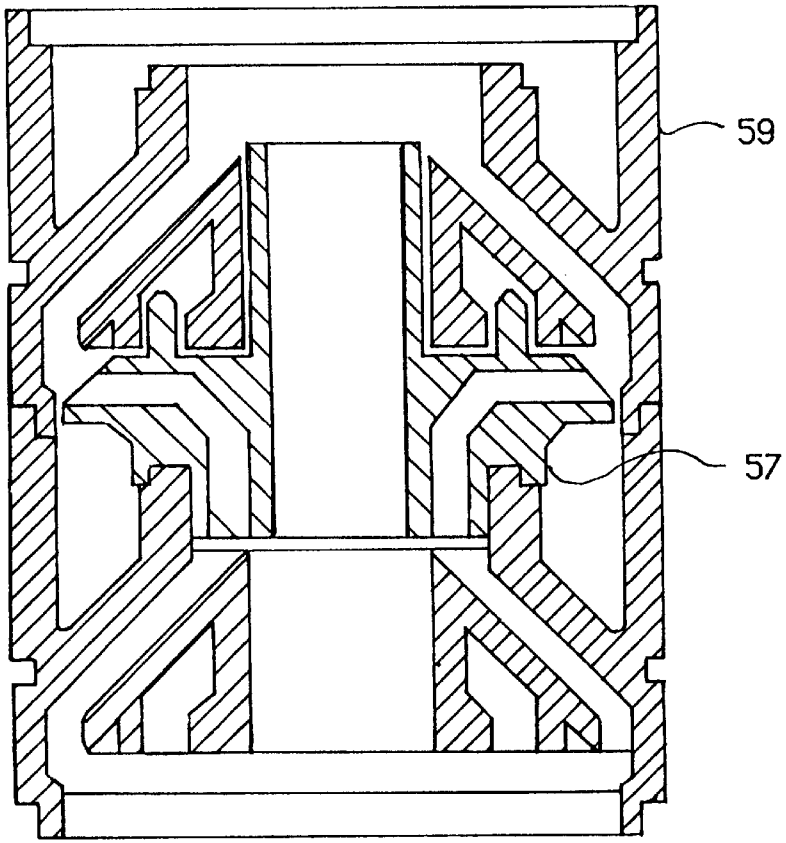
FIGS. 1B and 1C are longitudinal section views of two types of centrifugal pump stages.
Figure 1B:
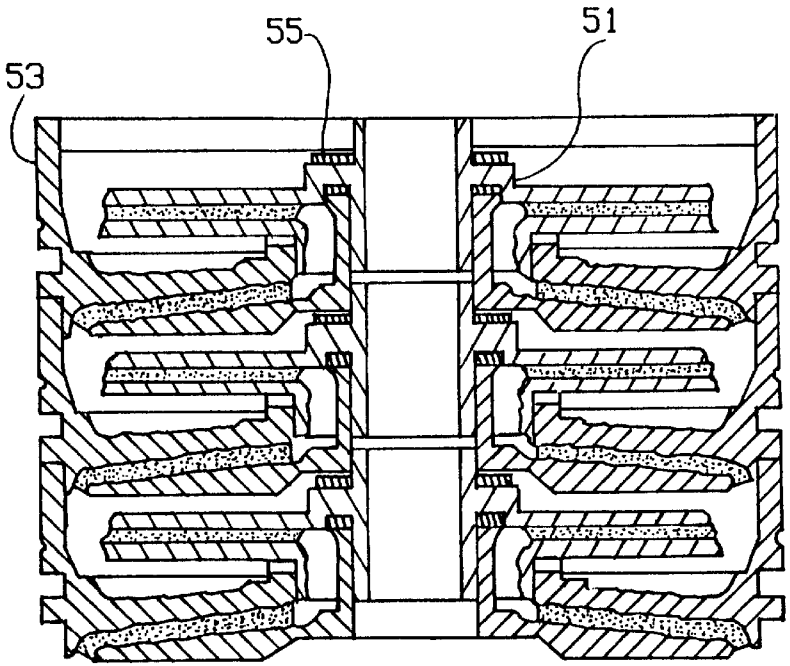

FIGS. 1B and 1C are longitudinal section views of two types of centrifugal pump stages. Electrical submersible pumps usually employ multiple stages of centrifugal pumps. Each stage of a submersible pump consists of a rotating impeller and a stationary diffuser. Generally, the small-flow pumps utilize a "radial flow design" such as that depicted in FIG. 1B, which utilizes the impeller to discharge the fluid in mostly a radial direction. The larger-volume pumps utilize a mixed flow design, such as depicted in FIG. 1C, which discharges the fluid in both axial (upward) and radial directions. As is shown in FIG. 1B, impeller 51 rotates relative to diffuser 53. Thrush washer 55 is provided to accommodate the axial force of impeller 51. Likewise, in accordance with FIG. 1C, in a mixed flow design, impeller 57 rotates relative to diffuser 59 to propel the fluid outward and upward.

Figure 1D:
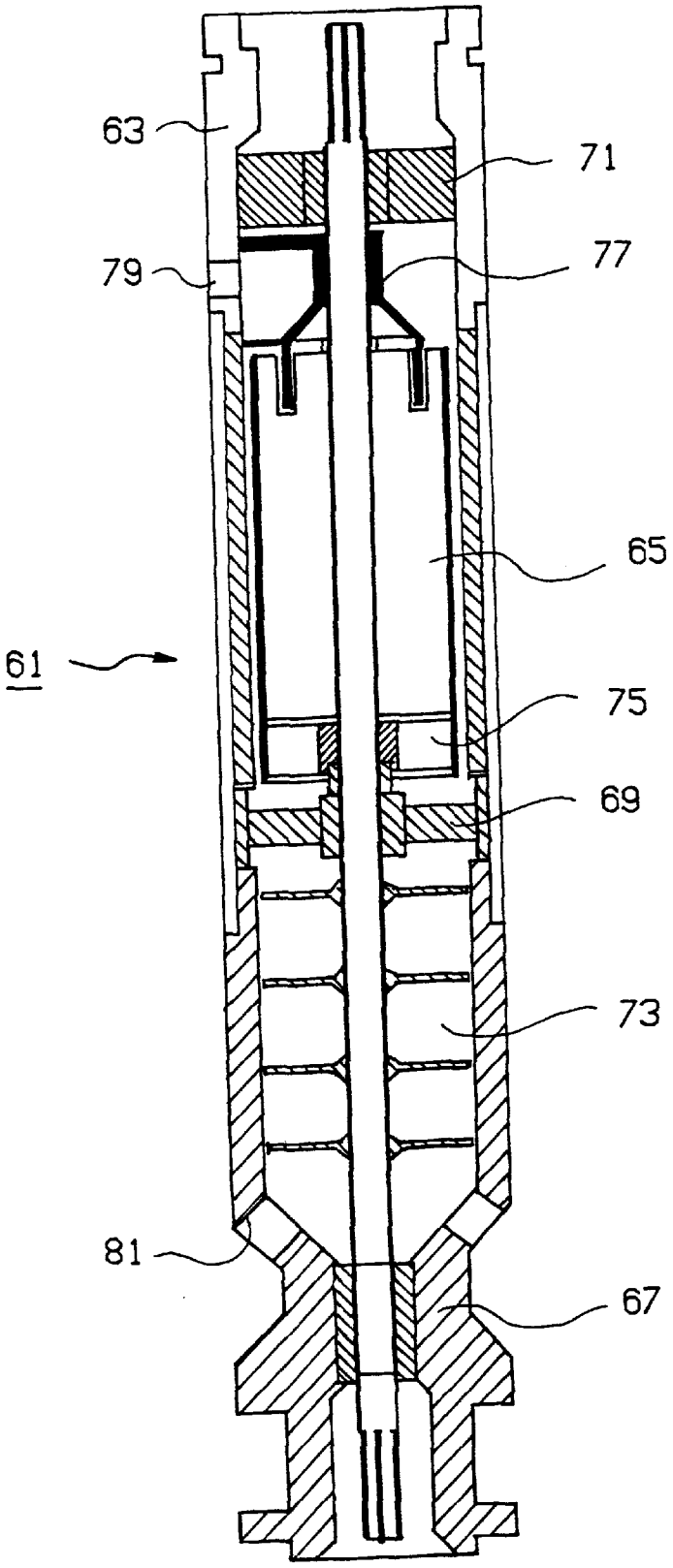
FIG. 1D is a simplified longitudinal section view of a rotary gas separator.

FIG. 1D is a simplified longitudinal section view of a rotary gas separator. The use of electrical submersible pumps in wells which have a high gas-to-oil ratio has been commonplace. Centrifugal pumps are unable to handle large amounts of gas without going into "gaslock". Therefore, rotary gas separators, such as rotary gas separator 61 of FIG. 1D, have been utilized to eliminate or reduce the amount of gas in the production fluids, thus making the utilization of electrical submersible pumps possible in formations which have a high gas-to-oil ratio. Rotary gas separator 61 utilizes centrifugal force to separate the free gas (that is, gas which is not in solution) from the well fluid before the fluid enters into the centrifugal pump section of the electrical submersible pump. As is shown in FIG. 1D, rotary gas separator 61 includes housing 63 and rotor 65 which is rotated by the action of electric motor 17 (of FIG. 1A). Rotor 65 is supported relative to housing by radial bearing 67, spider bearing 69, and spider bearing 71. Wellbore fluid that enters the separator through port 81 is forced into the rotating centrifuge chamber of rotor 65 by the action of inducer 73. When the wellbore fluid is in the centrifuge, the fluid with the higher specific gravity is forced to the outer wall of the rotating chamber by centrifugal force, thus leaving the free gas in or near the center of rotor 65. The gas is separated from the fluid by crossover 77 and exhausted to the wellbore through ports, such as port 79. The wellbore liquids are directed to the intake of this centrifugal pump, where they are pushed upward to the surface through tubing string 14 of FIG. 1A. Gas separators typically obtain an efficiency of 80 percent to 95 percent removal of the free gas from wellbore fluids. The overall efficiency of rotary gas separator 61 is effected by the volume of the fluids, the composition of the fluids, and other properties of the fluids. It is not uncommon for gas separator assemblies to be connected in tandem in order to improve the overall efficiency when large amounts of free gas are present in the wellbore fluids.

Figure 1E:
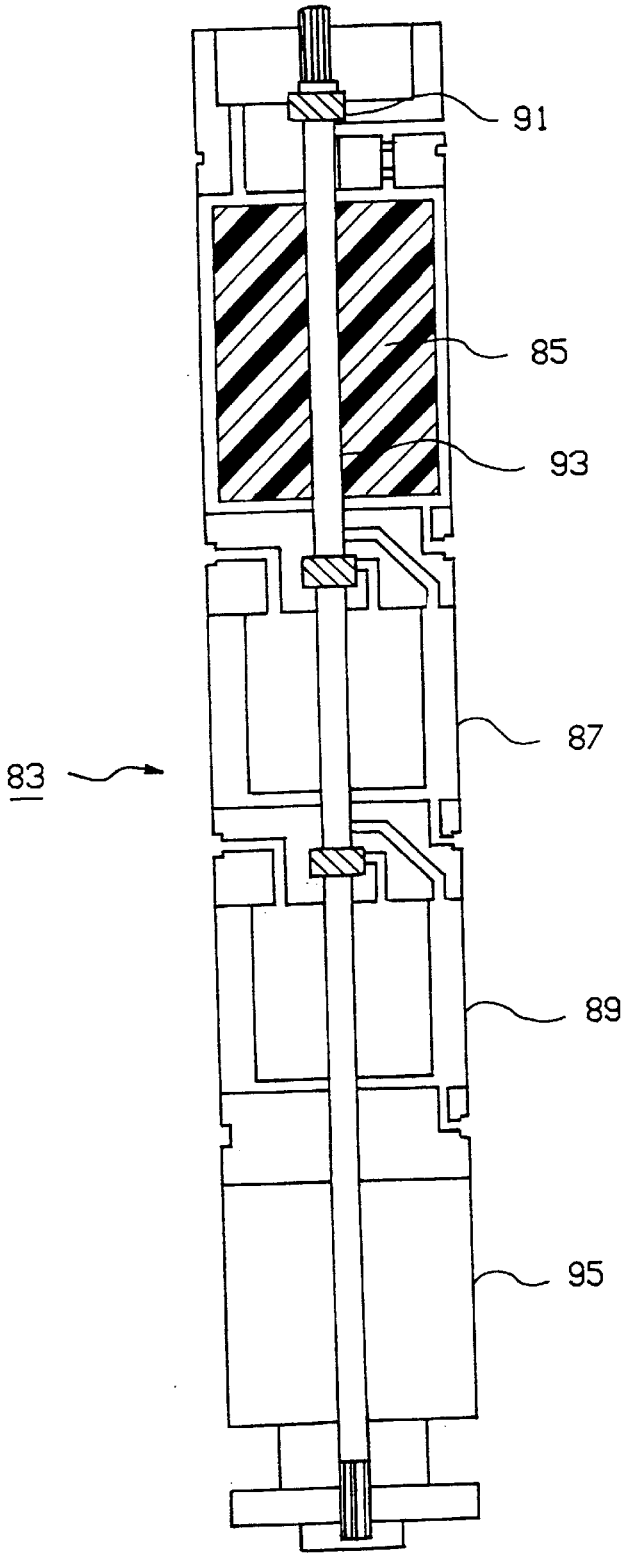
FIG. 1E is a simplified longitudinal section view of a seal section of an electrical submersible pump.

FIG. 1E is a simplified longitudinal section view of a seal section of an electrical submersible pump. The seal section operates to connect the drive shaft of the electrical motor to the pump or gas separator shaft. It performs several important functions. First, it allows for the expansion of the dielectric oil contained in the housing for the electrical motor. Temperature increases result in expansion of the dielectric oil which is contained within the electrical motor housing. The seal section absorbs expansion of the dielectric oil. Second, the seal section operates to equalize the pressure differential between the ambient wellbore pressure and the pressure of the dielectric oil contained within the electric motor housing. Third, the seal section operates to isolate wellbore fluid from the clean dielectric oil contained within the motor housing. Fourth, the seal section operates to absorb any downward thrusts of the pump during operation.

In seal section 83, mechanical seal 91 allows shaft 93 to rotate, while preventing or minimizing the inward flow of wellbore fluids. Elastomer bag 85 provides a positive barrier to the entry of wellbore fluids. Labyrinth chambers 87, 89 provide fluid separation based on the difference in densities between wellbore fluid and the dielectric motor oils. Any fluid that gets past mechanical seal 91 or elastomer bag 85 is contained in the lower portion of the labyrinth chambers 87, 89. Thrust chamber 95 absorbs the axial thrust of the pump operation.

Figure 1F:
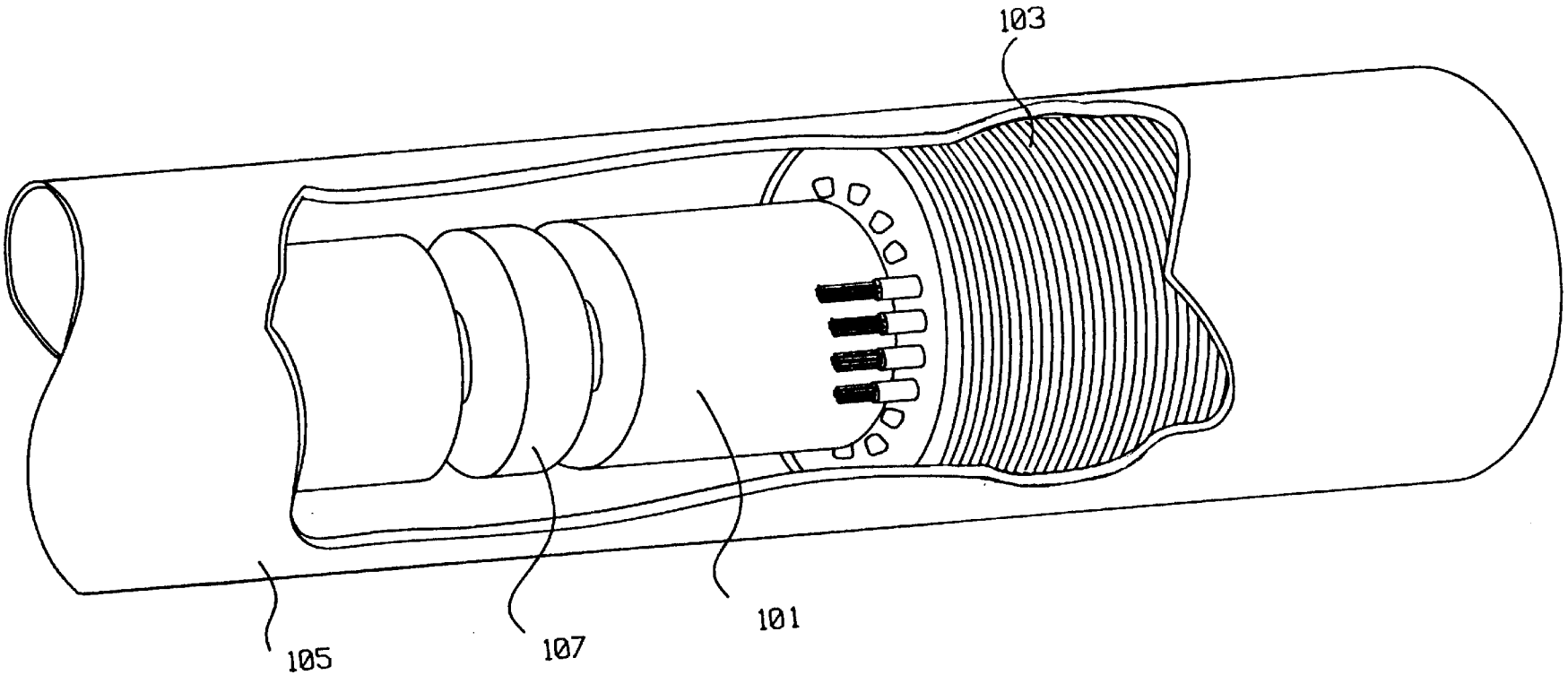
FIG. 1F is a fragmentary sectional view of a stator and rotor assembly of an electrical motor of an electrical submersible pump.

FIG. 1F is a fragmentary sectional view of a stator and rotor assembly of an electrical motor. Typically, electrical submersible pumps utilize two-pole, three-phase, squirrel cage, induction motors. As stated above, the motor cavity is filled with a highly refined mineral oil with a high dielectric strength. The motors for electrical submersible pumps include rotors, which are usually 12–18 inches in length, such as rotor 101, that are mounted on a shaft and located in the electrical field generated by stator windings, such as stator windings 103. Radial bearings, such as radial bearing 107, are provided to allow the rotors to rotate relative to the stators. All of these components are contained within steel housing 105.

Figure 1G:
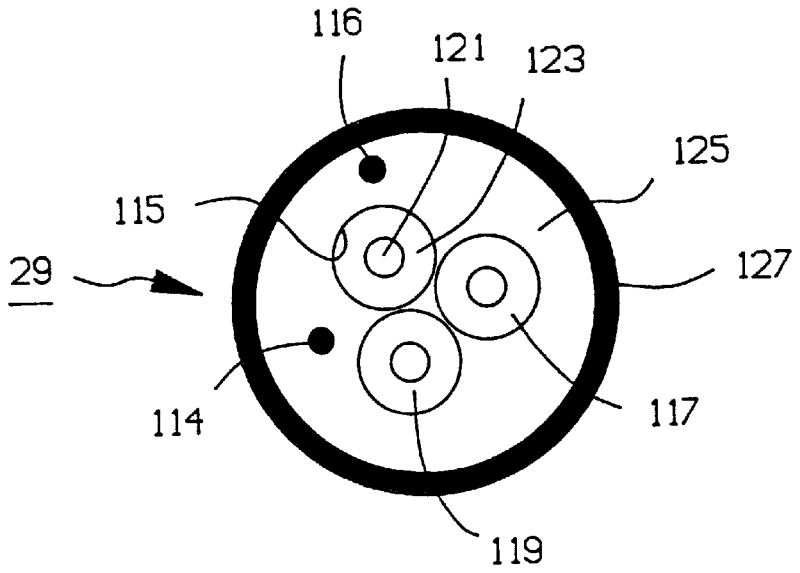
FIG. 1G depicts power cable 29 of FIG. 1A in cross-section view.
Figure 1H:
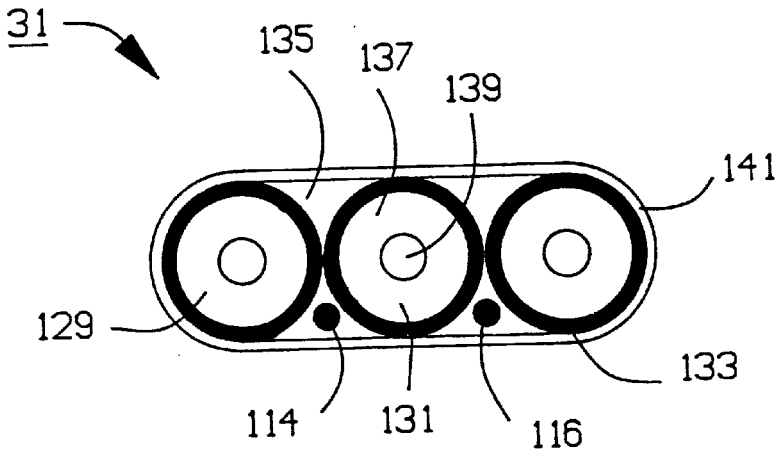
FIG. 1H is a cross-section view of flat cable 31 of FIG. 1A.

As is shown in FIG. 1A, electrical power is provided to electrical submersible pump 11 through power cable 29 and flat cable 31. FIG. 1G depicts power cable 29 of FIG. 1A in cross-section view. As is shown, power cable includes first conductor 115, second conductor 117, and third conductor 119. Each of these conductors includes a conductor element 121 which is electrically insulated by insulator 123 and jacketed by jacket 125. Conductors 115, 117, 119 are bundled and protected by armor 127. FIG. 1H is a cross-section view of flat cable 31 of FIG. 1A. As is shown in FIG. 1H, flat cable 31 includes first conductor 129, second conductor 131, and third conductor 133. Each of these conductors includes a conductor portion 139 which is electrically insulated by insulation 137 and jacketed with jacket 135. The conductors 129, 131, 133 are bundled together and protected by armor 141. Some particular embodiments may also require the use of an electrical data bus 114 or a fiber optic data line 116 to allow for the rapid transmission of large blocks of data or program instructions.

Figure 1I:
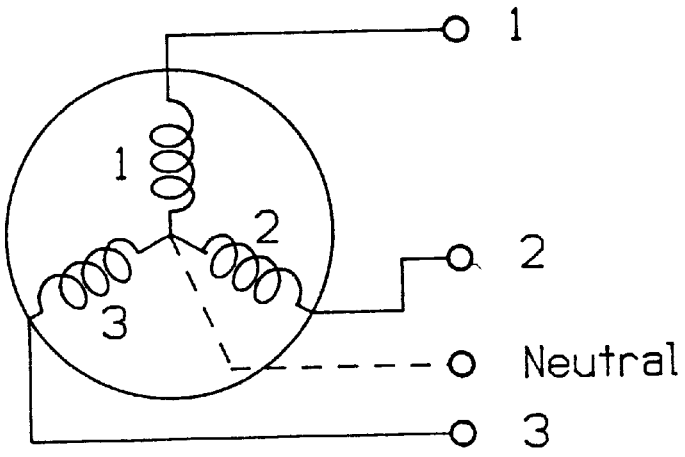
FIG. 1I depicts a wye connection for an electrical submersible pump.
Figure 1J:
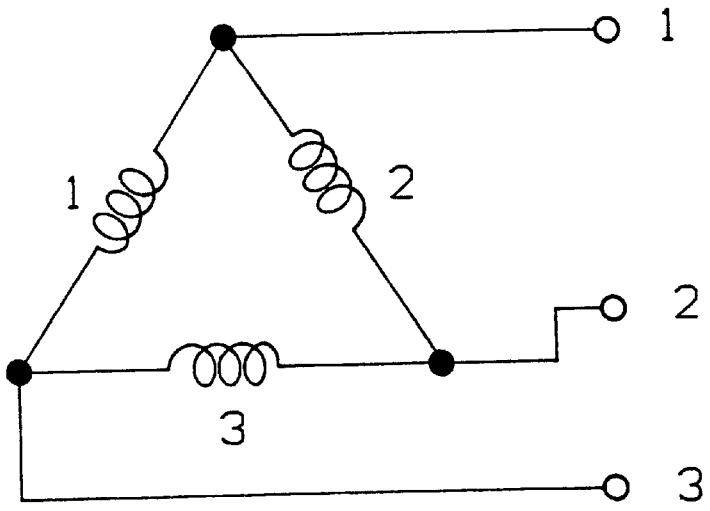
FIG. 1J depicts a delta connection for an electrical submersible pump.
Figure 1K:
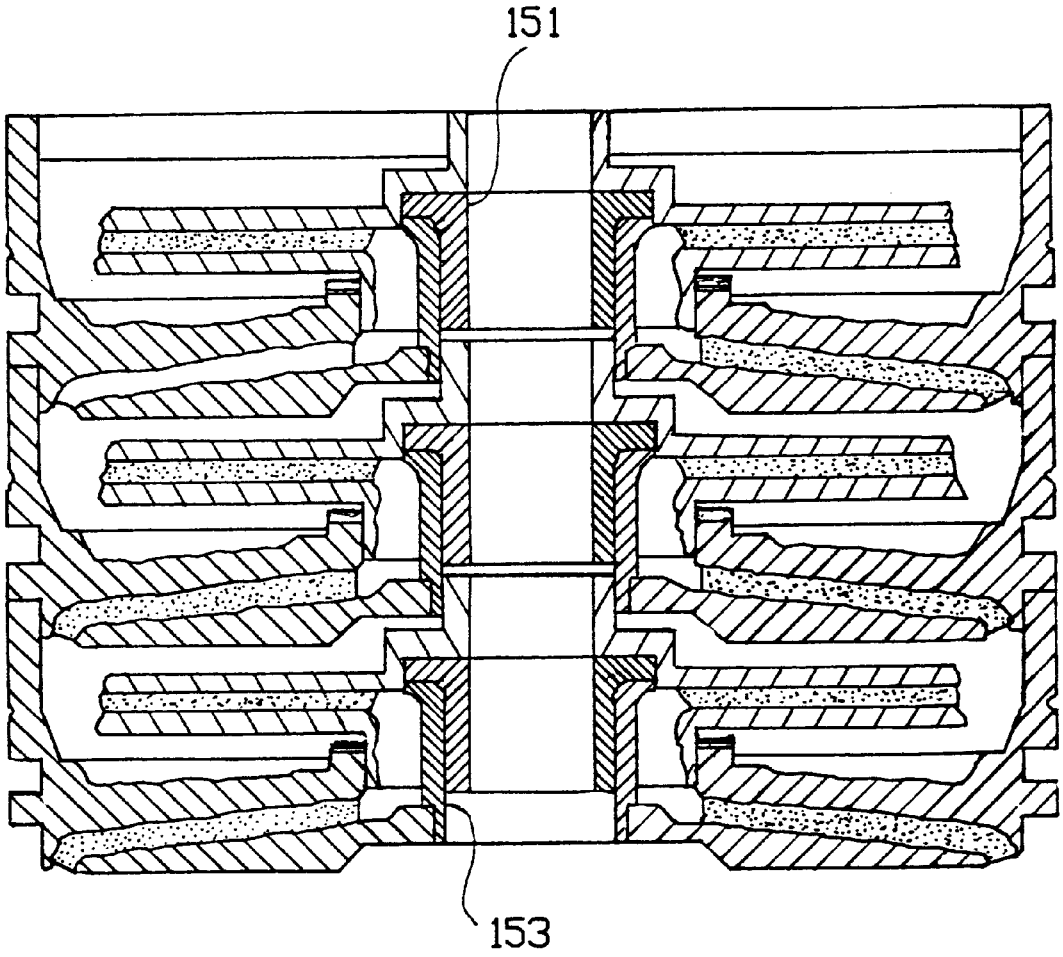
FIG. 1K is a longitudinal section view of a centrifugal pump section which includes hardened flange sleeves.

The electrical cables are connected to the electrical motor 17 of electrical submersible pump 11 through either a wye connection or a delta connection. FIG. 11 depicts a wye connection, and FIG. 1J depicts a delta connection. As is conventional in three-phase power distribution, each of the three nodes depicted in FIGS. 1I and 1J are connected to a different conductor path within flat cable 31 and power cable 29. These conductors apply a voltage to a motor winding which is 120 degrees out of phase from the voltage produced in the other two motor windings. If electrical submersible pump 11 of FIG. 1A is to be utilized to lift fluids which include an unusually large amount of particulate matter, the components of centrifugal pump 23 can be hardened to withstand the abrasion. FIG. 1K is a longitudinal section view of a centrifugal pump section which includes hardened flange sleeves, such as hardened flanged sleeve 151, and hardened mushroom inserts, such as hardened mushroom insert 153. With these parts hardened by conventional techniques, the centrifugal pump 23 of electrical submersible pump 11 is better able to withstand the otherwise destructive impact of pumping fluids which have a high particulate matter content.

Figure 1L:
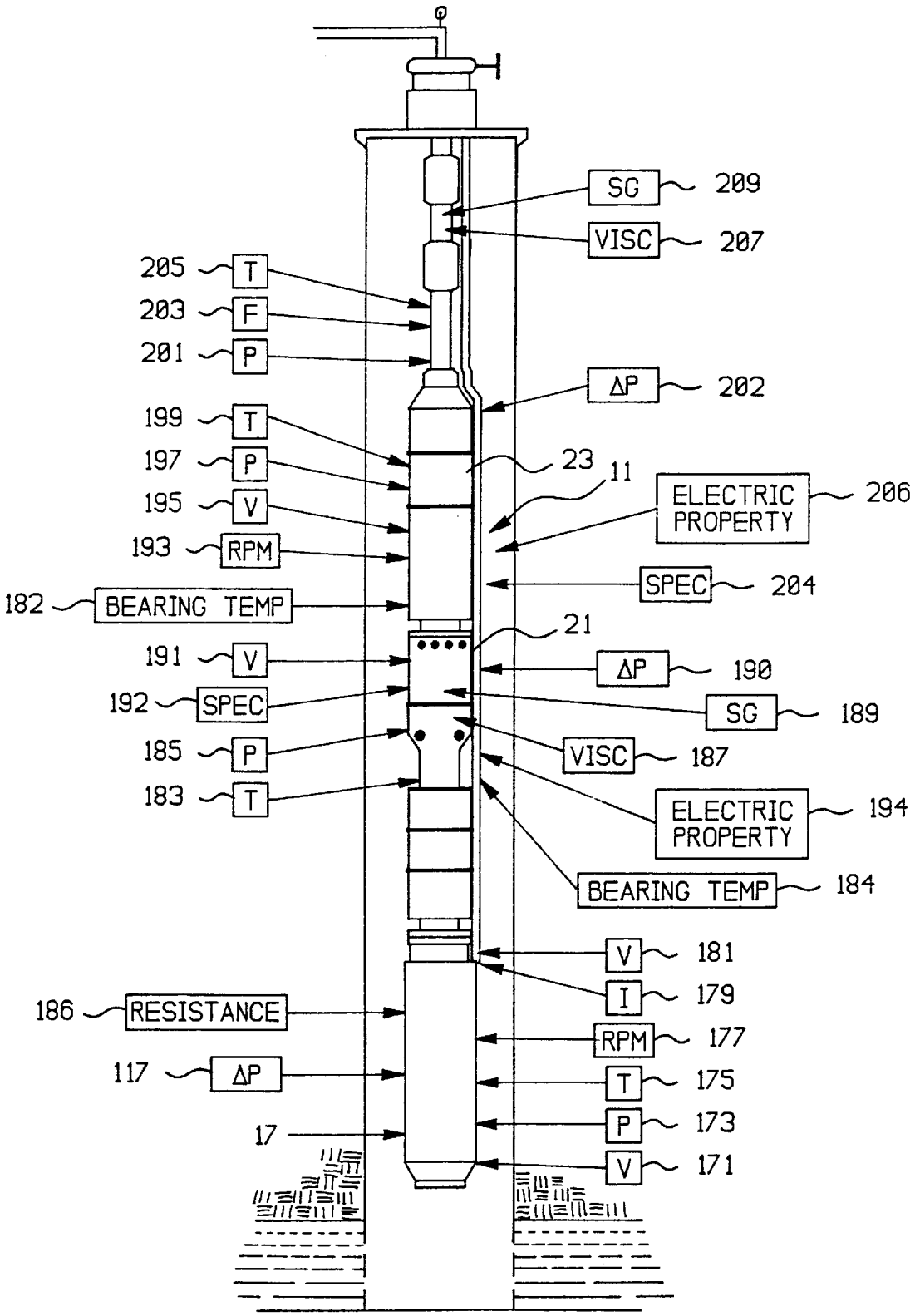
FIG. 1L is a simplified depiction of the sensor instrumentation of an electrical submersible pump in accordance with the present invention.

FIG. 1L is a simplified schematic depiction of an electrical submersible pump for monitoring sensor data and controlling the operation of electrical submersible pump 11 utilizing a motor controller which is resident within electrical submersible pump 11. A plurality of sensors are placed within the electrical submersible pump 11. Vibration sensors 171 are provided to detect vibrations produced as a result of operation of electrical motor 17. Pressure sensor 173 is provided within electrical motor 17 to provide a measure of the pressure of the dielectric motor oil contained within the housing. Temperature sensor 175 is provided within electrical motor 17 to provide a measure of the temperature of the dielectric oil contained within the housing of electric motor 17. An RPM sensor 177 is provided within the housing of electric motor 17 in order to provide a measure of the rotation rate of the rotor portion of the electric motor. Current sensor 179 is provided to provide a measure of the current provided to the three windings of the electric motor 17. Voltage sensor 181 is provided to provide a measure of the measure of the voltage applied to each of the three windings in electric motor 17. Additionally, a differential pressure sensor 117 is utilized to monitor the differential pressure between the sealed portions of the electric motor 17 and the surrounding wellbore, and an electrical sensor (such as resistivity and/or capacitance sensors) may also be utilized to monitor the quality of the seal by detecting changes in the electrical properties of the clean fluid as it is invaded by wellbore fluid when leaks occur.

A plurality of sensors are provided within rotary gas separator 21 in order to provide measurements of operating properties of the rotary gas separator 21. A temperature sensor 183 is provided to provide a continuous indication of the temperature of the ambient wellbore fluid which are being drawn into rotary gas separator 21. A pressure sensor 185 is provided to provide a continuous measurement of the intake pressure of the wellbore fluid. Alternatively, a differential pressure sensor 190 may be utilized to monitor the difference in pressure between various parts of the rotary gas separator 21. Conventional viscosity and specific gravity sensors 187, 189 are provided at the intake of rotary gas separator 21 to provide two signals which are generally indicative of the relative oil, gas, and water content of wellbore fluids which are drawn into rotary gas separator 21. Alternatively or additionally, a miniaturized, sold state spectrometer 192 may be utilized to monitor the chemical composition of both or either of fluid flowing into and out of rotary gas separator 21, and a resistivity/conductivity/dielectric constant sensor 194 may be utilized to determine the likely content of wellbore fluids based upon the value or changes in values of an electrical attribute, for example, since oil is relatively high in electrical resistance in comparison to water.

Centrifugal pump 23 is also extensively instrumented in accordance with the present invention. At least one RPM sensor 193 is provided to provide a measure of the speed of rotation of one or more stages of centrifugal pump 23. A vibration sensor 195 is provided to provide measurement of the vibration produced as a result of the operation of centrifugal pump 23. A pressure sensor 197 is provided to provide a continuous measure of the pressure at one or more stages of centrifugal pump 23. A temperature sensor 199 is also provided to provide a continuous measure of the temperature of the fluid passing through the stages of centrifugal pump 23. The output of centrifugal pump 23 is also monitored. A pressure sensor 201 is provided to provide a measure of the output pressure of centrifugal pump 23. A flow meter 203 is provided to provide a continuous measure of the velocity of the fluid exiting from centrifugal pump 23. A temperature sensor 205 is provided to provide a continuous measure of the temperature of the fluid passing out of centrifugal pump 23. Additionally, viscosity and specific gravity sensors 207, 209 are provided to provide a measurement which is generally indicative of the oil, gas, and water content of the fluid passing out of centrifugal pump 23. Additionally, a differential pressure sensor 202 may be utilized to monitor the difference in pressure between either two points within centrifugal pump 23 or between a point within centrifugal pump 23 and a point exterior of the centrifugal pump 23, and a miniaturized, solid state spectrometer 204 may be utilized to monitor the likely chemical composition of fluids passing through centrifugal pump 23, and an electric attribute sensor 206 may be utilized to monitor at least one of resistivity and dielectric properties of fluids passing through centrifugal pump 23. The electrical submersible pump 11 of the present invention is also equipped with sensors 182, 184, for monitoring bearing temperature of the centrifugal pump 23 and the rotary gear separator 21. Also, the quality of the electrical resistors can be monitored utilizing resistance sensors 186 which applies a voltage to a insulator of interest and monitors for leakage current.

Preferably, these sensors may be located within the various portions of electrical submersible pump 11 which require monitoring. Wire pathways may be formed through the housings for centrifugal pump 23, rotary gas separator 21, seal section 19, and electric motor 17. Preferably, one or more of these housing sections is slightly elongated in order to accommodate an electronics chamber which is sealed, or alternatively, the electronics section may be located under the electric motor 17. The electronics chamber carries a controller (such as a microprocessor), input/output devices such as receivers and transmitters (which preferably allow communication over the power cable, as discussed in detail further below), a motor controller which allows for conventional control over the operating state and condition of the electrical submersible pump 11, (such as on/off, speed, and timed control), and conventional analog-to-digital converters, non-volatile memory, and read only memory. In accordance with the present invention, the controller is utilized to execute preprogrammed instructions in order to monitor sensor data and control the operation of electrical submersible pump 11. These components will now be described with reference to FIGS. 1M and 1N.

Figure 1M:
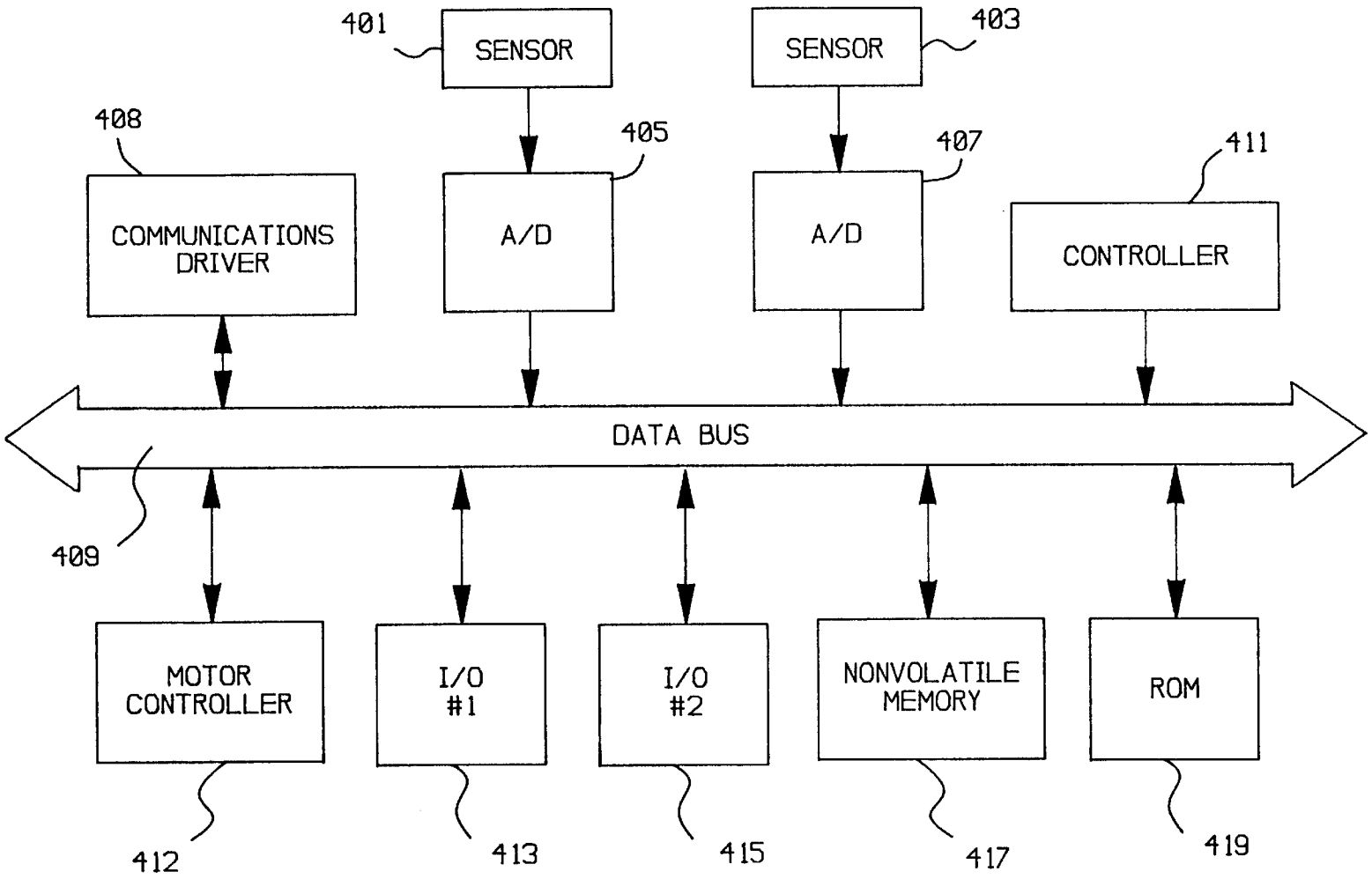
FIG. 1M is a block diagram representation of the components which are utilized to perform signal processing, data analysis, and communication operations, in accordance with the present invention.

FIG. 1M is a block diagram representation of the components which are utilized to perform signal processing, data analysis, and communication operations, in accordance with the present invention. As is shown therein, sensors, such as sensors 401, 403, provide analog signals to analog-to-digital converters 405, 407, respectively. The digitized sensor data is passed to data bus 409 for manipulation by controller 411. The data may be stored by controller 411 in nonvolatile memory 417. Program instructions which are executed by controller 411 may be maintained in ROM 419, and called for execution by controller 411 as needed. Controller 411 may comprise a conventional microprocessor which operates on eight or sixteen bit binary words. Controller 411 may be programmed to administer merely the recordation of sensor data in memory, in the most basic embodiment of the present invention; however, in more elaborate embodiments of the present invention, controller 411 may be utilized to perform analyses of the sensor data and/or to supervise communication of the processed or unprocessed sensor data to another location within the wellbore. The preprogrammed analyses may be maintained in memory in ROM 419, and loaded onto controller 411 in a conventional manner. In still more elaborate embodiments of the present invention, controller 411 may provide local control and diagnostics or it may pass digital data and/or control signals to either another location within the wellbore or drillstring, or to a surface location. The input/output devices 413, 415 may be also utilized for reading recorded sensor data from nonvolatile memory 417. As is also shown in FIG. 1M, motor controller 412 may communicate through data bus 409 with controller 411 and the other data processing components and may utilize communications driver 408. Motor controller 412 may comprise any one of the three basic types of motor controllers used in the prior art with electrical submersible pumps. The three basic types of controllers include a switchboard motor controller, a soft starter motor controller, and a variable speed motor controller. All three of these motor controllers utilize solid state circuitry to provide protection and control for electrical submersible pump systems. In the current state of the art, motor controllers are located at a surface location, but it is foreseeable that controllers can be miniaturized and located downhole.

Generally speaking, a switchboard motor controller consists of a motor starter, solid state circuitry for overload and underload protection, circuit breakers and time delay circuitry. Most conventional solid state switchboard controllers offer time delayed underload protection on all three phases, time delayed overload protection, and automatic protection against voltage or current under balance. Underload, or some other type of pump-off protection, is necessary since low flow passing through the motor will not give adequate cooling, and will cause the motor to overheat, which may result in motor failure.

A soft starter motor controller is utilized to control the amount of power delivered to the motor of the electrical submersible pump as it is coming up to speed. This is accomplished typically by dropping the voltage to the motor terminals during the initial start-up phase. Reactive circuit components or solid state devices may be utilized to accomplish this goal. Most solid state soft starter motor controllers typically use power semiconductors such as silicone controlled rectifiers to regulate the power to the electrical submersible pump. Once the electrical motor of the electrical submersible pump is brought up to speed, the solid state reactive circuit components are bypassed.

A variable speed motor controller allows the pump speed to be varied. Additionally, the pumping rate and the pump head, or both, can be adjust depending upon the application, without physical modification of the downhole unit. In its basic operation, the variable speed motor controller converts the incoming three phase alternating power to a single DC power supply. It then uses power semiconductors as solid state switches to invert the DC supply to regenerate the three AC output phases as pseudo-sinewave power. The frequency and voltage of the pseudo-sinewave power is subject to control, such as computer control through controller 411. In accordance with the present invention, motor controller 412 may utilize its own (conventional) electronics to turn the electrical submersible pump on and off, and to vary its speed in the case of a variable speed motor controller. Additionally, and in accordance with present invention, motor controller 412 is also under the control of controller 411. Controller 411 executes program instructions contained in memory, and may control the on/off condition and operating speed of the electrical submersible pump in accordance with program decisions made based on monitored sensor data.

Figure 1N:
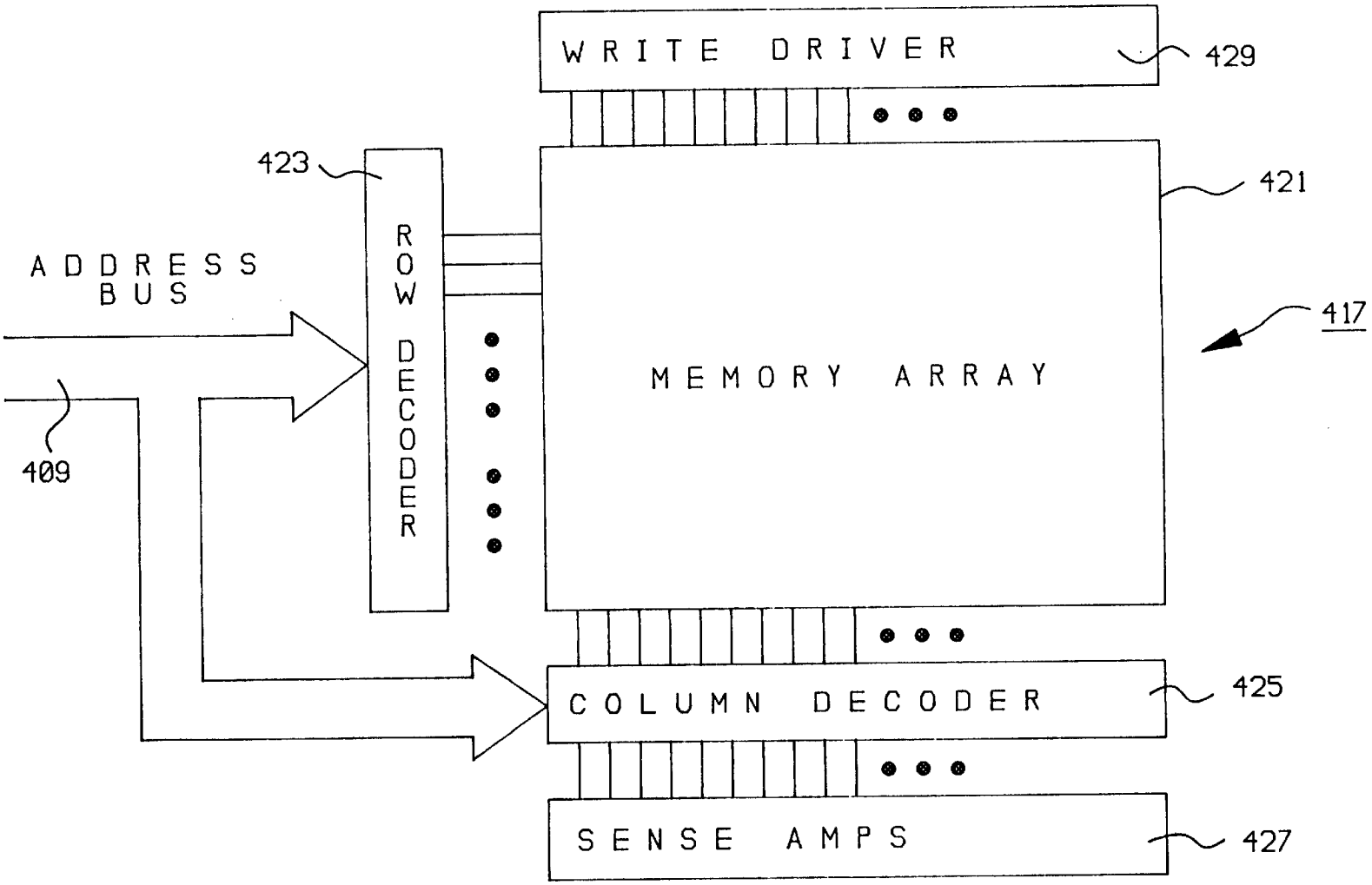
FIG. 1N is a block diagram depiction of electronic memory utilized in the present invention to record data.

FIG. 1N is a block diagram depiction of electronic memory utilized in the present invention to record data. Nonvolatile memory 417 includes a memory array 421. As is known in the art, memory array 421 is addressed by row decoder 423 and column decoder 425. Row decoder 423 selects a row of memory array 417 in response to a portion of an address received from the address bus 409. The remaining lines of the address bus 409 are connected to column decoder 425, and used to select a subset of columns from the memory array 417. Sense amplifiers 427 are connected to column decoder 425, and sense the data provided by the cells in memory array 421. The sense amps provide data read from the array 421 to an output (not shown), which can include latches as is well known in the art. Write driver 429 is provided to store data into selected locations within the memory array 421 in response to a write control signal.

The cells in the array 421 of nonvolatile memory 417 can be any of a number of different types of cells known in the art to provide nonvolatile memory. For example, EEPROM memories are well known in the art, and provide a reliable, erasable nonvolatile memory suitable for use in applications such as recording of data in wellbore environments. Alternatively, the cells of memory array 421 can be other designs known in the art, such as SRAM memory arrays utilized with battery back-up power sources.

2. MONITORING AND DATA PROCESSING IN ACCORDANCE WITH THE PRESENT INVENTION

The present invention brings together a variety of important features. First, the electrical submersible pump is equipped with local data processing capabilities through the use of one or more microprocessors and associated electrical and electronic components such as non-volatile memory. The processor may be preprogrammed to monitor and control the operations of the electrical submersible pump in accordance with either preprogrammed instructions or with commands communicated from a remotely located surface or subsurface site, utilizing a conductor-based or wireless data communication system. Second, the electrical submersible pump of the present invention is extensively instrumented with a variety of sensors. Some of these sensors monitor the operating condition of one or more components of the electrical submersible pump, such as internal pressure, internal temperature, vibration, rotary speed, and the like. Other sets of sensors monitor ambient conditions such as ambient temperature and pressure. The composition of the wellbore fluid can be inferred from measurements of the specific gravity and viscosity of the fluid or from miniaturized, solid state mass spectrometers. This is particularly useful in separation operations wherein the composition of the input of the separator is compared to the composition of the output of the separator in order to determine a measure of the effectiveness of the separation. Still other sensors monitor the overall attributes of the electrical submersible pump, such as pump efficiency, pump horsepower, the power factor of the electrical motor, and electrical motor efficiency. The sensors can be utilized to detect dangerous operating conditions such as insufficient pump input pressure, and the onset or impending occurrence of either cavitation or gas-lock. Third, the electrical submersible pump of the present invention utilizes volatile and nonvolatile memory for recording program instructions, receive commands and data, and sensed data. Fourth, the electrical submersible pump of the present invention may include a resident motor controller which operates to provide control over the on/off condition of the pump, as well as the operating speed of the pump or it may interact through communication with motor controller(s) located at the surface. Fifth, the electrical submersible pump of the present invention includes communication capabilities. Preferably, one input/output device comprises a transmitter which is utilized to communicate with other subsurface and surface sites. The other input/output device is utilized to receive communications from other subsurface and surface sites. One suitable data transmission system is described in detail in pending U.S. patent application, Ser. No. 08/262,807, entitled "Method and Apparatus for Transmitting Data Over a Power Cable Utilizing a Magnetically Saturable Core Reactor", filed Jun. 17, 1994, and identified by attorney docket no. 104-6455-US, which is incorporated herein by reference as if fully set forth, and is particularly suited for impressing digital data on the power cable which extends through the wellbore to provide electrical energy to the electrical motor of the electrical submersible pump. Alternative communication systems, such as acoustic data communication systems or fiber optic communication systems, may be utilized in lieu of the "hardwire" communication system described below.

The data processing implemented monitoring and control operations of the present invention will now be described. In general, controller 411 of FIG. 1M is preprogrammed with program instructions which allow for the continual or intermittent monitoring of one or more sensors carried by the electrical submersible pump, and processed in order to control the operating state of the electrical submersible pump, or to provide information or commands to other wellbore or surface equipment (which are based at least in part upon the monitored and processed data). Alternatively, the controller 411 may be reprogrammed with new instructions by passing blocks of program instructions from a surface location to the controller 411 over the hardwire, fiber optic, or acoustic communication systems.

For electrical submersible pumps, a minimum amount of intake pressure is necessary in order to properly feed the pump and prevent cavitation or gas-locking in the pump. Cavitation is an undesirable condition which can damage or destroy pumps. Cavitation occurs as follows. When a liquid enters the eye of the pump and impeller, it increases in velocity. This increase in velocity is accompanied by a reduction in pressure. If the pressure falls below the vapor pressure corresponding to the temperature of the liquid, the liquid will vaporize. This results in the generation of pockets of vapor within the liquid. As the fluid flows further through the impeller, and companion impellers, the liquid reaches a region of higher pressure and the cavities of vapor collapse. Cavitation results in noise and vibration, caused by the collapse of the vapor bubbles as they reach the high pressure side of the impeller. This noise and vibration can cause shaft breakage and other fatigue failures in the pump. Cavitation will not occur if there is a sufficient intake pressure for the electrical submersible pump. In accordance with the present invention, the intake pressure of electrical submersible pump is continually monitored by controller 411 to determine if the minimum intake pressure is present. If the minimum intake pressure is not present, then the controller can alter at least one operating condition as per programming instructions, record the event, optionally communicate the event, and optionally communicate commands to other wellbore tools. For example, if the required pump intake pressure is not present, the speed of the motor may be altered by controller 411 by issuing commands to motor controller 412. Optionally, controller 411 can issue commands to motor controller 412 which turn the pump from an "on" condition to an "off" condition.

Figure 2A:
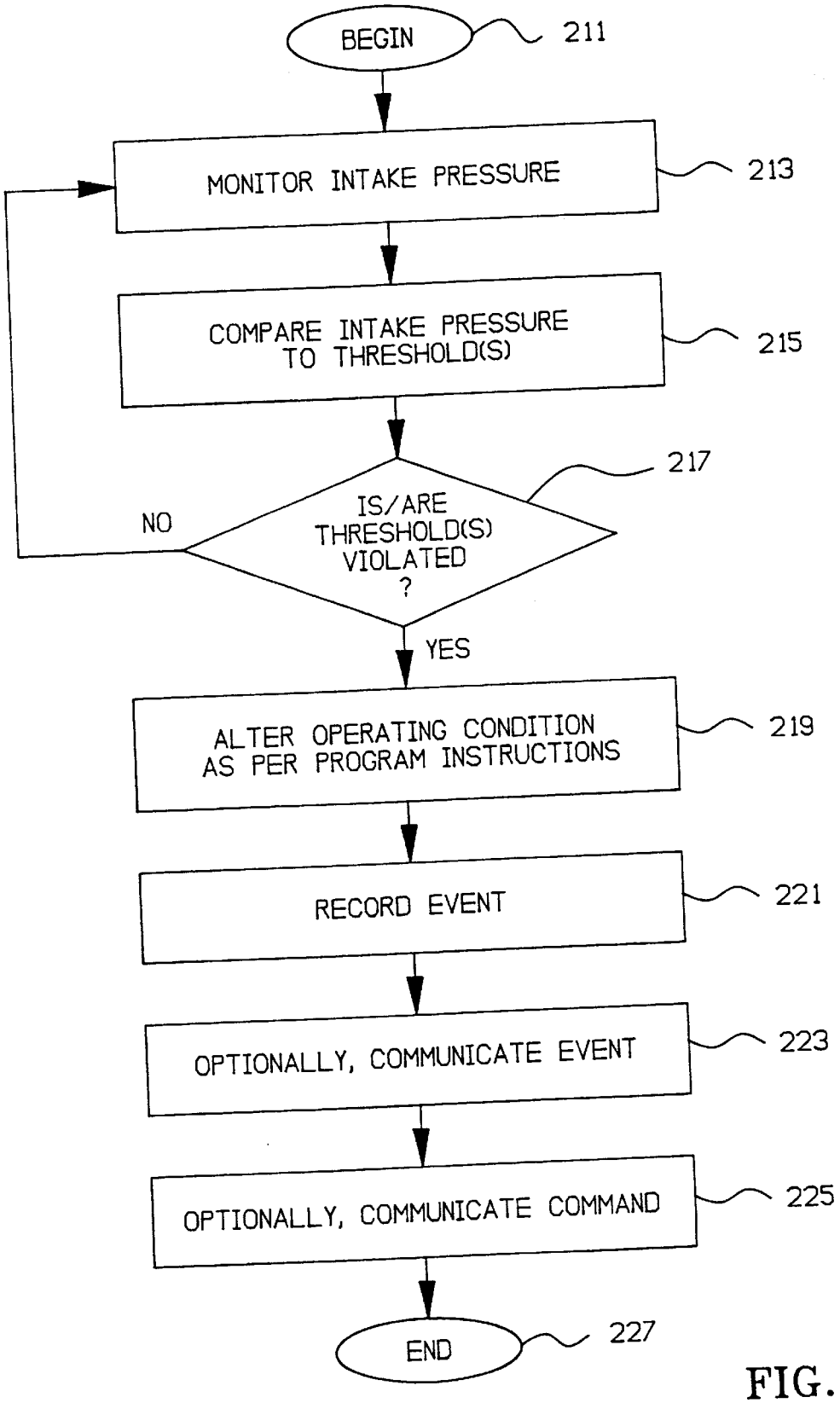
FIG. 2A is a flowchart representation of data processing implemented monitoring of the pump intake pressure of electrical submersible pumps, in accordance with the present invention.

FIG. 2A is a flowchart representation of the monitoring operations. The process begins at software block 211, and continues at software block 213, wherein controller 411 continually monitors intake pressure for the electrical submersible pump utilizing one or more pressure sensors. In accordance with software block 215, the intake pressure is compared to one or more intake pressure thresholds which have been recorded in memory or in program instructions. As with this, and all other thresholds discussed below, a single threshold may be provided, or a pressure "bandwidth" may be provided which is defined by at least two pressure magnitudes. In accordance with software block 217, controller 411 compares the actual monitored pump intake pressure to the required pump intake pressure in order to determine whether the threshold or thresholds have been violated; if the pressure thresholds have not been violated, the process returns to software block 213; however, if the pressure threshold or thresholds have been violated, the process continues to software block 219. In software blocks 219–227, the controller 411 alters one or more operating conditions as per program instructions, records events and communicates events and/or commands. For example, controller 411 may pass commands to motor controller 412 which switch the electrical motor of the electrical submersible pump from an "on" condition to an "off" condition. Alternatively, controller 411 may pass commands to motor controller 412 which reduces the operating speed of the electric motor, thus reducing the required pump intake pressure. In fact, the pressure threshold or thresholds may constitute a family of thresholds for a variety of operating speeds. A table may be provided in memory which maps a particular operating speed to a particular minimum required pump intake pressure threshold. In this manner, the electrical submersible pump may be operated over a wide range of operating speeds to accommodate a dynamic and changing intake pressure level.

Figure 2B:
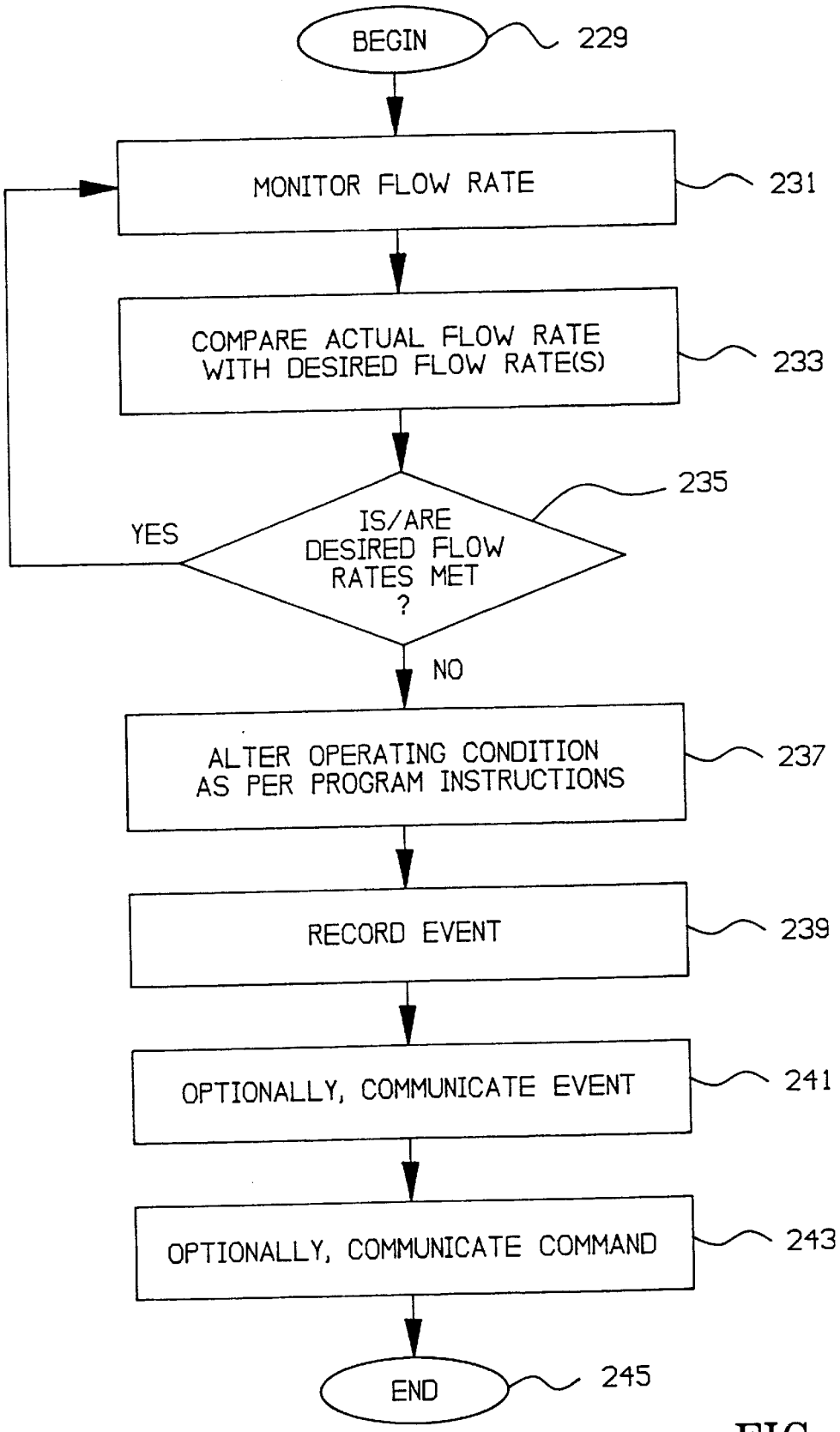
FIG. 2B is a flowchart representation of data processing implemented monitoring of pump flow rates for electrical submersible pumps, in accordance with the present invention.

Controller 411 may also control pump flow rates, as is depicted in flowchart form in FIG. 2B. The process begins at software block 229, and continues to software block 231, wherein controller 411 receives sensor data from flow meters which provide a continuous or intermittent measure of the amount of fluid flowing from the electrical submersible pump. In accordance with software block 233, controller 411 compares the actual flow rate with one or more desired flow rates. In software block 235, controller 411 determines whether the actual pump flow rate corresponds with the desired pump flow rates; if so, the process continues at software block 231 by continuing the monitoring operations; if not, the process continues at software block 237 wherein controller 411 is utilized to alter one or more operations conditions as per program instructions. For example, controller 411 may direct commands to motor controller 412 which increase or decrease the operating speed of the electrical submersible pump in order to match the actual pump flow rate with the desired pump flow rate. In accordance with the present invention, controller 411 can either monitor the velocity of the fluid directly, or it can calculate the volume of the fluid flow. Of course, the quantity of fluid flowing in a conduit is directly proportional to the velocity of the fluid. More specifically, the quantity of fluid flowing in a conduit is the product of the cross-sectional area of the conduit carrying the fluid and the velocity of the fluid flowing in the conduit.

In accordance with the present invention, controller 411 may also be utilized to continuously monitor and control the efficiency of operation of the centrifugal pump. The efficiency of operation of a centrifugal pump cannot be measured directly, but it can be calculated. The percentage of efficiency of a centrifugal pump can be determined in accordance with the following formula:

EQUATION NO. 1:

$$\text{percent efficiency}=[\text{head}\times\text{capacity}\times\text{specific gravity}\times 100]+[3{,}960\times \text{BHP}]$$

wherein the head is measured in feet, the capacity is measured in gallons per minute, and the term BHP corresponds to the break horsepower. The "head" is the amount of energy of the fluid column. It is used to represent the vertical height of a static column of liquid corresponding to the pressure of the fluid at the point in question. The head can also be considered to be the amount of work necessary to move a liquid from its original position to a required delivery position. This includes the extra necessary work to overcome the resistance to flow in the line. Pressure and head are, therefore, different ways of expressing the same value. In the submersible pump and petroleum industry where the term "pressure" is used it generally refers to units in pounds per square inch, whereas the term "head" refers to feet or length of column. These values are mutually convertible in accordance with the following simple formulas.

EQUATION NO. 2:

$$PSI = \frac{\text{Head in Feet}\times\text{Specific Gravity}}{2.31\ \text{Ft./PSI}}$$

EQUATION NO. 3:

$$\text{Head in Feet} = \frac{PSI\times 2.31\ \text{Ft./PSI}}{\text{Specific Gravity}}$$

EQUATION NO. 4:

$$PSI = 0.433\ \text{PSI/Ft.}\times\text{Specific Gravity}\times\text{Head in Feet}$$

EQUATION NO. 5:

$$\text{Hydraulic HP} = \frac{\text{Flow}\times\text{Head}}{3{,}960}$$

Where:

Flow=Gallon/minute (G.P.M.)

Head=Feet

For water, which has a specific gravity of 1.0

EQUATION NO. 6:

$$\text{Brake Horsepower} = \frac{\text{Hydraulic Horsepower}}{\text{Pump Efficiency}}$$

Wherein Brake Horsepower is the total power required by a pump to do a specific amount of work.

EQUATION NO. 7:

$$\text{Brake Horsepower} = \frac{G.P.M.\times\text{Head Feet}\times\text{Specific Gravity}}{3.960\times\%\ \text{Pump Efficiency}}$$

Figure 2C:
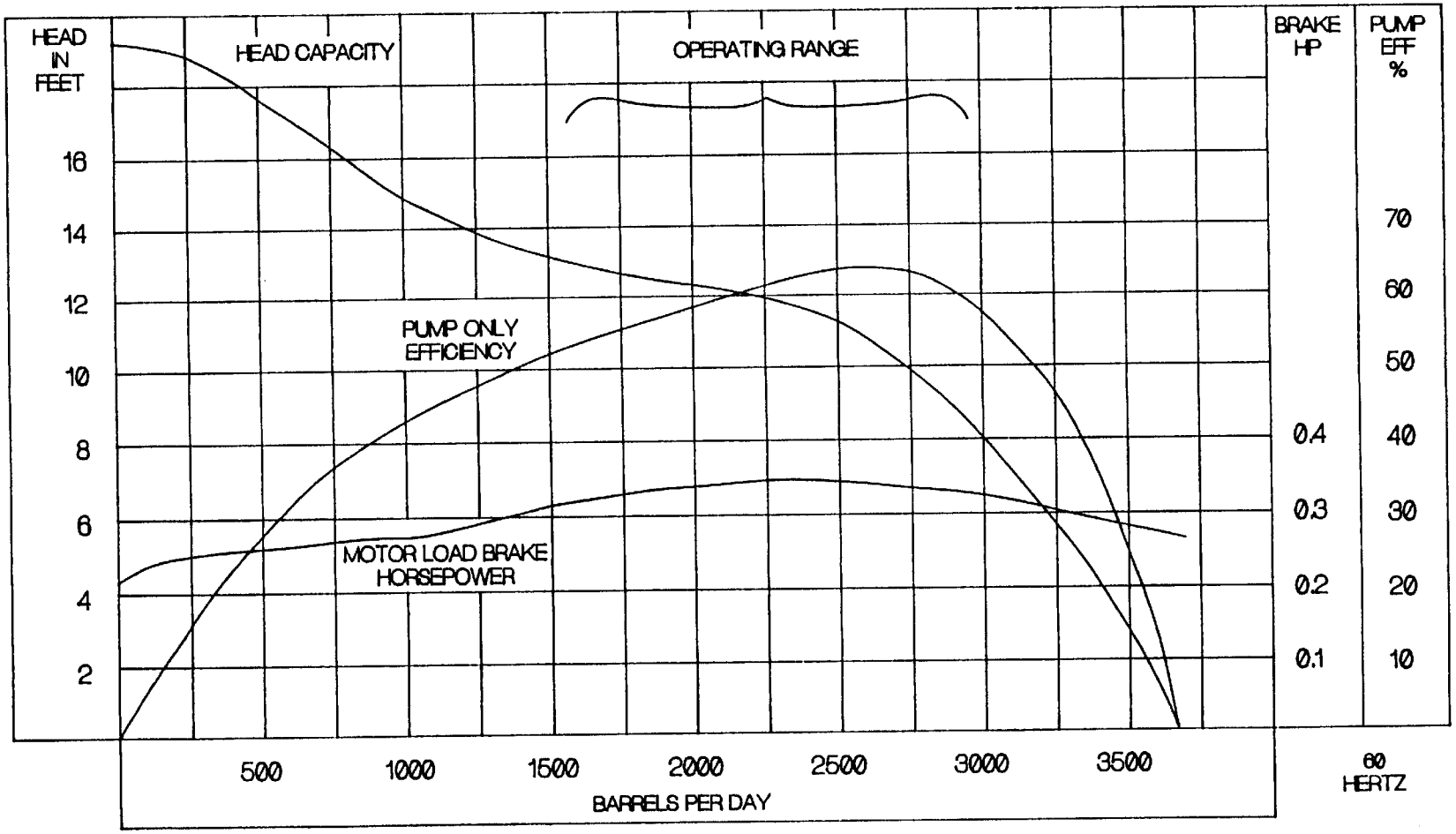
FIG. 2C is a graphical representation of head capacity, pump efficiency, which illustrates how a preferred operating range is selected for electrical submersible pumps.

The relationship between head capacity, pump efficiency, and motor load break horsepower is a complex one, and is utilized to determine an optimal operating range for an electrical submersible pump. FIG. 2C graphically represents this complex relationship. For a particular specific gravity, a particular pump capacity, the graph of FIG. 2C includes an x-axis which represents barrels pumped per day, and the y-axis is representative simultaneously of the head in feet (for the head capacity curve), the break horse power (for the motor load break horsepower curve), and pump efficiency (for the pump only efficiency curve). As is clearly depicted in FIG. 2C, there is an optimum operating efficiency (pump efficiency) which can be obtained. In accordance with the present invention, the efficiency of the pump can be calculated directly using the equations, or it can be determined in accordance with a data table maintained in memory similar to the graphical presentation of FIG. 2C. In either event, controller 411 is utilized to continuously monitor the actual pump efficiency, and compare it to a desired pump efficiency, as is depicted in flowchart form in FIGS. 2D and 2E.

Figure 2D:
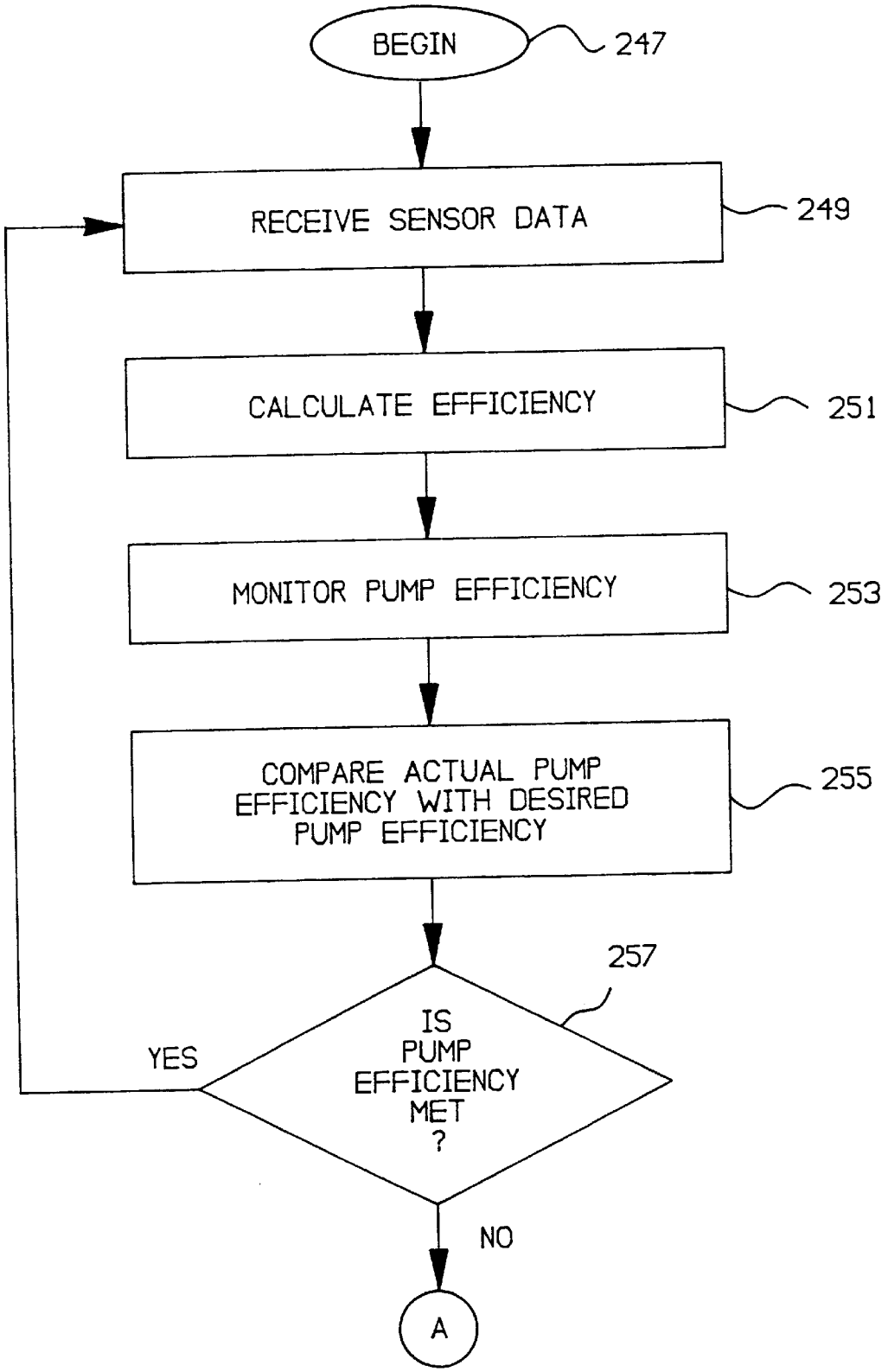
FIGS. 2D and 2E are a flowchart representation of data processing implemented monitoring pump efficiency for electrical submersible pumps, in accordance with the present invention.
Figure 2E:
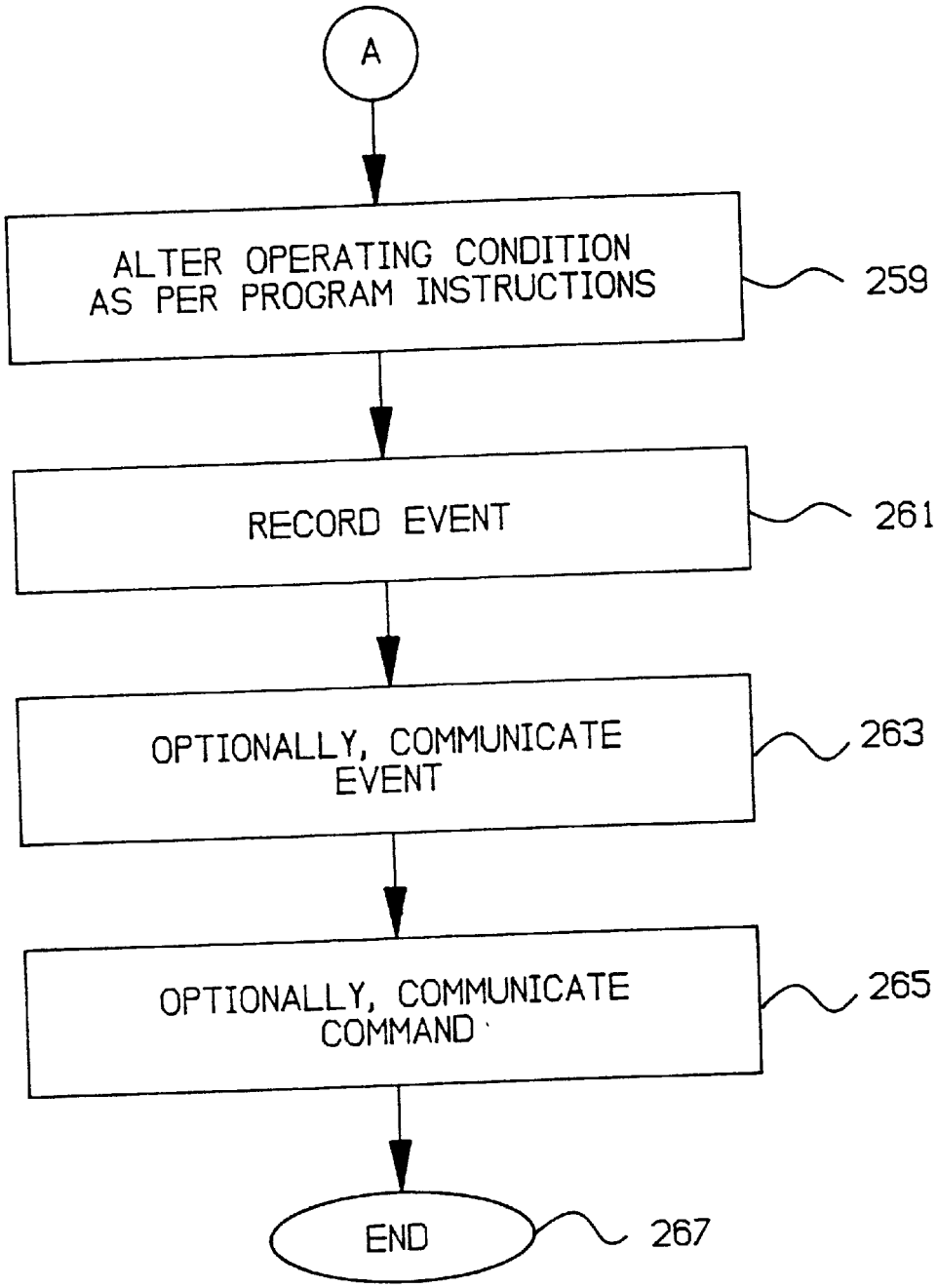

With reference now to FIGS. 2D and 2E, the process begins at software block 247, and continues at software block 249, wherein controller 411 receives sensor data from one or more sensors carried by the electrical submersible pump. Then, in accordance with software block 251, controller 411 utilizes the sensor data to calculate pump efficiency. Pump efficiency is then monitored, in accordance with software block 253, either continuously or intermittently. In accordance with software block 255, the actual pump efficiency is compared with a desired pump efficiency which is carried in memory, or which has been communicated from a remote location utilizing a data transmission system. In accordance with software block 257, controller 411 determines whether or not the pump efficiency is being met; if so, the processor returns to software block 249; if not, the process continues to software block 259, wherein controller 411 alters at least one operating condition in accordance with the program instructions. Controller 411 can be utilized to alter the quantity of fluid flowing through the electrical submersible pump, primarily by altering the operating speed of the pump. Then, in accordance with software block 261, controller 411 records the event in memory. In accordance with software block 263, controller 411 optionally communicates the event to a remotely located surface or subsurface sites to allow further processing and control operations to occur. In accordance with software block 265, controller 411 optionally communicates a command signal to a remotely located surface or subsurface equipment to influence or direct an operation which is occurring at a remote location. The process ends at software block 267.

The improved electrical submersible pump of the present invention can also be utilized to calculate and monitor the productivity index for the pump. The productivity index is a simple form of production testing. In order to calculate the productivity index for an electrical submersible pump, one must first measure the static bottomhole pressure. Then production is commenced, and the flowing bottomhole pressure is measured. Simultaneously, the rate of liquid produced at that particular flowing bottomhole pressure is also recorded. The productivity index can be calculated in accordance with the following equation:

EQUATION NO. 8

$$PI = \frac{Q}{\overline{P_r} - P_{wf}}$$

where:

Q=Test rate of liquid production stb/d $P_r$=Static Reservoir pressure $P_{wf}$=Well flowing pressure (@ Test Rate Q)

$R_r$-$P_{wf}$=Pressure drawdown

Figure 2F:
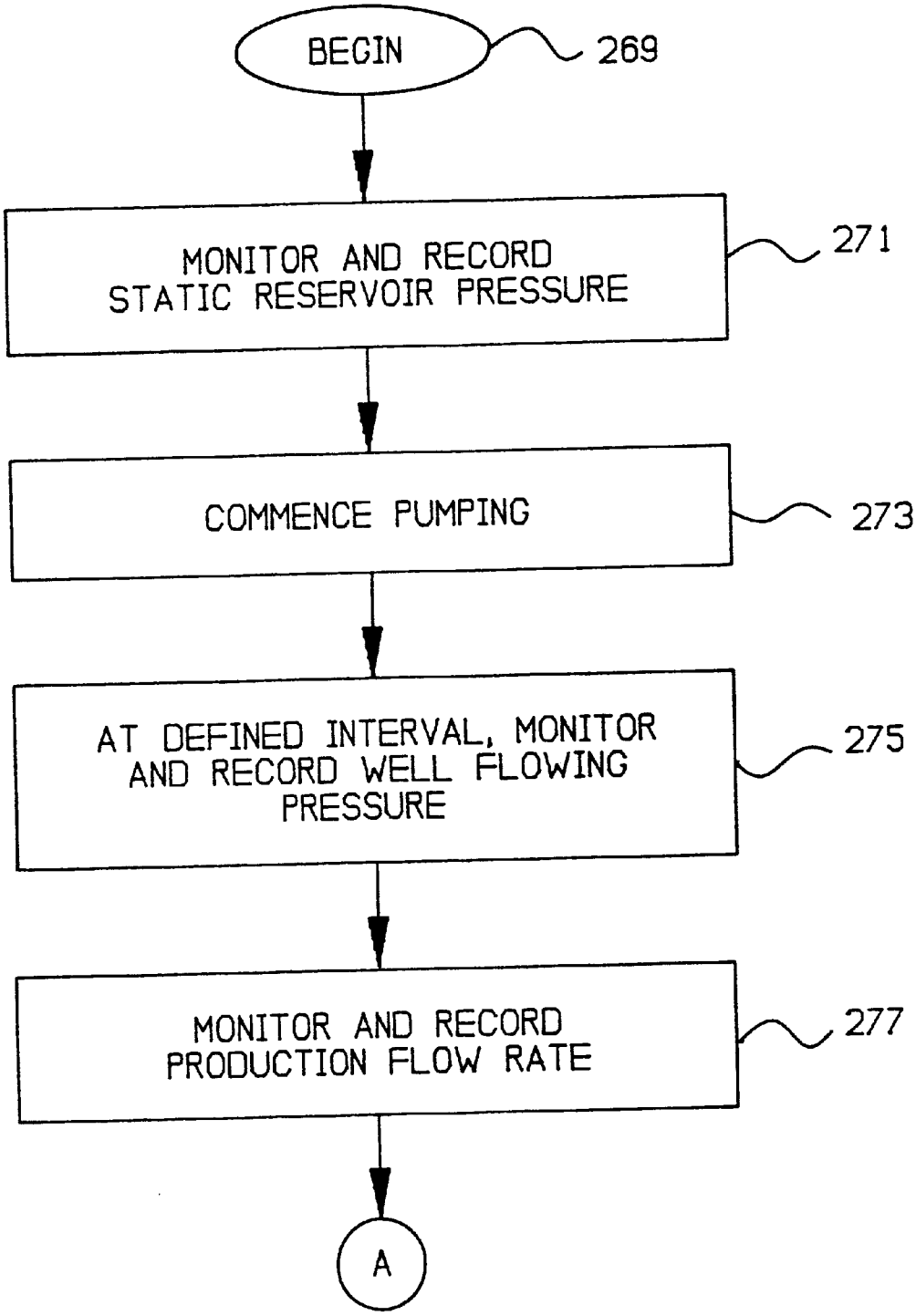
FIGS. 2F and 2G are a flowchart representation of data processing implemented monitoring of the productivity index for electrical submersible pumps, in accordance with the present invention.
Figure 2G:
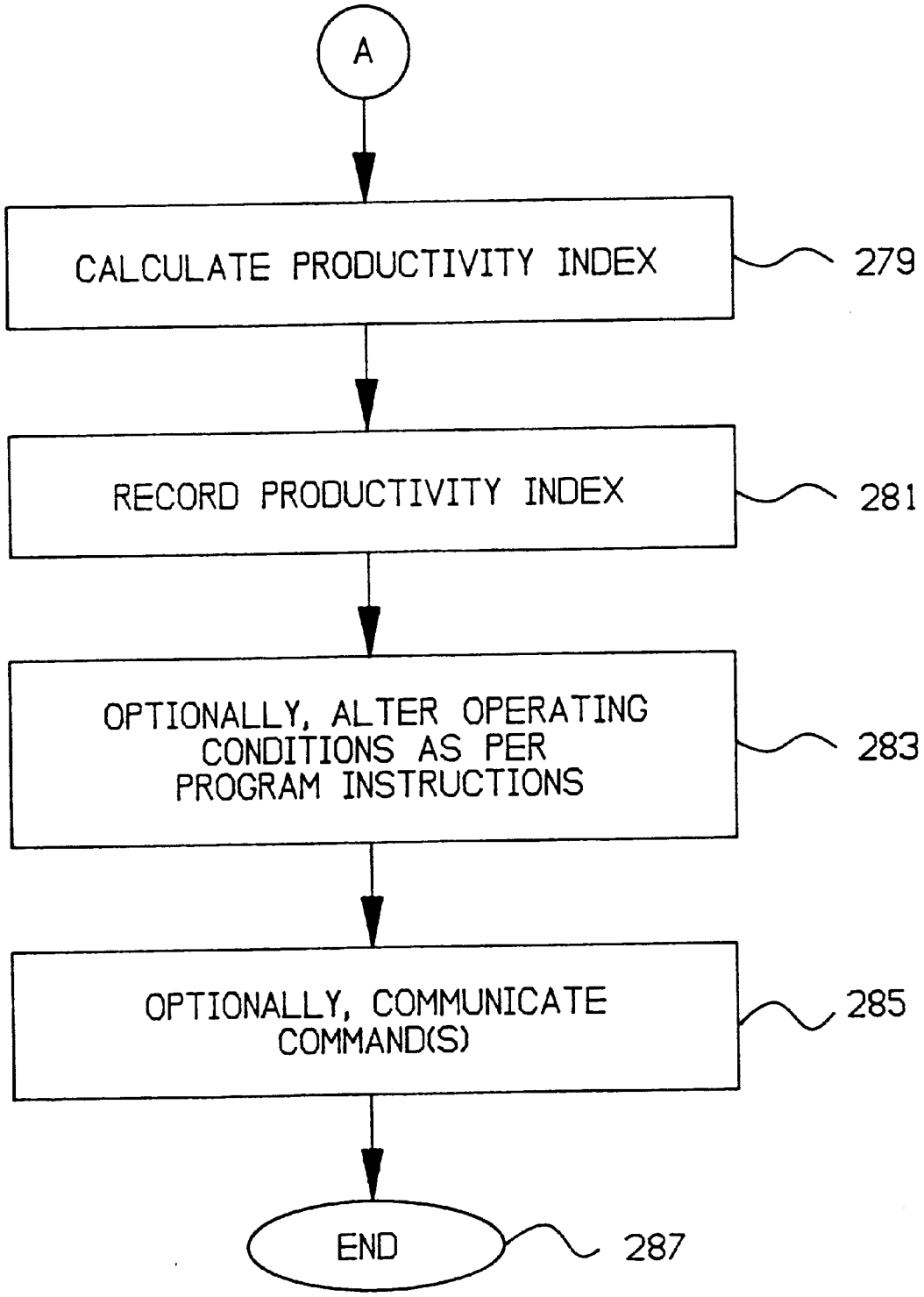

FIGS. 2F and 2G are a flowchart representation of data processing implemented steps of determining and monitoring the productivity index for a particular electrical submersible pump. The process begins at software block 269, and continues at software block 271, wherein controller 411 is utilized to monitor and record the static reservoir pressure. Next, in accordance with software block 273, controller 411 utilizes motor controller 412 to commence pumping operations. Next, in accordance with block 275, controller 411 continues pumping operations for a defined interval, or alternatively for an interval sufficient to obtain a predetermined flow characteristic, such as a substantially constant flow rate or flow pressure. Controller 411 then records the well flowing pressure. Next in accordance with software block 277, controller 411 monitors and records the production flow rate. Then, utilizing equation number 8, and in accordance with software block 279, controller 411 calculates the productivity index. In software block 281, the productivity index is recorded in memory. Then, in accordance with software blocks 283, 285, controller 411 is utilized to alter optionally operating conditions in accordance with program instructions and/or to communicate commands to equipment located in remote surface or subsurface locations. The process ends at software block 287.

The present invention can also be utilized to calculate and monitor the inflow performance relationship. When the well flowing pressure falls below the bubble point pressure, gas comes out of solution and interferes with the flow of oil and water. The end result is that the true inflow performance curve is not a straight line; it usually declines at greater drawdowns. An accurate well test should consist of productivity index tests at several production rates in order to provide a better representation of the true inflow performance of the well.

Figure 2H:
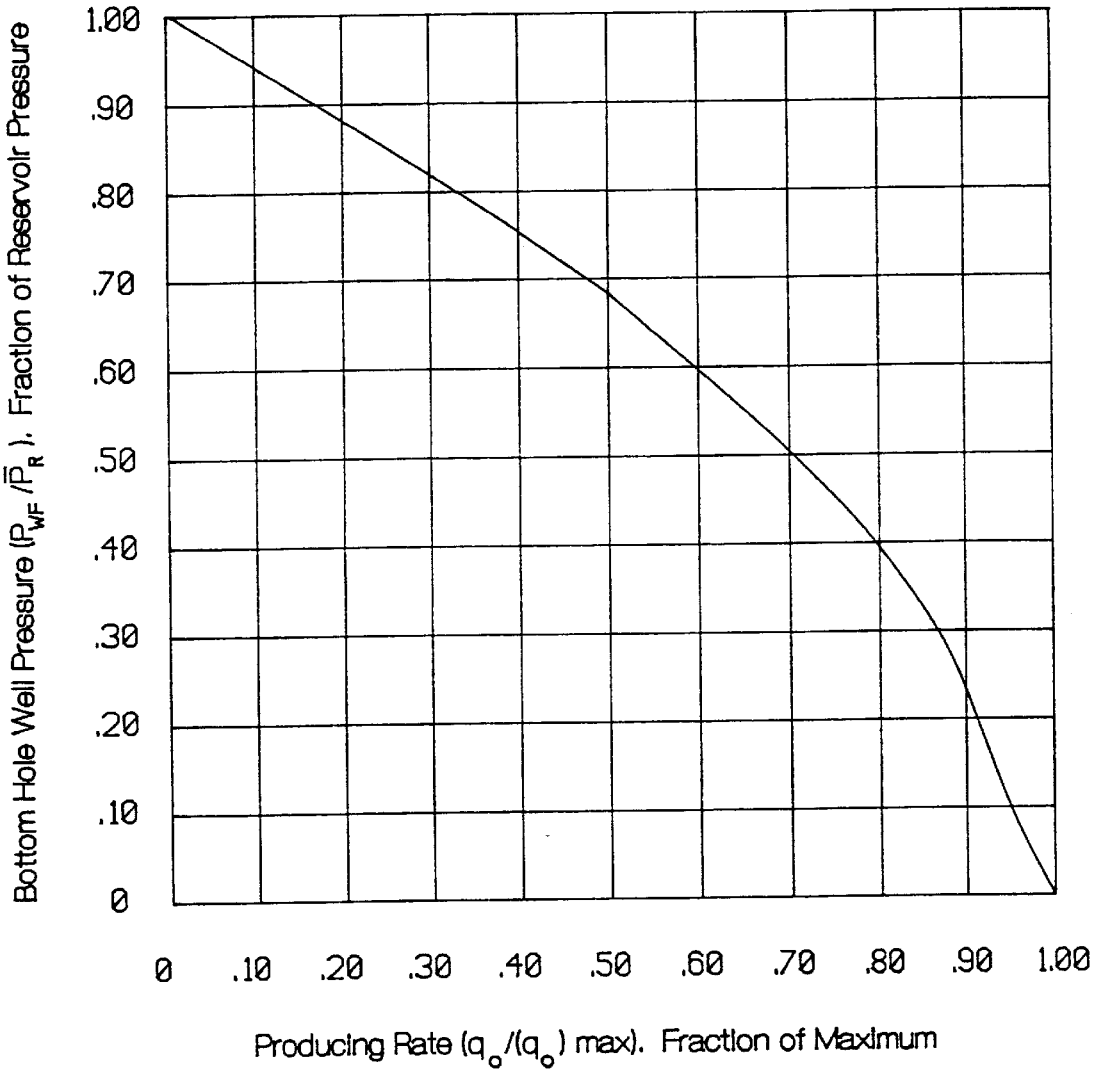
FIG. 2H is a graphical representation of an inflow performance reference curve.
Figure 21:
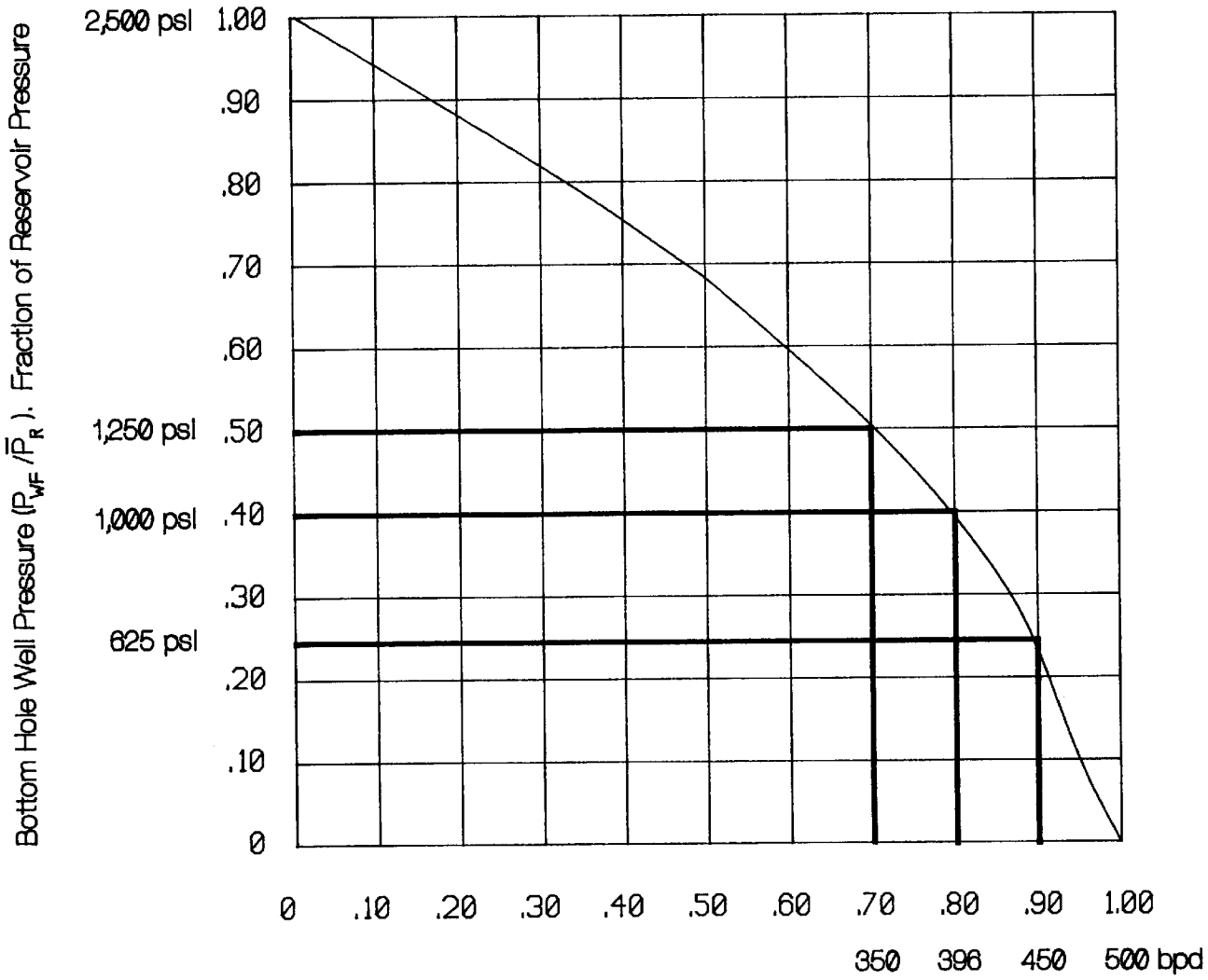

Vogel developed a dimensionless reference curve of FIG. 2H that has become a very effective tool in defining well inflow performance. FIG. 2I depicts Vogel's curve with dimensions added for a particular example. His technique, based on a computer simulation of dissolved gas drive reservoirs, gives a more realistic indication of the well's producing potential. The equation of the curve that gives a reasonable empirical fit is:

EQUATION NO. 9

$$Q_{o\,\max} = \frac{Q_o}{1 - 0.2\left(\frac{P_{wf}}{\overline{P_r}}\right) - 0.8\left(\frac{P_{wf}}{\overline{P_r}}\right)^2}$$

where:

$Q_0$=Test rate of liquid production stb/d $P_r$=Static Reservoir pressure $P_{wf}$=Well flowing pressure (@ Test Rate $Q_0$)

$Q_0$=Maximum Production Rate ($P_{wf}$=0)

If we assume that constant reservoir conditions exist, we can transform Vogel's mathematical statement to solve for the anticipated production ($Q_{0d}$) based on changes in the well flowing pressures ($P_{wfd}$). The transformed equation would then be defined as:

EQUATION NO. 10:

$$Q_{od} = Q_{o\max}\left\{1 - 0.2\left(\frac{P_{wfd}}{\overline{P_r}}\right) - 0.8\left(\frac{P_{wfd}}{\overline{P_r}}\right)^2\right\}$$

Furthermore, to predict the well flowing pressure ($P_{wfd}$), based on changes in the production rate ($Q_{0d}$), the equation can then be transformed as:

EQUATION NO. 11:

$$P_{wfd} = 0.125\left\{\overline{P_r}\left[-1 + \sqrt{81 - 80\left(\frac{Q_{od}}{Q_{o\,\max}}\right)}\right]\right\}$$

Figure 2J:
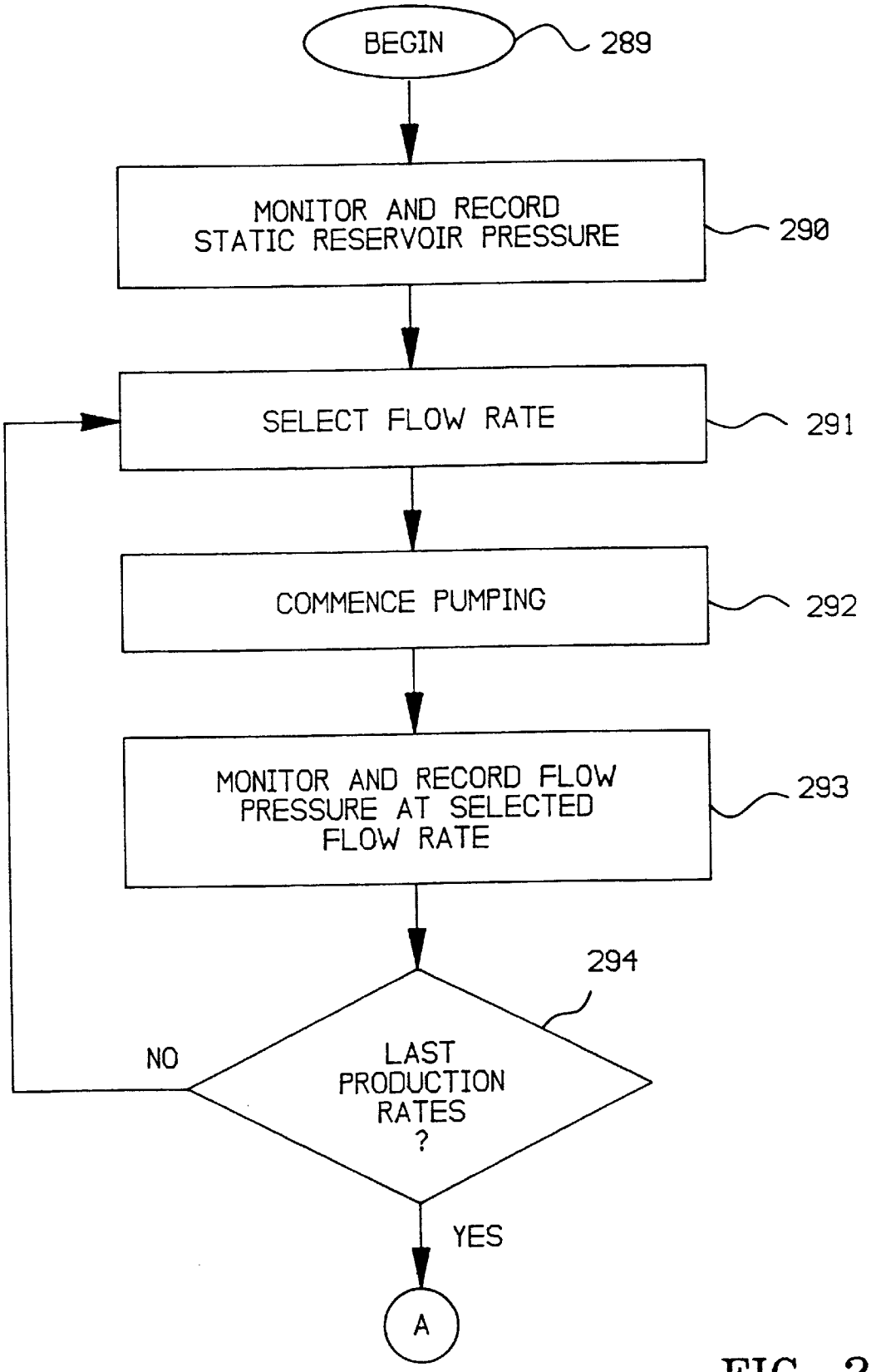
FIGS. 2J and 2K are a flowchart representation of data processing implemented determination of the inflow performance relationship for an electrical submersible pump, in accordance with the present invention.
Figure 2K:
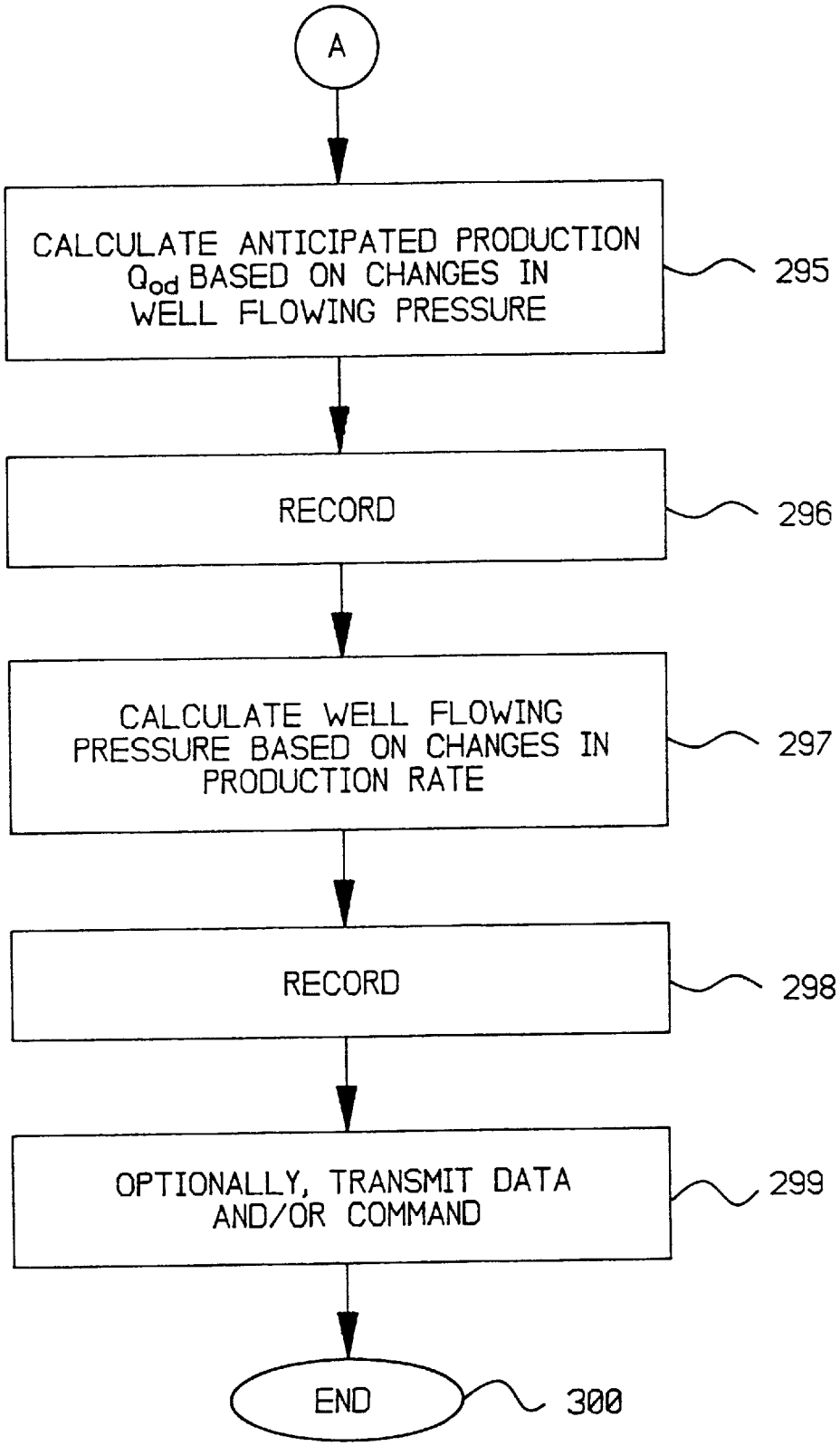

FIGS. 2J and 2K are a flowchart representation of data processing implemented calculation and determination of the inflow performance relationship utilizing controller 411. The process begins at software block 289, and continues at 290, wherein controller 411 monitors and records the static reservoir pressure. Next, in accordance with software block 291 a particular flow rate is selected from a plurality of preprogrammed test flow rates. In accordance with software block 292, controller 411 actuates motor controller 412 to commence pumping operations. Once steady state pumping operations have been obtained at the particular flow rate, controller 411 is utilized to monitor and record flow pressure at the selected flow rate, in accordance with software block 293. Next, in accordance with software block 294, controller 411 determines whether or not all of the predetermined flow rates have been tested; if not, the process continues to software block 291 with the selection of a new flow rate; if so, the process continues at software block 295, wherein the anticipated production $Q_{Od}$ is calculated based on changes in well flowing pressure. This calculated value is recorded in accordance with software block 296. Then, in accordance with software block 297, controller 411 calculates well flowing pressure based on changes in the production rate (as determined by flow meters at the output of the electrical submersible pump). The calculated value is recorded in memory in accordance with soft-ware block 298. In accordance with software block 299, optionally, either the recorded data or command signals based upon conclusions derived from the recorded data are transmitted to a remote surface or subsurface site for utilization by equipment. The process ends at software block 300.

In accordance with the present invention, controller 411 can also be utilized to monitor the electric motor power factor for the electric motor 17 (of FIG. 1A) of electrical submersible pump 11 (also of FIG. 1A). The power factor is the ratio of true power (KW) to the apparent power (KVA). The true power is measured by a wattmeter. The apparent power is measured by a volt meter and an ammeter (and is a product of the measured values). The power factor can be defined by the following equation:

EQUATION NO. 12

$$\text{Power factor}(PF) = \frac{\text{true power}}{\text{apparent power}}$$

The power factor has a value of 1.0 if the voltage and current reach their respective maximum value simultaneously. In most alternating current systems, the voltage reaches its maximum value slightly before the current reaches its maximum value. In other words, the current is said to "lag" behind the voltage. This lag may be measured in degrees, and is caused by the presence of transformers, inductive motors, and the like.

Figure 2L:
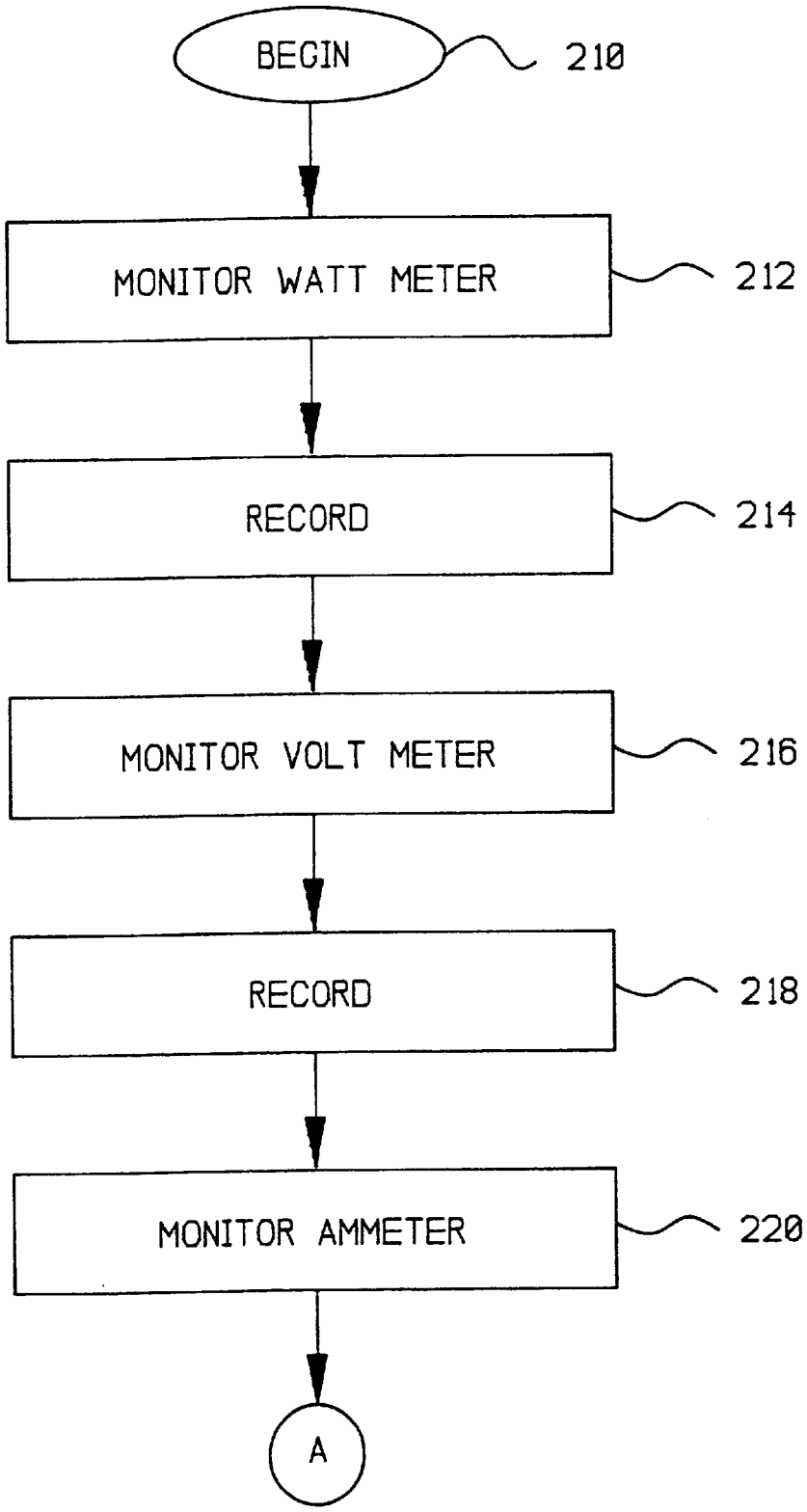
FIGS. 2L and 2M are a flowchart representation of data processing implemented monitoring of the electric motor power factor for electrical submersible pumps, in accordance with the present invention.
Figure 2M:
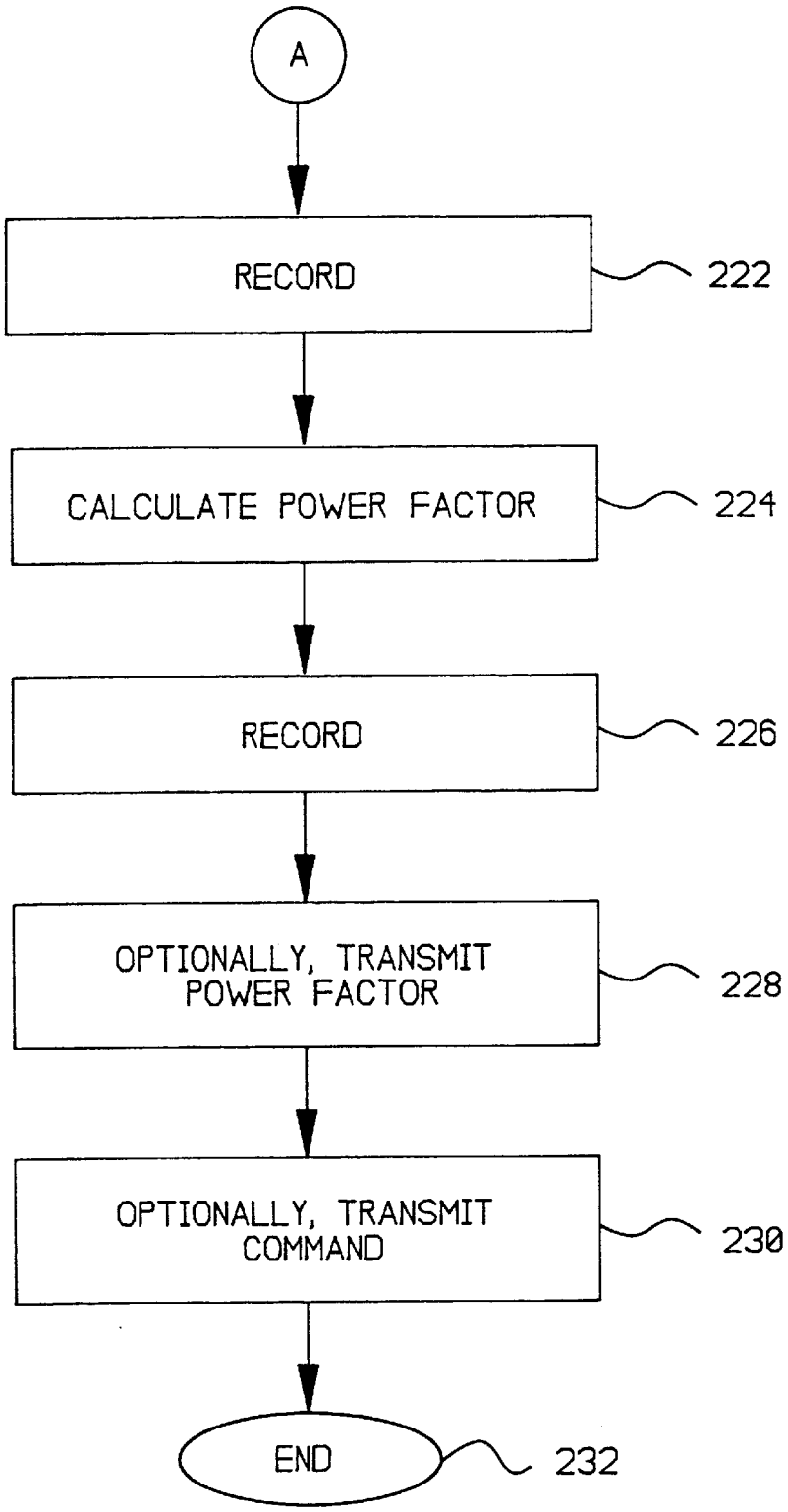

FIGS. 2L and 2M are a flowchart depiction of a data processing implemented routine for calculating the electric motor power factor. The process begins at software block 210, and continues at software block 212, wherein controller 411 monitors the output of a watt meter. The output is recorded in step 214. In software block 216, controller 411 monitors the output of a volt meter, and records that measurement in accordance with step 218. Next, controller 411 monitors the output of an ammeter in accordance with step 220, and records the measurement in accordance with step 222. Then, controller 411 utilizes the formula set forth above to calculate the power factor for the electric motor, in accordance with step 224. This power factor is recorded in memory in accordance with software block 226. Optionally, and in accordance with steps 228 and 230, controller 411 transmits the power factor to a remote surface or subsurface location where utilization or recordation, and/or controller 411 transmits a command signal to a surface or subsurface location in order to influence or control the operation of wellbore equipment contained therein. The process ends at software block 232.

The electrical submersible pump of the present invention may also utilize controller 411 to monitor motor efficiency for the electric motor. In an electric motor, motor efficiency is the ratio of the power output of the electric motor to the power input, and is usually expressed as a percentage. Of course, the output of a motor is mechanical power, while the input of an electrical motor is electrical power. Fortunately, there is a simple relationship, which is set forth below in the following equations.

EQUATION NO 13

$$T = \frac{HP \times 5{,}252}{N}$$

wherein

T=motor torque in pound-feet, when fully loaded at the rated speed

HP=horsepower

N=motor rated speed rpm

EQUATION NO. 14

$$\text{Output HP} = HP = \frac{N \times T}{5{,}252}$$

EQUATION NO. 15

$$\text{Input HP} = \frac{1.732 \times V \times I \times COS0}{746}$$

wherein

V=motor terminal voltage

I=line current

COSO=power factor of motor

Figure 2N:
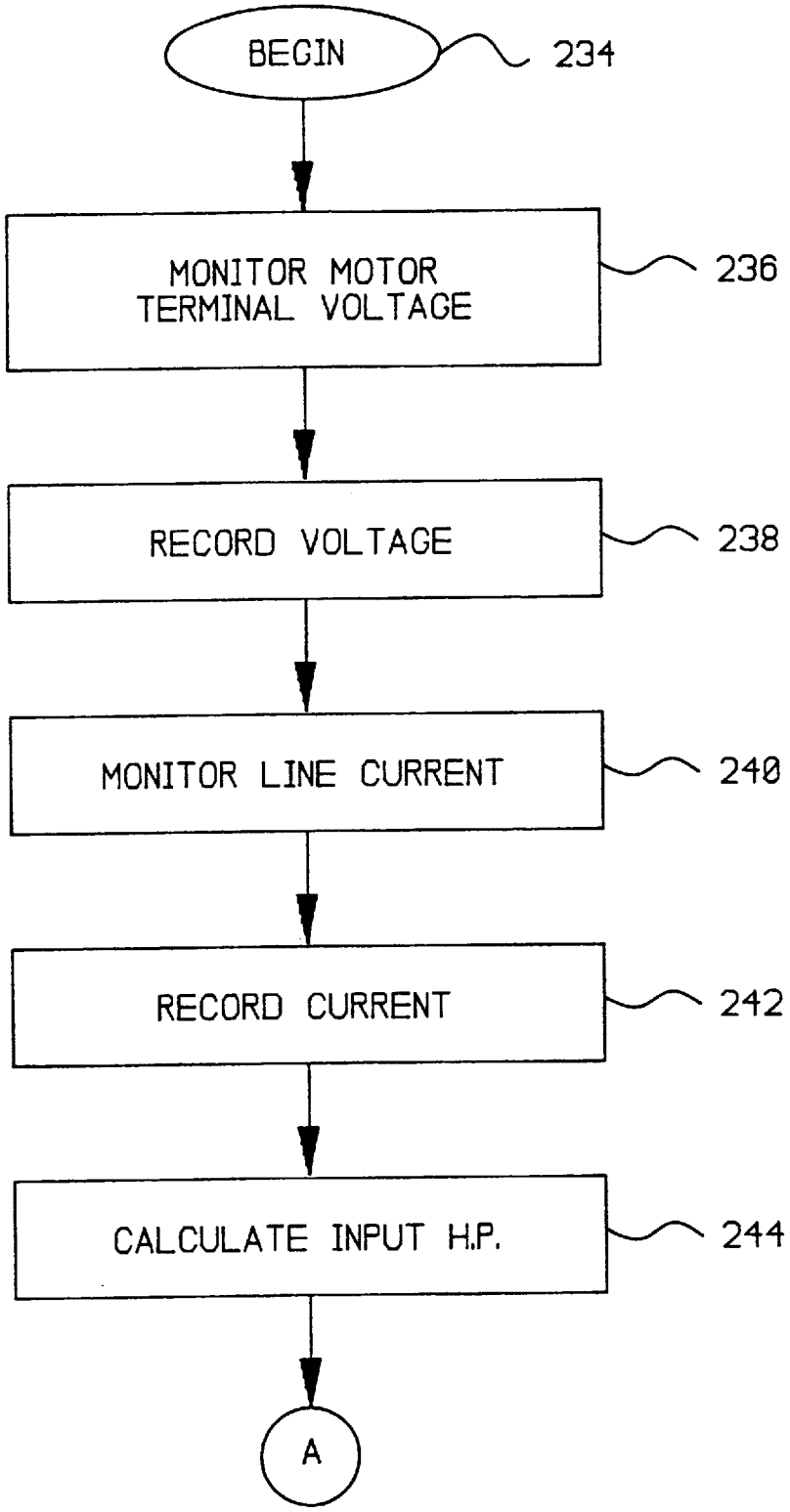
Figure 20:
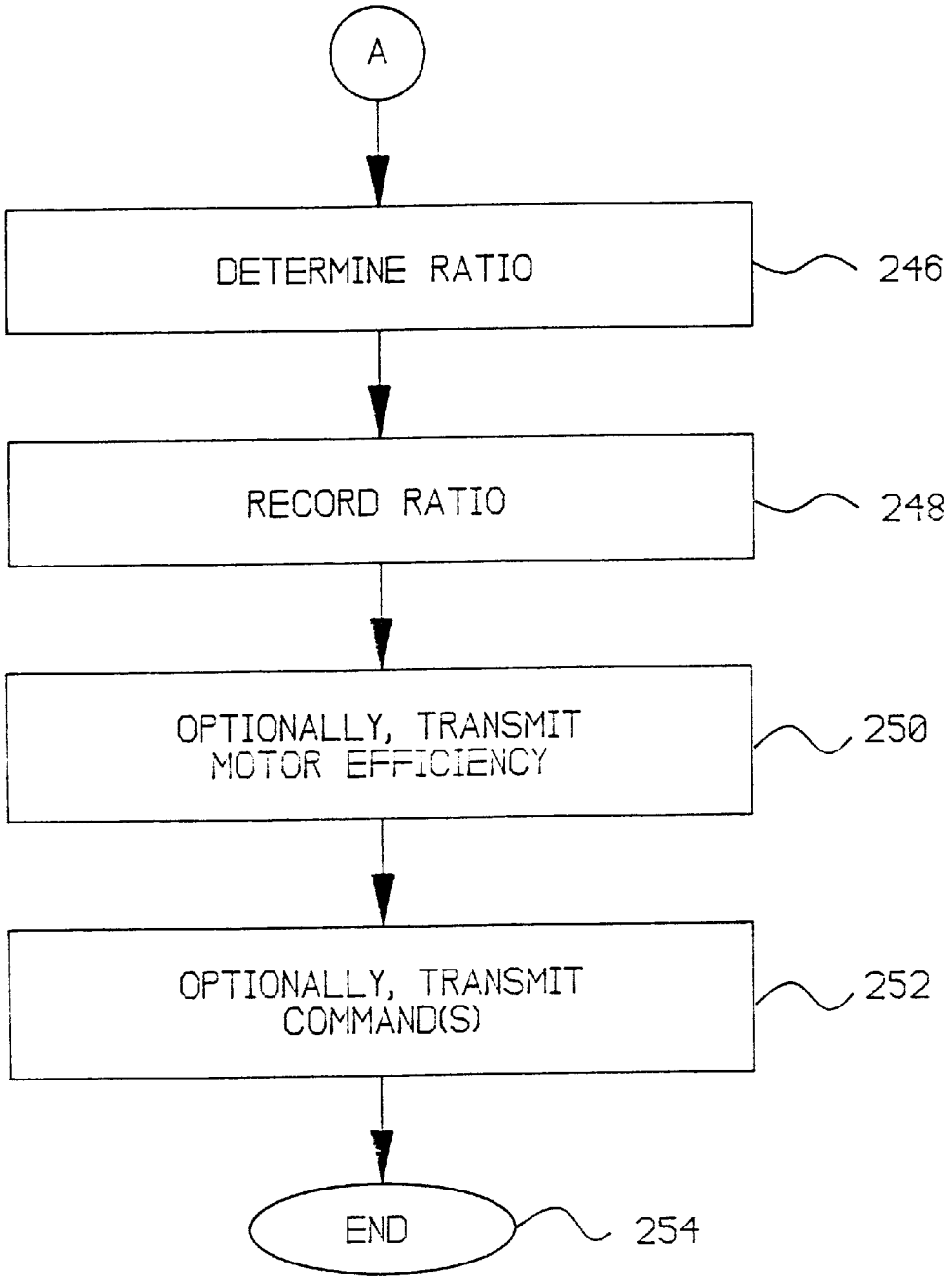

FIGS. 2N and 2O are a flowchart representation of the utilization of the improved electrical submersible pump of the present invention in determining and monitoring electrical motor efficiency. The process begins at software block 234, and continues at software block 236, wherein controller 411 monitors the motor terminal voltage. Then, in accordance with software block 238, controller 411 records the voltage in memory. Then, controller 411 monitors the line current, in accordance with software step 240. Then, in accordance with software block 242, controller 411 records the current in memory. In accordance with software block 244, controller 411 calculates the input horsepower for the electrical motor, in accordance with the foregoing formula. The controller $_4$ retains in memory the value of the torque T which the motor will produce when fully loaded at the rated speed. Additionally, controller 411 retains in memory the rated speed. These are utilized to derive the output horsepower of the electric motor. The output horsepower and input horsepower figures are utilized to determine a ratio, in accordance with software step 246. This ratio is recorded in memory, in accordance with step 248. Then, in accordance with steps 250 and 252, controller 411 optionally transmits the motor efficiency ratio to a remote surface or subterranean location, and/or transmits a command signal to a remotely located surface or subsurface location. The process ends at software block 254.

The improved electrical submersible pump of the present invention may be also utilized to continually monitor vibration (typically, utilizing strain gauges or accelerometers) generated by various rotating components. The various components which can be monitored relatively independently include the different stages of the centrifugal pump, the rotor, radial bearings, and spider bearings of the rotary gas separator, the shaft which extends through the seal section, and the rotors of the electrical motor. Preferably, controller 411 includes in the program instructions preestablished vibration thresholds which indicate excessive wear, damage, or impending failure of various moving components of the improved electrical submersible pump. Preferably, these vibration thresholds are established in both laboratory and field settings, representing a cumulative analysis under a variety of operating conditions. The vibration thresholds which indicate excessive wear, damage and impending failure can be preselected and coded in memory, or they may be loaded or altered once the electrical submersible pump is lowered into position through utilization of data transmission systems. In one particular embodiment, the vibration sensors (typically, strain gauges and/or accelerometers) may be utilized to monitor the vibration of an electrical submersible pump after the pump is installed in a subterranean package. The data may be packaged and transmitted to a surface location for analysis. The analysis will reveal the extent of vibration present during normal operation. The one or more vibration thresholds can be established with respect to the initial sampling, and transmitted into the wellbore and loaded into memory for access by controller 411 during subsequent monitoring operations.

Figure 2P:
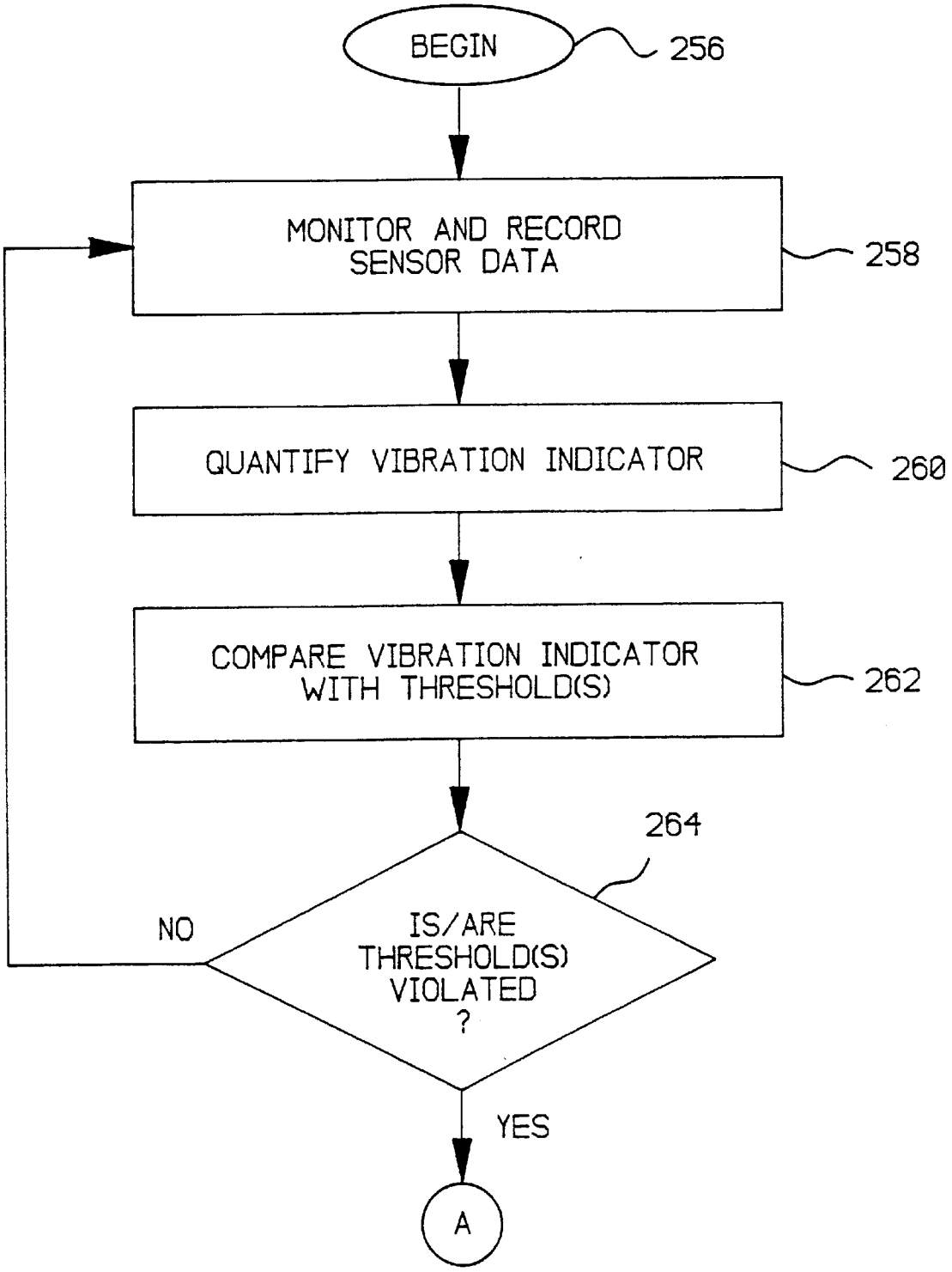
FIGS. 2P and 2Q are a flowchart representation of data processing implemented monitoring of vibration in an electrical submersible pump, in accordance with the present invention.
Figure 2Q:
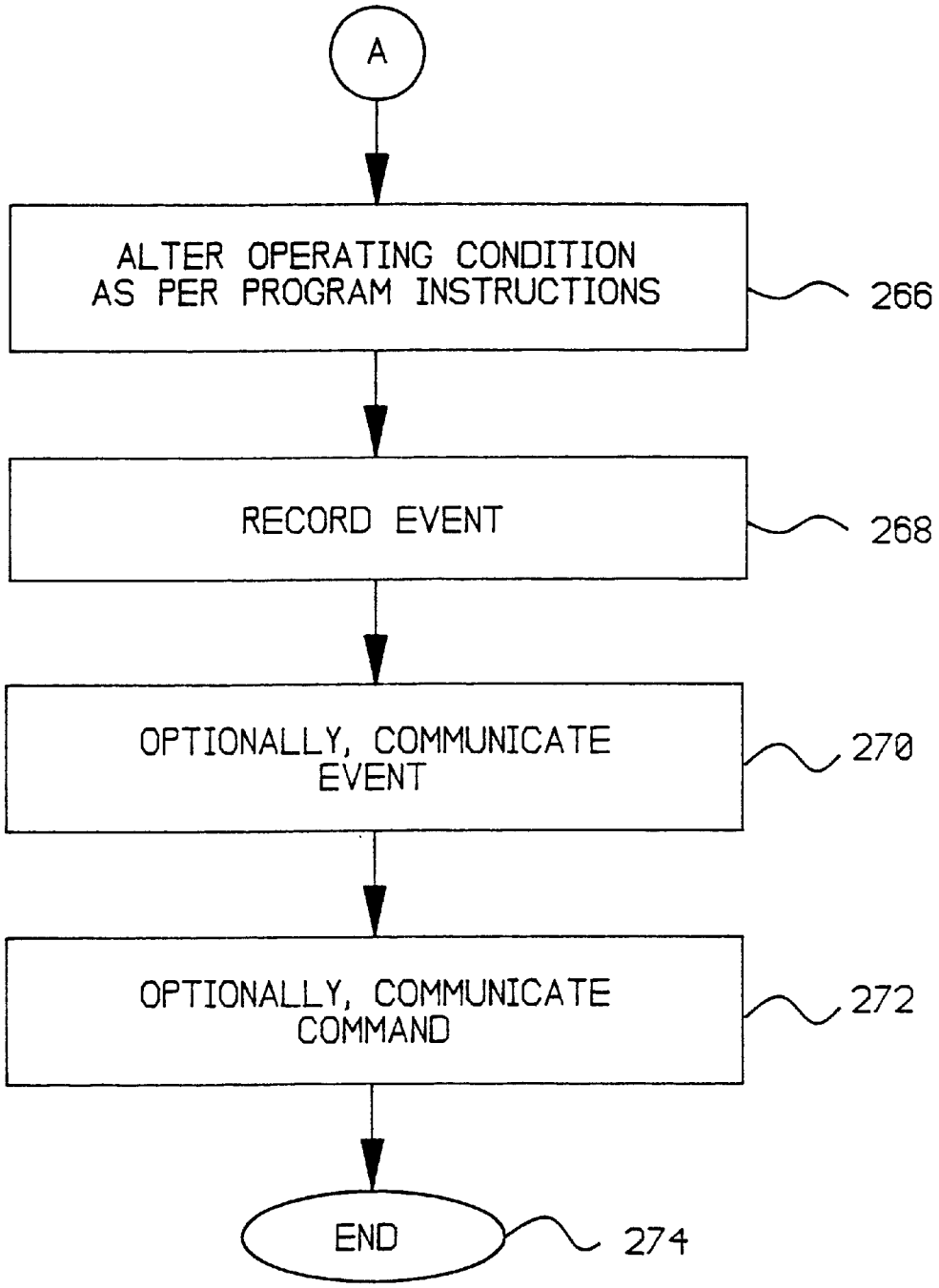

The data processing implemented steps of the present invention are depicted in flowchart form in FIGS. 2P and 2Q. The process begins at software block 256, and continues at software block 258, wherein controller 411 is utilized to monitor and record sensor data. In accordance with software block 260, the vibration data is manipulated in a manner to produce a vibration indicator. Next, in accordance with software block 262, the vibration indicator is compared with one or more thresholds maintained in memory. In accordance with software block 264, controller 411 determines whether or not the one or more thresholds have been violated; if not, the process continues at software block 258; if so, the process continues to software block 266, wherein controller 411 is utilized to alter at least one operating condition in accordance with program instructions. For example, program instructions may require that the pump be turned off for a predetermined time interval upon the detection of a vibration threshold violation. An alternative response may include altering the operating speed, flow rate, or pump cycle of the electrical submersible pump. In accordance with software block 268, controller 411 is utilized to record the event to allow later retrieval and processing, if necessary. Then, in accordance with software blocks 270, 272, controller 411 is utilized to optionally communicate a command developed from detection of a threshold violation to a remote surface or subsurface location for utilization by other equipment. The process is completed in software block 274.

Figure 2R:
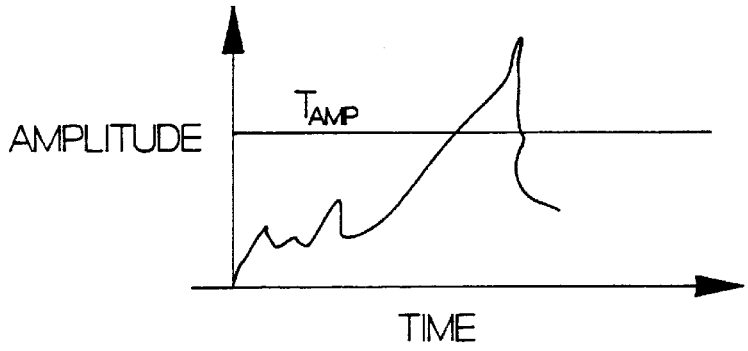
FIG. 2R is a graphical representation of vibration amplitude with respect to time.
Figure 2S:
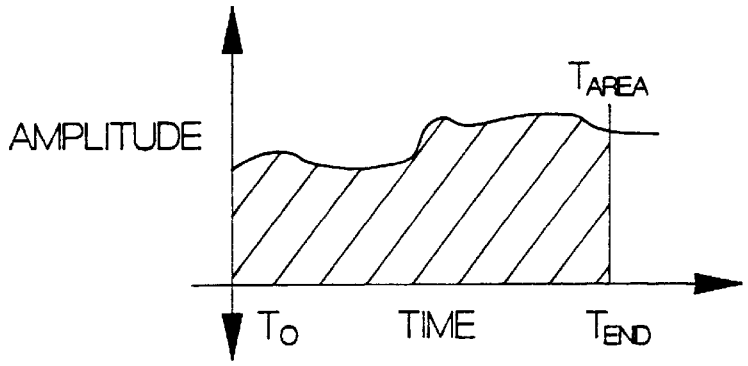
FIG. 2S is a graphical representation of vibration amplitude with respect to time.
Figure 2T:
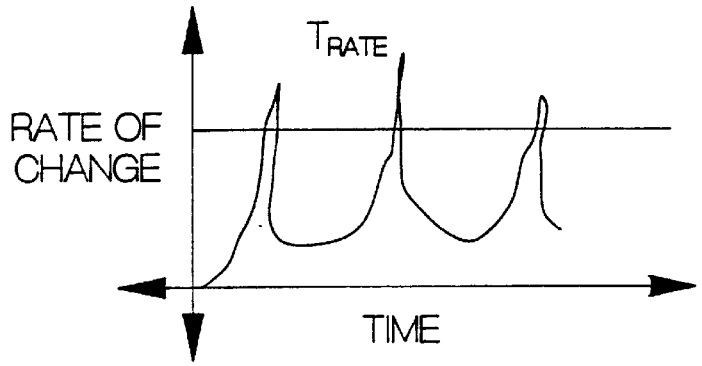
FIG. 2T is a graphical representation of the rate of change of the vibration with respect to time.
Figure 2U:
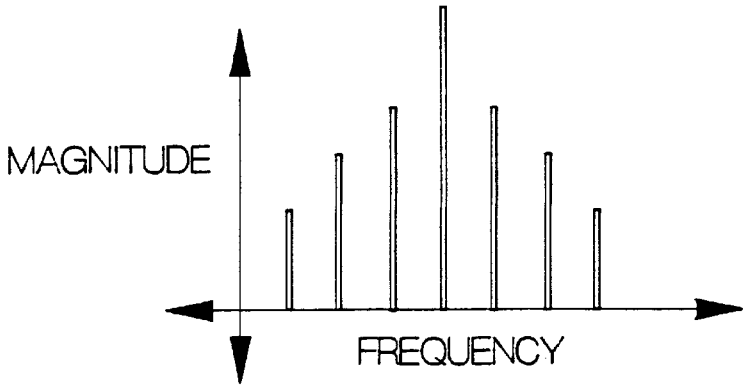
FIG. 2U is a graphical representation of the frequency domain distribution of vibration in an electrical submersible pump.

Some types of simple vibration thresholds are graphically depicted in FIGS. 2R through 2U. Referring first to FIG. 2R, there is depicted a graph of vibration amplitude. An amplitude threshold $T_{amp}$ may be selected based upon empirical study of pump vibration. The presence of vibration above the vibration threshold indicates excessive wear, damage, or impending failure of one or more components of the electrical submersible pump. In FIG. 2S, there is depicted a graphical representation of vibration amplitude with respect to time. Another type of vibration threshold may be established which is represented by the area underneath the vibration signal in a time interval defined between a starting time $T_0$ and an ending time $T_{end}$. FIG. 2T depicts a graphical representation of the rate of change of the vibration with respect to time. A rate threshold $T_{rate}$ may be established based on empirical data. A violation of the rate of change threshold may indicate wear, damage, or impending failure of one or more mechanical components within the electrical submersible pump. FIG. 2U is a representation of the frequency domain transform of vibration data, with the x-axis representative of frequency and the y-axis representative of magnitude. One or more frequency components may be identified as essential components of proper operation of electrical submersible pump. The absence of this component, shifting of this component, or change in magnitude of this component may indicate the excessive wear, damage, or impending failure of the electrical submersible pump.

Figure 2V:
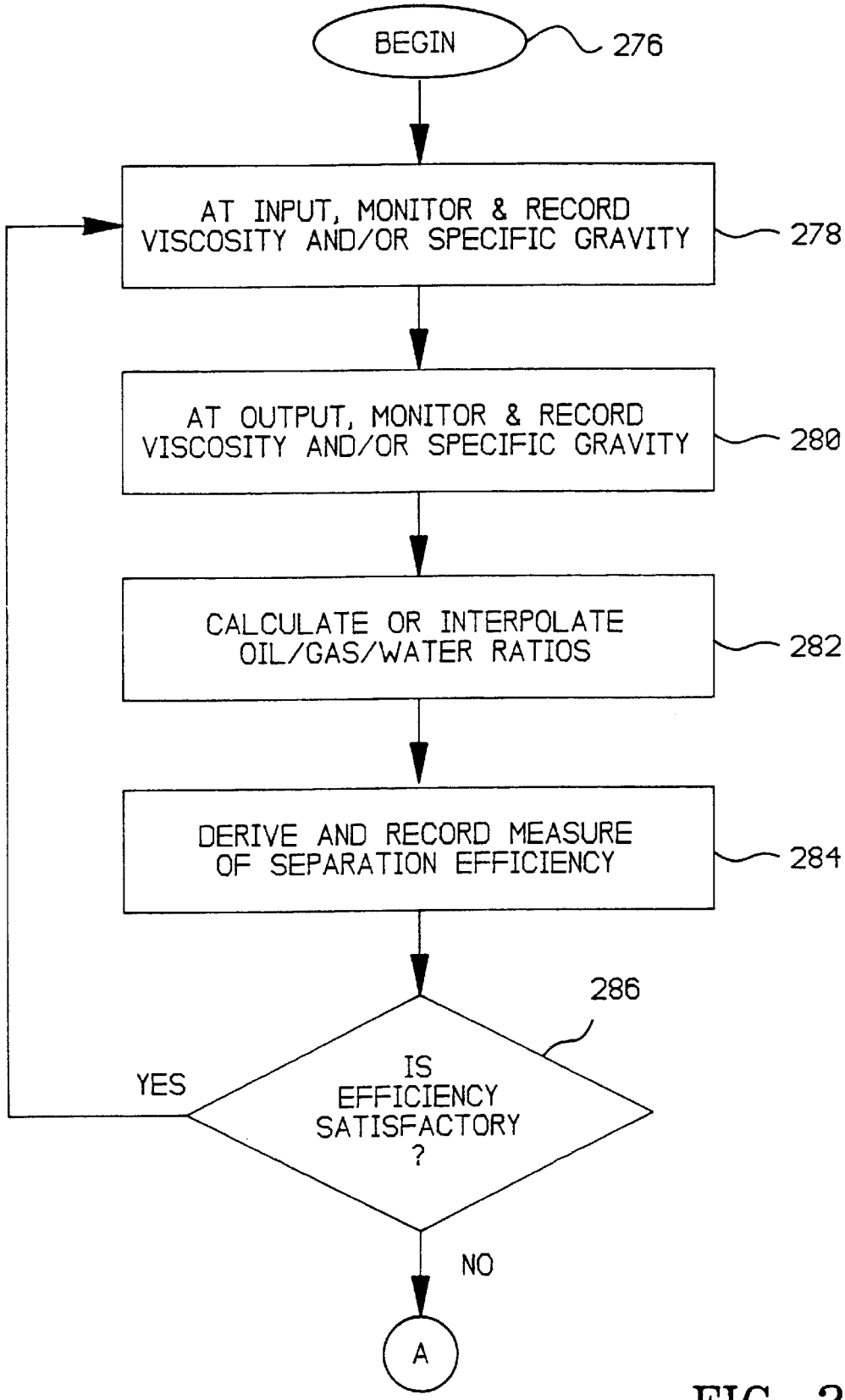
FIGS. 2V and 2W are a flowchart representation of data processing implemented monitoring of viscosity and specific gravity in the fluids passing through an electrical submersible pump, in accordance with the present invention.
Figure 2W:
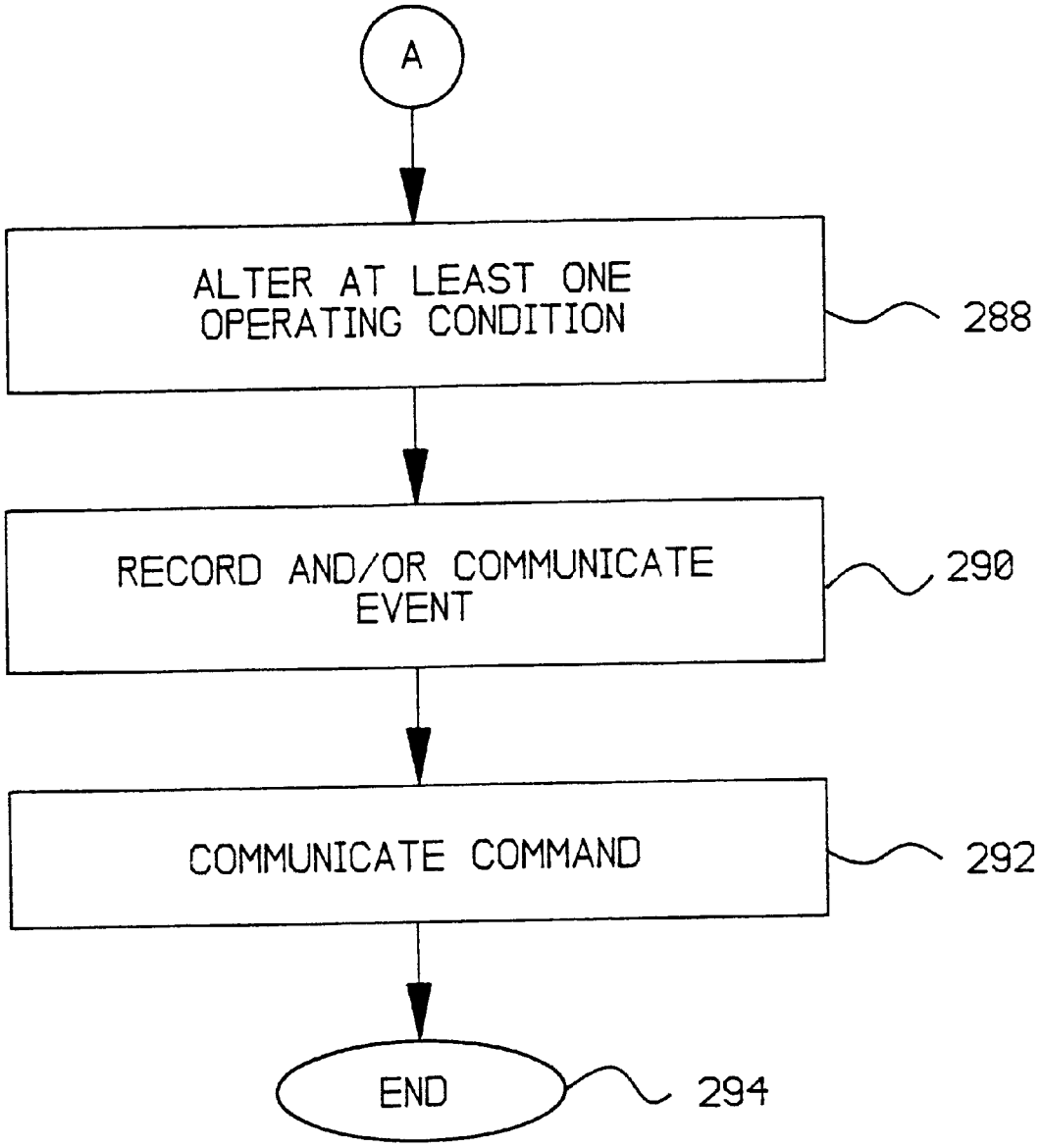

The improved electrical submersible pump of the present invention may be also utilized for monitoring the viscosity, specific gravity, output of mass spectrometers, and other physical indicators of the composition of the wellbore fluid passing through the electrical submersible pump. This provides some measure of the oil/gas/water ratios. This is especially useful when the electrical submersible pump is utilized as a downhole separator and injector, in accordance with the present invention. This allows the separator/injector to be utilized when predetermined oil/gas/water ratios exist, and which further allows for quantification of the effectiveness of operation of the electrical submersible pump as a separator. FIGS. 2V and 2W are a flowchart depiction of the data processing implemented steps of monitoring viscosity and specific gravity. The process begins at software block 276, and continues at software block 278, wherein the viscosity and specific gravity are monitored at an input to the electrical submersible pump. In accordance with software block 280, at the output, the viscosity and/or specific gravity is also monitored. In accordance with software block 282, controller 411 is utilized to calculate or interpolate the oil/gas/water ratios. Controller 411 then can be utilized in accordance with step 284 to derive and record a quantitative measure of the efficiency of the separator. This quantitative measure may be a simple indication of the percentage of total oil, gas, or water removed by the action of the separator. In accordance with software step 286, controller 411 is utilized to determine whether or not the efficiency of the separator is satisfactory, as compared to the preestablished efficiency criteria; if so, the process continues to software block 278; if not, the process continues at software block 288, wherein controller 411 is utilized to alter at least one operating condition of the electrical submersible pump. For example, controller 411 may utilize motor controller 412 to turn the pump from an "on" condition to an "off" condition.

Alternatively, controller 411 may utilize motor controller 412 to alter the operating speed of the electrical submersible pump. In accordance with software block 290, the occurrence is recorded and/or communicated to a remote surface or subsurface location within the wellbore. Optionally, in accordance with software block 292, the controller 411 may be utilized to communicate a command to remotely located wellbore equipment which is produced as a result of detection of the increase or decrease in efficiency of operation of the electrical submersible pump as a separator. The process ends at software block 294.

Figure 2X:
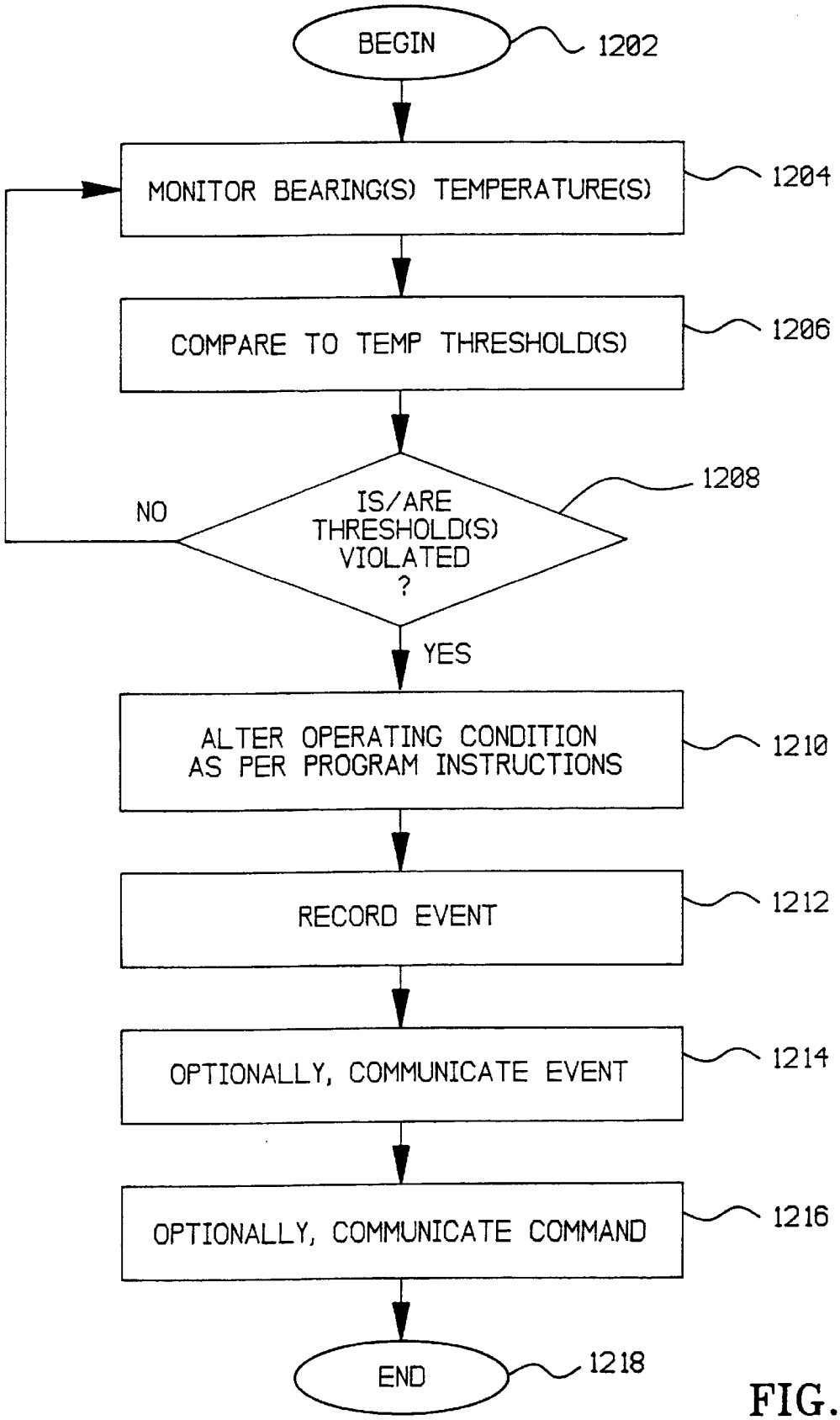
FIG. 2X is a flowchart representation of the data processing implemented steps of monitoring bearing temperature.

In accordance with the present invention, the improved electrical submersible pump 11 may be utilized to monitor bearing temperatures for the rotating components therein. FIG. 2X is a flowchart representation of the data processing implemented process of monitoring bearing temperature within the electrical submersible pump 11. The process begins in software block 1202 and continues to software block 1204, wherein the bearing temperature is monitored utilizing one or more temperature sensors, such as thermocouples which are located as close as possible to the bearings of interest. Then, in accordance with software block 1206, the controller is utilized to compare the monitored temperatures to temperature thresholds maintained within program memory. In accordance with software block 1208, the controller determines whether the threshold or thresholds have been violated; if not, the process returns to software block 1204; if so, the process continues at software block 1210, wherein a pre-selected operating condition is altered in accordance with program instructions. For example, the speed of operation may be diminished in order to bring an abnormally high bearing temperature down within an acceptable temperature range. Next, in accordance with software blocks 1212, 1214, and 1216, the controller is utilized to record data which may represent an "event", such as an abnormally high bearing temperature, to optionally communicate the occurrence of the event to another subsurface or surface location, and to optionally communicate a command to an electrically-controllable surface or subsurface equipment. The process ends at software block 1218. In accordance with the present invention, if the bearing temperature indicates that failure is likely, the controller may switch the electrically submersible pump to an "off" condition, and may communicate commands to flow control devices, such as valves, in order to alter wellbore fluid flow. For example, a valve may be utilized to shut off a particular zone or zones to prevent the flow of wellbore fluid into the wellbore, until the possible bearing failure can be analyzed and a decision made as to whether to proceed with operations.

Figure 2Y:
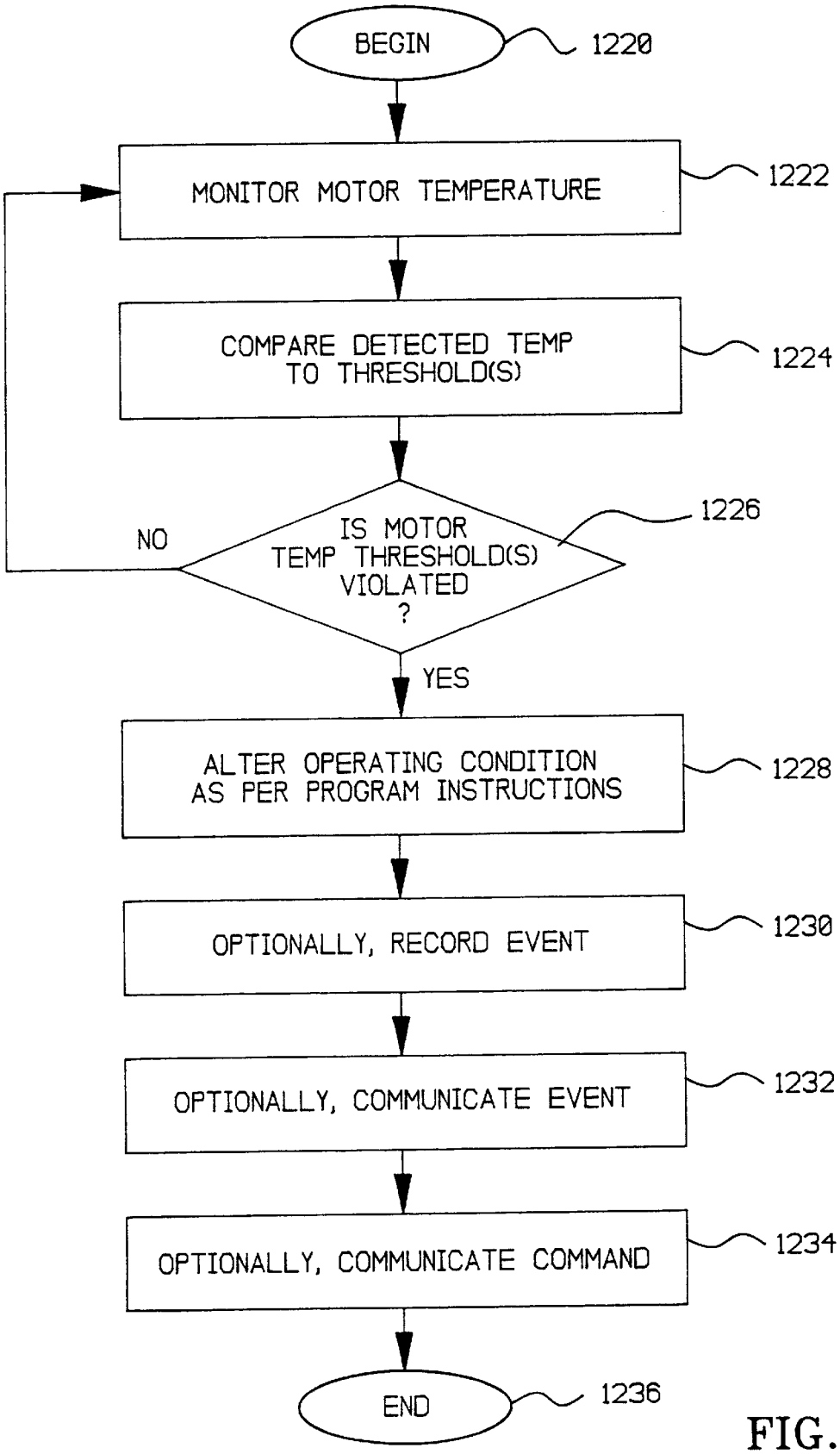
FIG. 2Y is a flowchart representation of the data processing implemented steps of monitoring motor temperature.

The improved electrical submersible pump 11 of the present invention may be utilized also to monitor motor temperature during operations. FIG. 2Y is a flowchart representation of the data processing implemented steps of monitoring motor temperature. The process begins in software block 1220, and continues in software block 1222, wherein the motor temperature is monitored. Then, in accordance with software block 1224, the controller compares the detected temperature to temperature thresholds maintained in program memory. Then, in accordance with software block 1226, the controller determines whether the pump temperature thresholds have been violated; if not, controller returns to software block 1222; if so, the process continues at software block 1228, wherein at least one operating condition is altered in accordance with program instructions. For example, if the motor temperature is determined to be too high for safe operation, the electrical submersible pump may be turned to an "off" condition or, alternatively, the speed of operation of the electrical submersible pump may be reduced. Thereafter, the motor temperature may be monitored in order to determine whether the electrical submersible pump 11 can be operated safely at the reduced speed. In accordance with software blocks 1230, 1232, and 1234, the controller is utilized to optionally record the occurrence of the high motor temperature condition (the "event"), to optionally communicate the occurrence of the event to other surface or subsurface equipment, and to optionally communicate a command to other surface or subsurface equipment. A variety of commands can be communicated to other equipment. For example, the electrical submersible pump 11 may communicate the occurrence of the event to motor controllers which are located either at the surface or at some other location, causing the motor controller to reduce the power provided to the electrical submersible pump 11, and thus reduce its operating speed. Additionally, valves which control the flow of fluid into the region of the wellbore where the electrical submersible pump 11 is located may be partially or completely closed in order to reduce the flow of fluids into the wellbore while the electrical submersible pump is operating at a reduced speed. The process ends at software block 1236.

Figure 2Z:
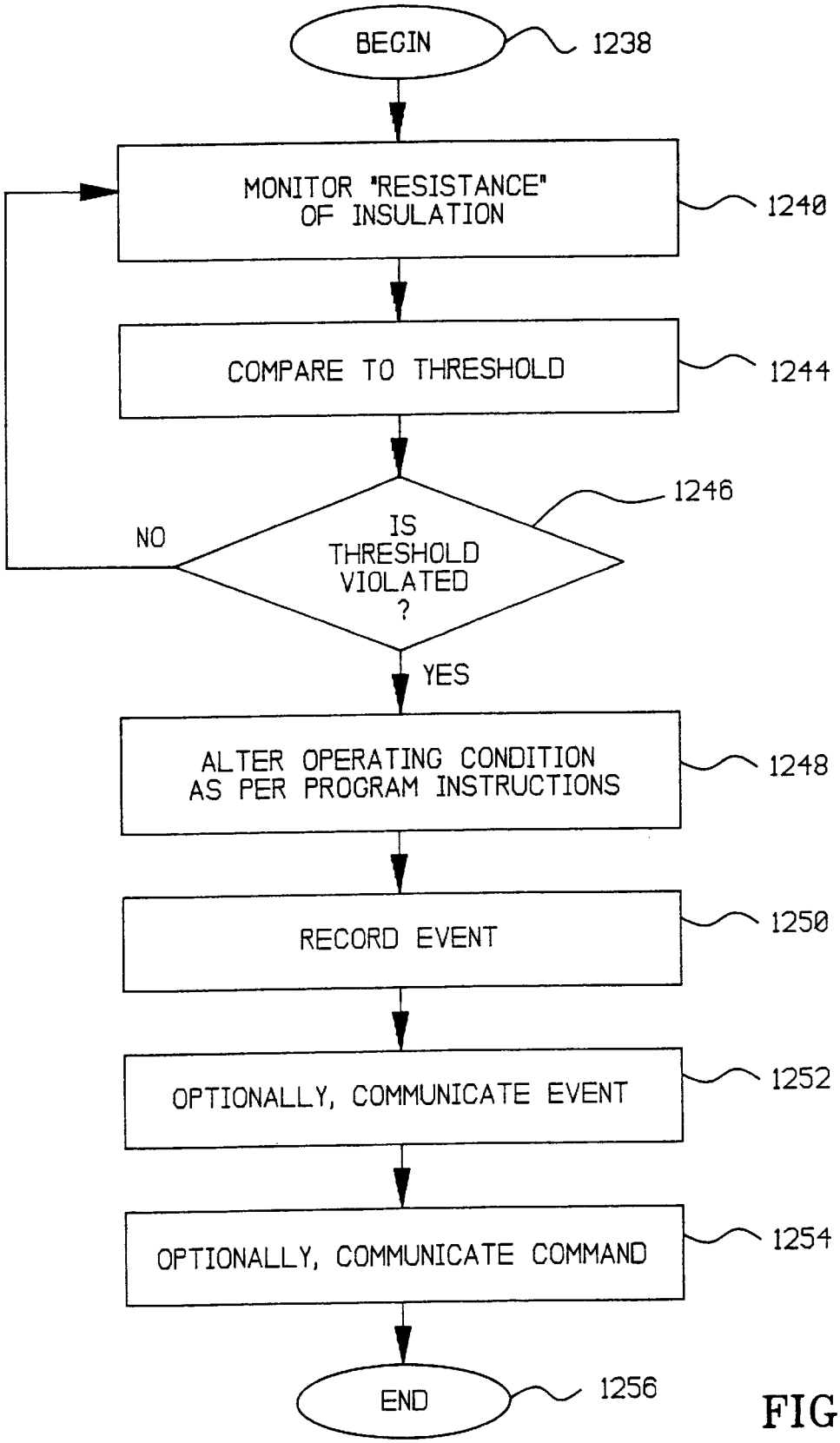
FIG. 2Z is a flowchart representation of the data processing implemented steps of monitoring insulation resistance.
Figure 2A:
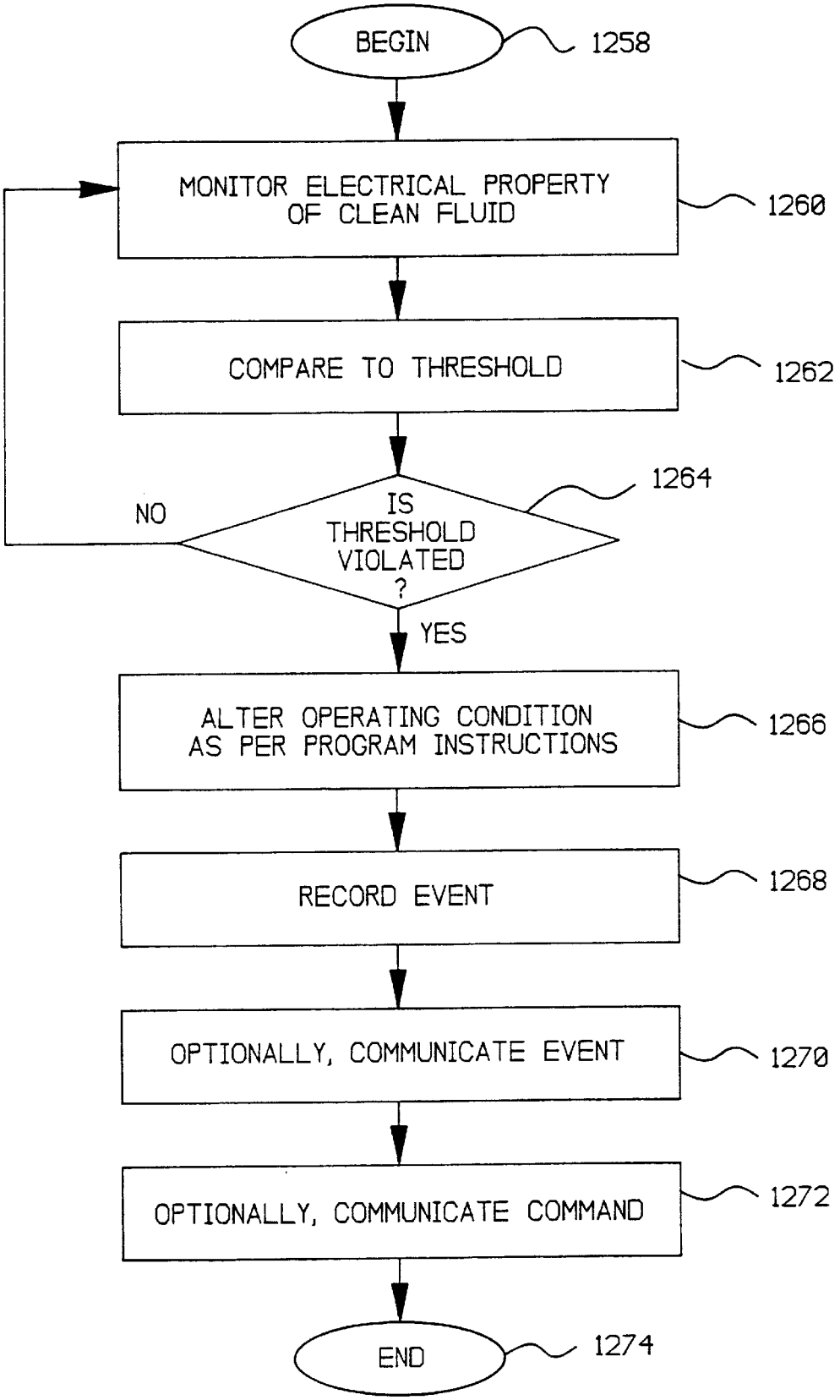
Figure 2B:
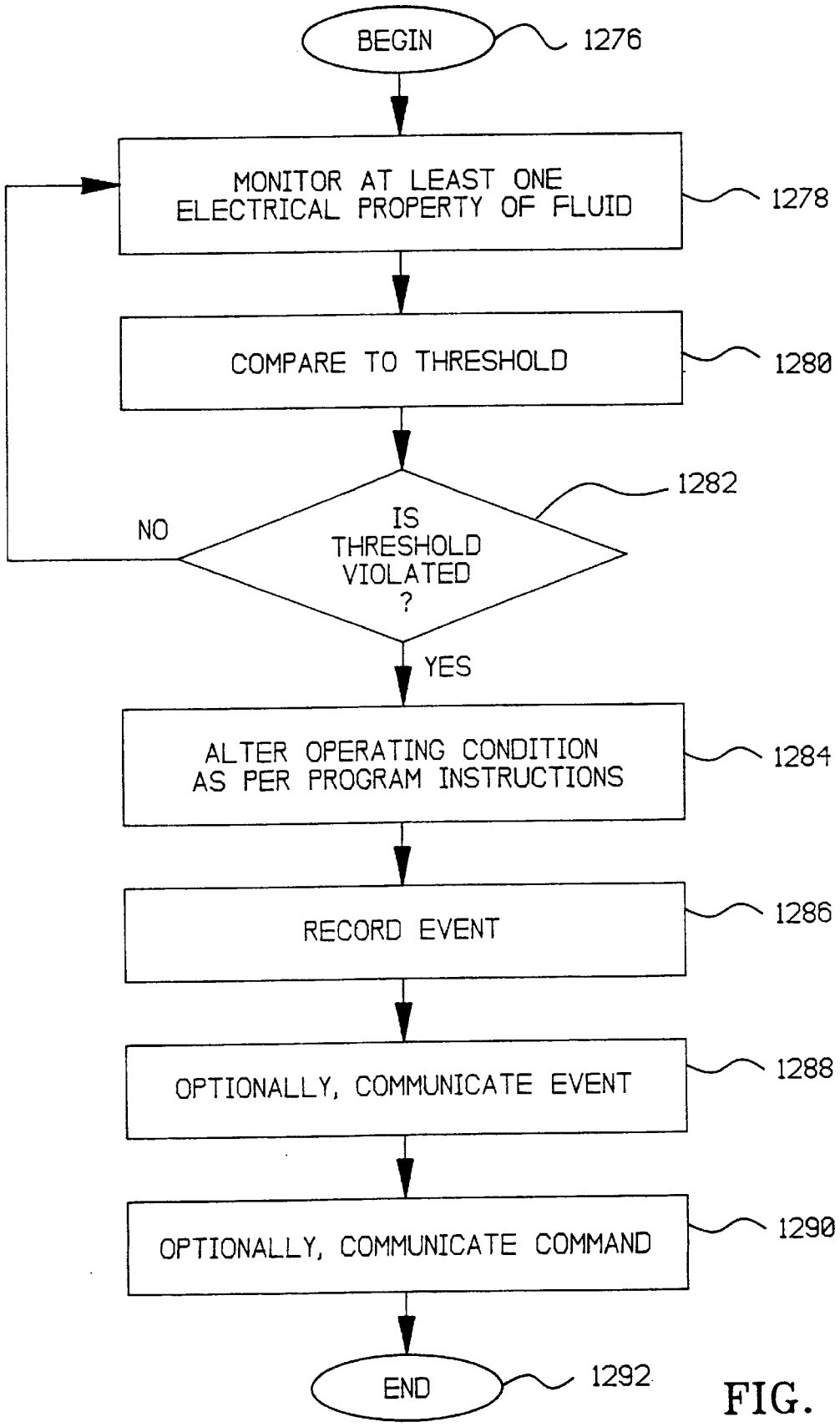
Figure 2C:
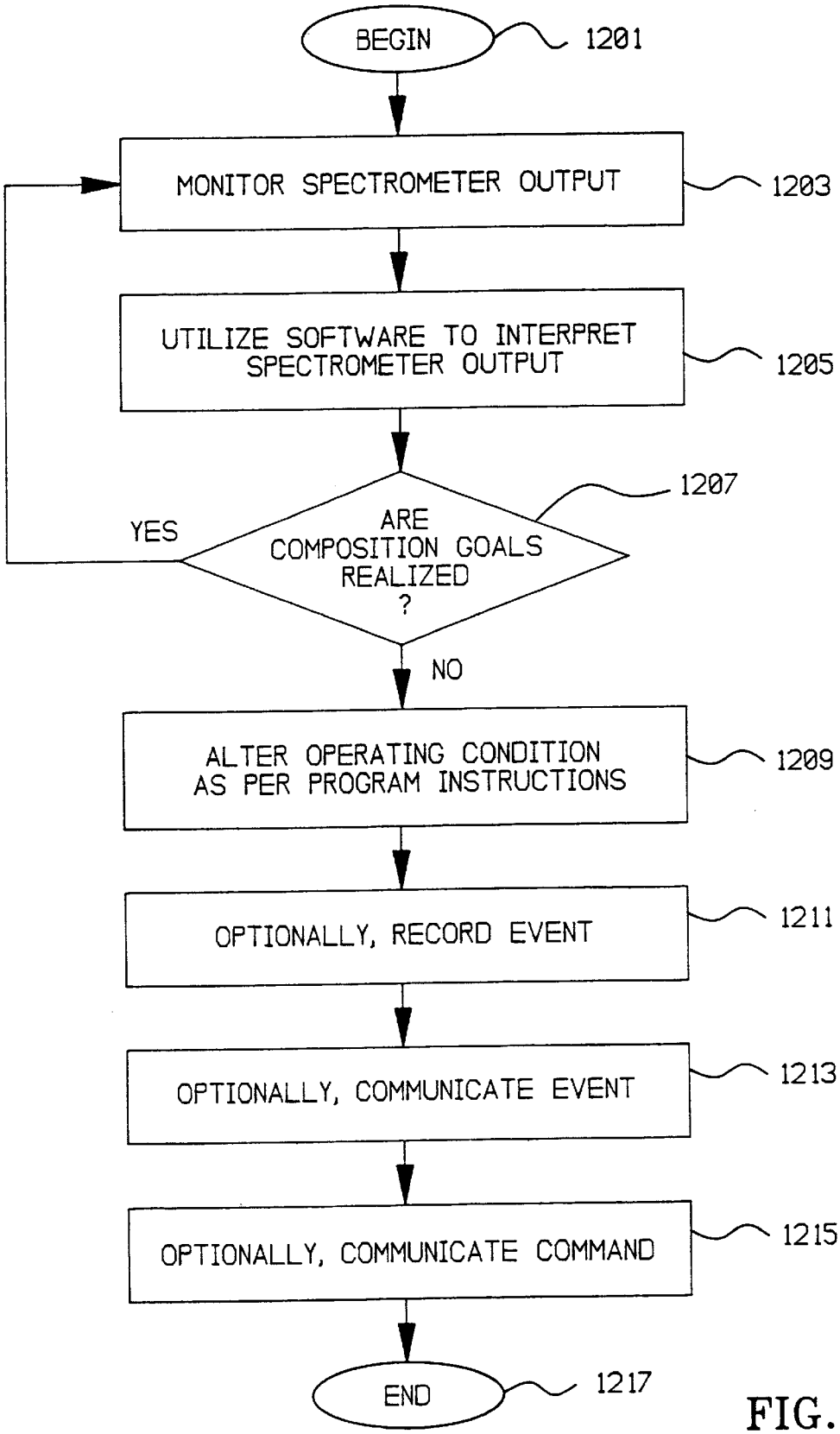
Figure 2D:
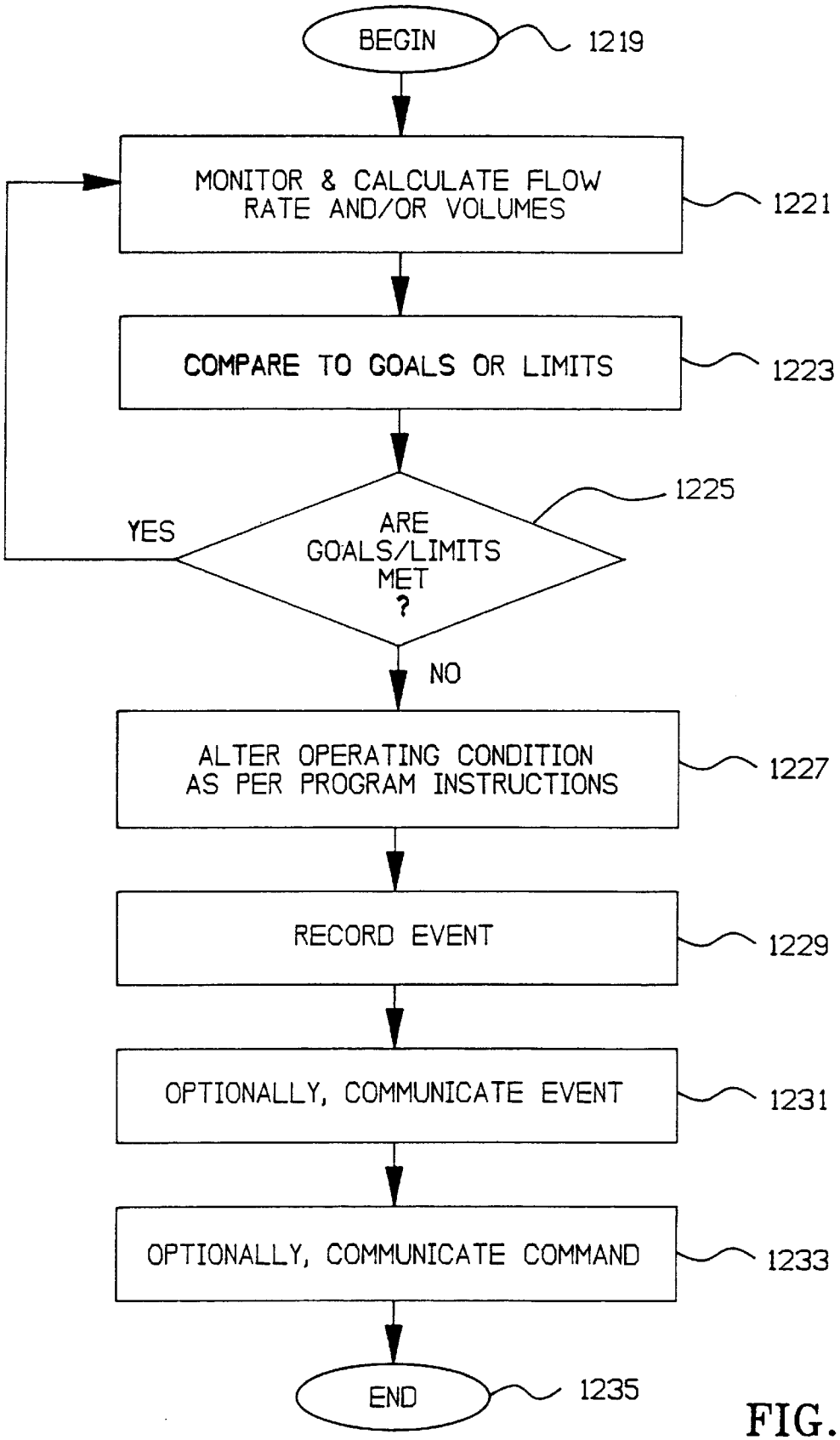

The electrical submersible pump 11 of the present invention may be utilized to monitor the quality of the insulation resistance at various locations. This is accomplished by supplying a DC voltage to a region of insulation of interest, and utilizing a current detector to detect leakage currents which exist when there is a breach or degradation of the insulation. FIG. 2Z is a flowchart representation of the data processing implemented steps of monitoring the quality of the insulation resistance. The process begins at software block 1238, and continues at software block 1240, wherein the controller 411 is utilized to monitor the resistance of the insulation by monitoring the detected leakage currents. Then, in accordance with software block 1244, the controller 411 is utilized to compare the thresholds to thresholds maintained in memory. In accordance with software block 1246, the controller 411 is utilized to compare the monitored resistance of the insulation to one or more thresholds maintained in memory; if the threshold is not violated, the controller is returned to software block 1240; if the threshold is violated, the process continues to software block 1248, wherein the controller 411 is utilized to alter at least one operating condition in accordance with programmed instructions. For example, if a serious loss of insulation is detected, "an event," the electrical submersible pump may be switched from an "on" condition to an "off" condition in order to avoid damaging the pump. Next, in accordance with software blocks 1250, 1252, 1254, the controller 411 is utilized to record the occurrence of the event, to optionally communicate the occurrence of the event to either surface or subsurface equipment, or to optionally communicate commands to one or more surface or subsurface devices which are electrically controllable. The process ends at software block 1256.

The improved electrical submersible pump of the present invention may be utilized to monitor the electrical properties of the clean fluid which is contained within the housing of the electric motor. FIG. 2AA is a flowchart representation of the data processing implemented steps of monitoring the electrical property of the clean fluid of the electric motor within electrical submersible pump 11. The process begins at software block 1258, and continues to software block 1260, where the controller 411 is utilized to monitor the electrical properties of the clean fluid. Preferably, the sensors are utilized to monitor either the resistivity and/or the dielectric constant of the clean fluid. If there is leakage of wellbore fluid into the clean fluid, the resistivity and dielectric constant associated with the clean fluid will change, an "event." Next, in accordance with software block 1262, the controller 411 is utilized to compare the monitored values to one or more thresholds maintained in memory. In accordance with software block 1264, the controller 411 determines whether the threshold or thresholds have been violated; if not, the process continues to software block 1260; if so, the process continues to software block 1266, wherein the controller 411 is utilized to alter at least one operating condition in accordance with program instructions. Then, in accordance with software blocks 1268, 1270, and 1272, the controller is utilized to record the occurrence of the event, to optionally communicate the event to surface or subsurface equipment, and to optionally communicate commands to remotely located surface or subsurface equipment. The software process ends at software block 1274.

The improved electrical submersible pump of the present invention may be utilized to monitor the electrical property of fluids passing through the electrical submersible pump. FIG. 2BB is a flowchart representation of data processing implemented monitoring of the electrical property of fluids passing through the electrical submersible pump 11. The process begins at software block 1276, and continues to software block 1278, wherein the controller 411 is utilized to monitor at least one electric property of the fluid. In accordance with the present invention, one or more of a variety of commercially available sensors may be utilized to monitor the resistivity or dielectric constant of the fluids passing through the electrical submersible pump 11 at particular points within the pump 11. In accordance with software block 1280, the controller 411 is utilized to compare the monitored values with one or more thresholds maintained in memory. Then, in accordance with software block 1282, the controller 411 determines whether one or more thresholds have been violated; if not, the process continues to software block 1278; if so, the process continues in software block 1284, wherein the controller 411 is utilized to alter one or more operating conditions in accordance with program instructions. As is well known, the electrical properties of fluid can provide information about the presence or absence of petroleum within the wellbore fluid and its relative content. Therefore, the operating condition of the electrical submersible pump 11 can be moderated in order to obtain particular goals with respect to the oil/water content of the fluids passing through the electrical submersible pump 11. Next, in accordance with software blocks 1286, 1288, and 1290, the controller 411 is utilized to record the occurrence of the event, to optionally communicate the event to surface or subsurface equipment, and to optionally communicate commands to remotely located surface or subsurface equipment. The process ends at software block 1292.

The improved electrical submersible pump 11 of the present invention may be utilized to monitor the output of a miniaturized, solid state spectrometer in order to determine the likely chemical composition of the wellbore fluid. FIG. 2CC is a flowchart representation of data processing implemented steps of monitoring spectrometer data. The process begins at software block 1201, and continues at software block 1203, wherein the output of the solid state mass spectrometer is monitored. Then, in accordance with software block 1205, the controller 411 is utilized to interpret the output of the mass spectrometer in order to determine the likely composition of the wellbore fluid. Next, in accordance with software block 1207, the controller 411 is utilized to determined whether or not the composition goals are realized by operation of the electrical submersible pump 11; if so, the process continues to software block 1203; if not, the process continues to software block 1209, wherein the controller 411 is utilized to alter operating conditions in accordance with program instructions, such as, for example, operating the electrical submersible pump 11 at higher or greater speeds. Next, in accordance with software blocks 1211, 1213, and 1215, the controller 411 is utilized to optionally record the occurrence of the event, to optionally communicate the occurrence of the event to remotely located surface or subsurface equipment, and to optionally communicate commands to remotely located surface or subsurface equipment. The process ends at software block 1217.

The electrical submersible pump 11 of the present invention may be utilized to monitor flow rates. FIG. 2DD is a flowchart representation of data processing implemented steps for monitoring flow rates within the wellbore. The process begins at software block 1219 and continues at software block 1221, wherein the controller 411 is utilized to monitor and calculate flow rates and/or flow volumes. Next, in accordance with software block 1223, the controller 411 is utilized to compare the calculated flow rates and/or volumes to predetermined goals and/or limits. In software block 1225, the controller 411 is utilized to determine whether the goals and/or limits have been met; if so, the controller 411 is returned to software block 1221; if not, in accordance with software block 1227, the controller 411 is utilized to alter at least one operating condition in accordance with program instructions. Next, in accordance with software blocks 1229, 1231, 1233, the controller 411 is utilized to record the event, to optionally communicate the occurrence of the event to remotely located surface or subsurface equipment, or to optionally communicate a command to remotely located surface or subsurface equipment. The process ends at software block 1235.

For all of the foregoing data processing operations, the "recordation" or "recording" of an "event" can signify the storage in memory of any or all of (1) the sensed raw data, (2) the condition data, (3) intermediate or ultimate calculations of one or more pump or wellbore parameters, (4) the relative date/time of occurrence of the event, (5) the frequency or total number (count) of the events, (6) a record or log of the communication of the data and any associated command to any other surface or wellbore location, (7) acknowledgement of receipt of the data or command from any other wellbore or surface location.

3. USES OF ELECTRICAL SUBMERSIBLE PUMPS IN ACCORDANCE WITH THE PRESENT INVENTION

USES OF THE ELECTRICAL SUBMERSIBLE PUMP: In accordance with the present invention, the electrical submersible pump may be utilized in a number of differing fluid transfer operations, including some operations which are conventional, and other operations which are innovative. For example, the electrical submersible pump may be utilized in conventional fluid transfer operations to lift wellbore fluids from a subsurface location to a surface location. The electrical submersible pump of the present invention may also be utilized in an innovative fluid transfer operation, such as the transfer of fluids from either a surface or subsurface location to another subsurface location. For example, the electrical submersible pump of the present invention may be utilized to effect the fluid transfer or well treating fluids, such as acidizing fluids, emulsifiers, and breakers. Additionally, the electrical submersible pump of the present invention may be utilized to transfer fracturing fluids which contain or include a high particulate matter content such as fracturing proppants (such as sand, glass beads, and synthetic beads). The electrical submersible pump of the present invention may also be utilized in an innovative fluid transfer operation to move fluids from a subterranean fluid source (or reservoir) site to a subterranean target site to achieve one or more completion or production objectives. Such objectives include the separation of wellbore fluids: for example, the elimination or removal of free gas from wellbore fluids, or the removal or elimination of water from the wellbore fluid. The improved electrical submersible pump of the present invention may be utilized to compress free gas in a subterranean location. The compressed free gas may be injected into one or more particular geologic formations in a manner which enhances one or more production objectives. For example, the free gas from one formation may be separated, compressed, and injected into another formation in order to allow or enhance the gas lift production of wellbore fluids from that particular formation. This minimizes or eliminates the disposal problems associated with free gas when it is pumped or when it flows to the wellhead. The enhanced electrical submersible pump of the present invention may also be utilized for the separation, and injection, of wellbore water. The wellbore water may be removed from one particular subterranean geologic formation (where it is essentially a waste product) and deliberately delivered to another subterranean geologic formation, where it may serve one or more beneficial production or completion objectives. For example, the wellbore water may be injected into a particular subterranean geologic formation which is part of a water flood operation. The water which would have ordinarily been lifted to the surface and disposed of by (rather expensive) disposal services now serves a beneficial purpose in the water flood zone to drive the hydrocarbons toward one or more production wells. SOME CONVENTIONAL USES AND CONFIGURATIONS OF ELECTRICAL SUBMERSIBLE PUMPS: FIGS. 3A–3J depict conventional uses and configurations for electrical submersible pumps. Such uses and configurations can be utilized or employed with the improved electrical submersible pump of the present invention.

Figures 3A, 3B, 3C:
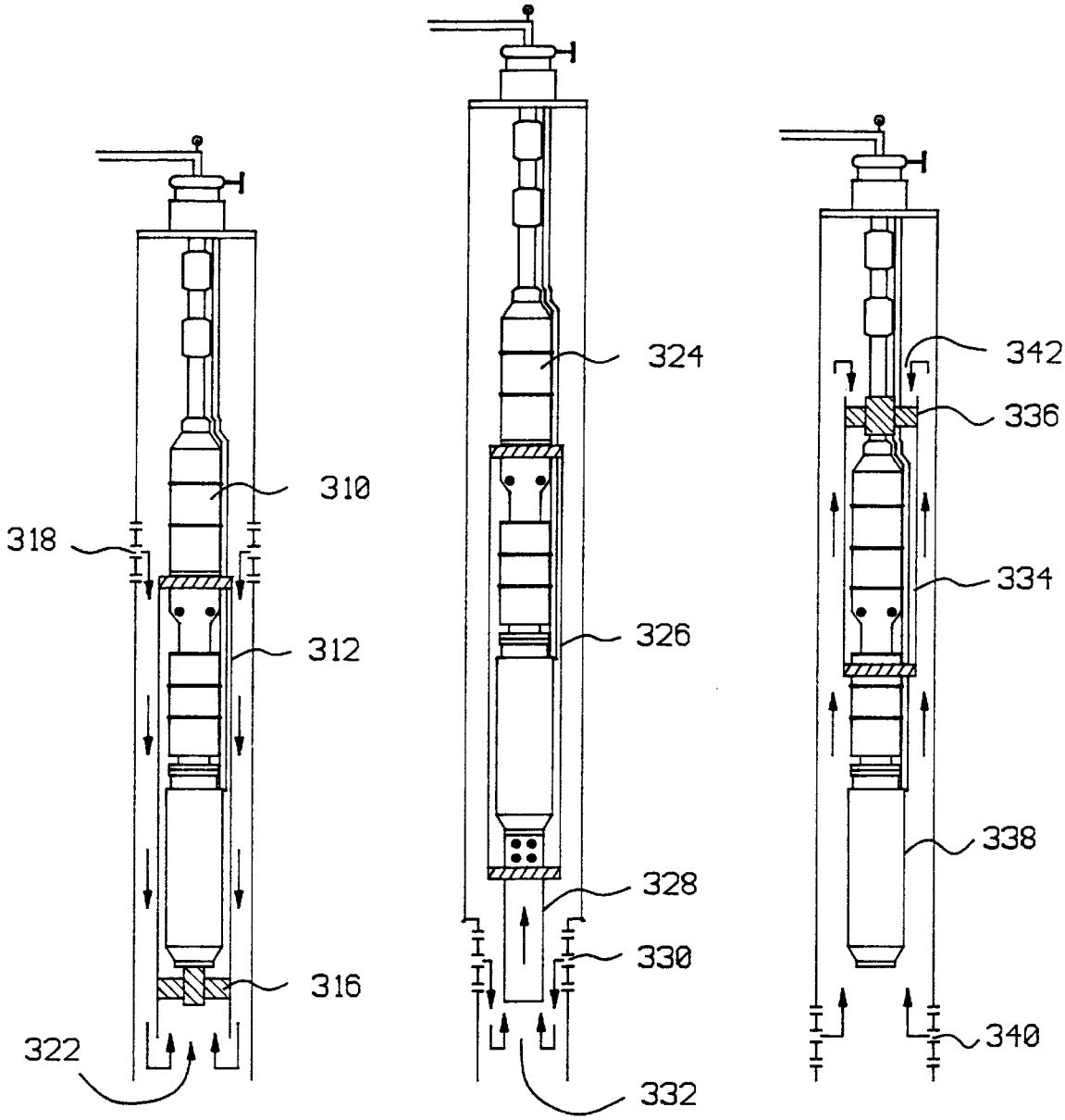
FIGS. 3A, 3B, and 3C schematically depict shrouded configurations for electrical submersible pumps.

FIGS. 3A, 3B, and 3C depict some conventional "shrouded configuration" installations of electrical submersible pumps. This shrouded configuration differs from the configuration depicted in FIG. 1A in that the pump unit is set in or below the perforation zone. In this configuration, motor cooling is achieved by surrounding the motor housing with a shroud (known as a "motor jacket") up to just above the pump intake. The motor jacket can be either open ended or packed off using a stinger. In FIG. 3A, jacket 312 is shown as covering the pump intake, the seal section, and the electrical motor. A centralizer 316 fixes the position of the jacket relative to the electrical submersible pump. Wellbore fluids flow through perforations 318 into the wellbore. A flow path 322 is defined through centralizer 316. The fluid flows upward within jacket 312, where it is taken into pump 310 at the pump intake. The jacket 312 can serve to minimize the amount of gas entering pump 310. Additionally, since pump 310 is exposed to wellbore fluids as they pass through perforations 318, the flow of wellbore fluids can be utilized to provide cooling to pump 310. FIG. 3B depicts jacket 326 disposed about the pump intake, seal section, and electrical motor of the electrical submersible pump. A stinger 328 is connected to jacket 326. Wellbore fluid flows through perforations 330, and upward through central bore 332 of stinger 328. FIG. 3C depicts jacket 334 covering only the pump portion of the electrical submersible pump. Motor 338 is not jacketed, and thus may be cooled by the flow of wellbore fluids through perforations 340. The wellbore fluids flow into the jacket at opening 342. Centralizer 336 is provided to fix the relative position of jacket 334 and the electrical submersible pump.

Figure 3D:
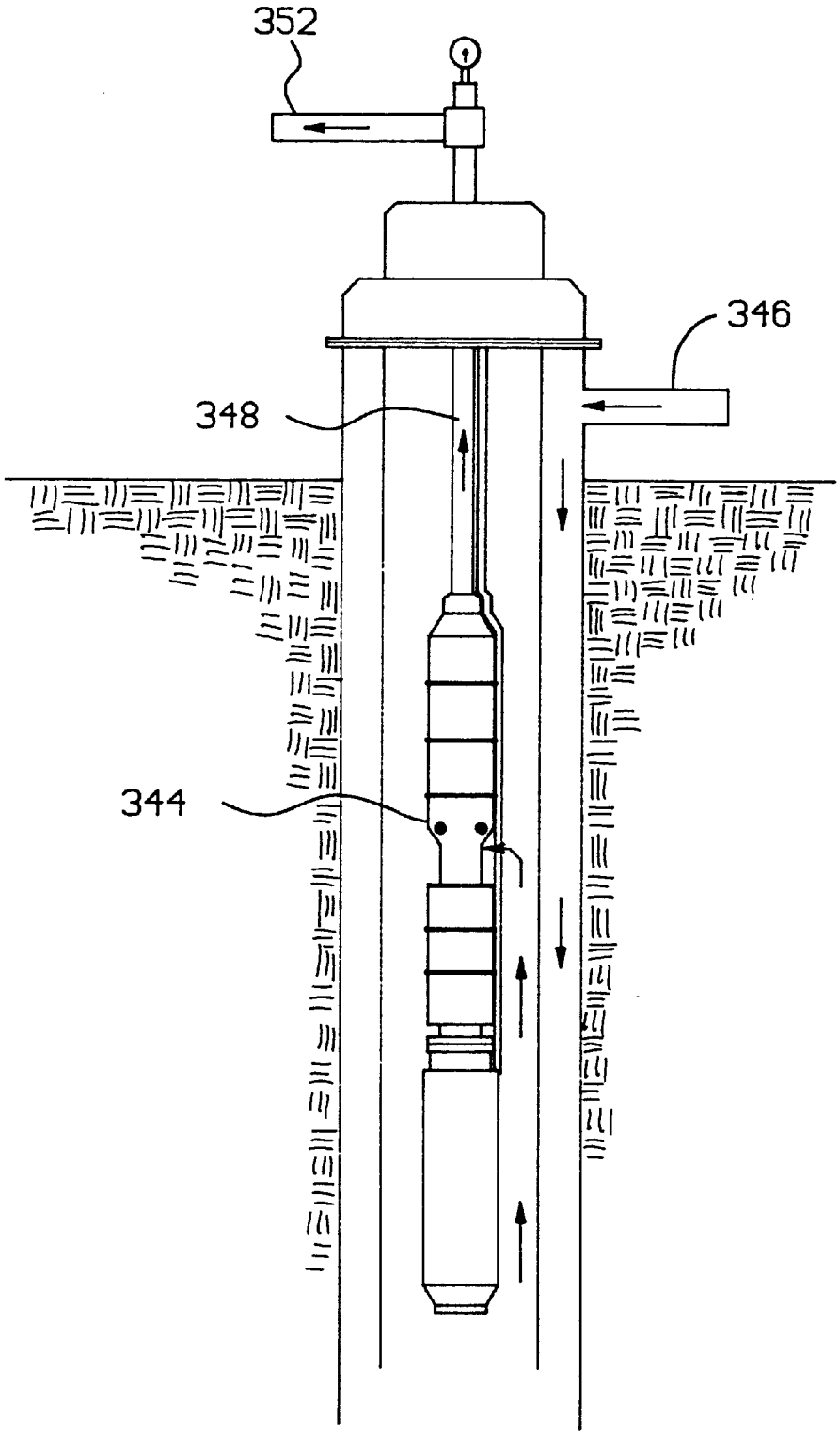
FIG. 3D depicts a booster pump configuration for electrical submersible pumps.

FIG. 3D is a booster pump configuration, in which the electrical submersible pump is used as a booster pump to increase the incoming pressure. As is shown, the electrical submersible pump 344 is installed in a shallow set vertical casing commonly known as a "can". An incoming line 346 is connected to the can. It feeds fluid into the can and electrical submersible pump 344. Electrical submersible pump 344 lifts the fluid through tubing 348, 352. Depending upon the particular application, several booster pumps can be connected together in series or in parallel. In the series connection, the discharge of one booster is connected to the feed of a second stage booster. In such a system, the flow rate through the various pump stays the same while the pressure increases as the fluid flows from one booster to the next. On the other hand, in a parallel connection, the boosters are connected to a common discharge manifold whereby the discharge pressure is the same, but the production rates are cumulative. Electrical submersible pumps are used as boosters to add pressure to long pipelines for pumping produced fluids to storage and processing facilities. Electrical submersible pumps are also used as boosters for increasing the pressure of water injection systems in water flood projects.

Figure 3E:
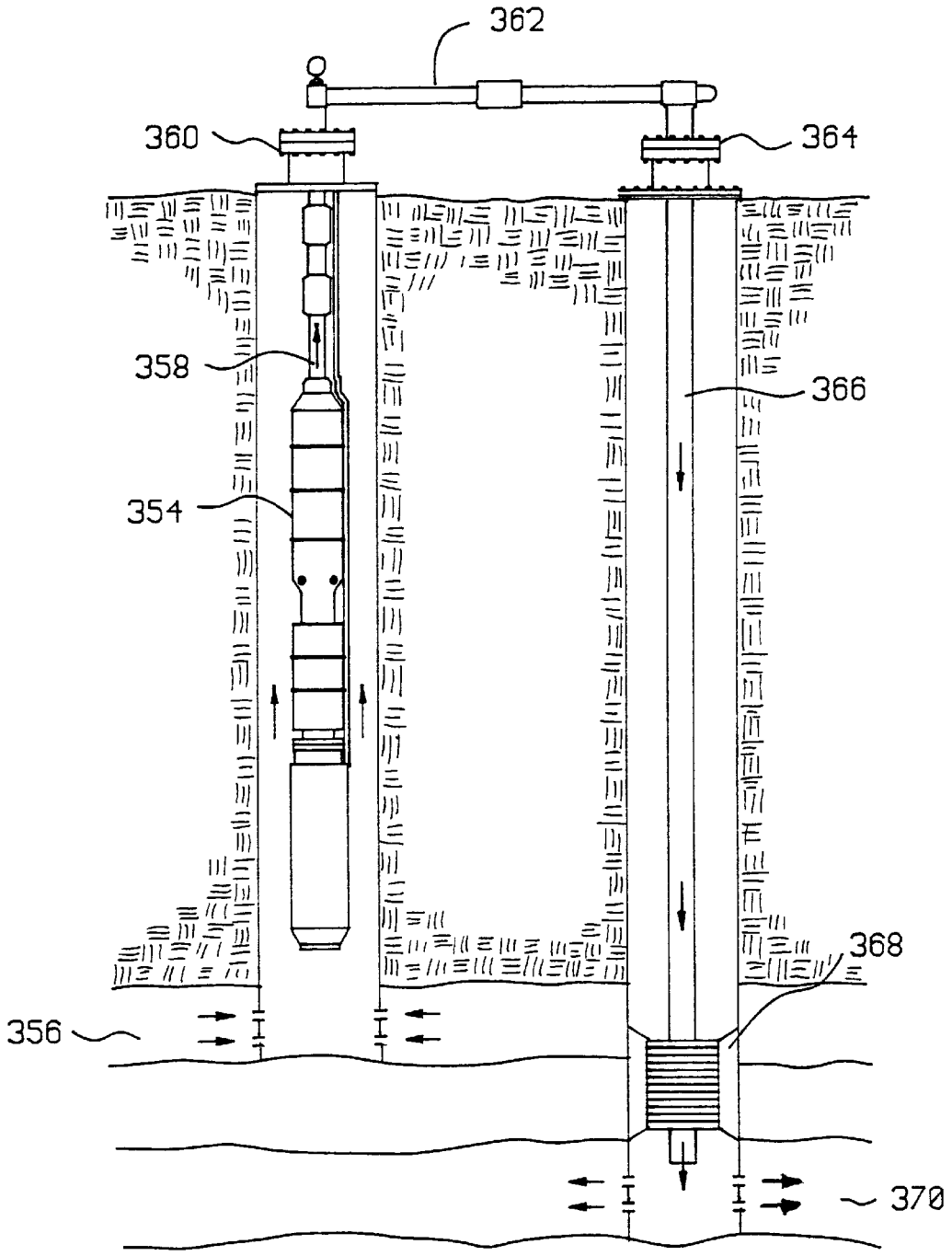
FIG. 3E depicts a two well configuration for electrical submersible pumps.

FIG. 3E depicts the utilization of electrical submersible pump 354 for injecting subsurface water from one formation into another. As is shown, subsurface water flows from water bearing formation 356 into the wellbore, where it is drawn upward by electrical submersible pump 354, and lifted through production tubing string 358. The fluid passes through wellhead 360 and conduit 362, then downward through wellhead 364 of an injection well. The fluid passes through tubing string 366 which is located and isolated by packer 368. The water then enters formation 370 through perforations, where it is utilized to drive hydrocarbons to one or more producing wells.

Figure 3F:
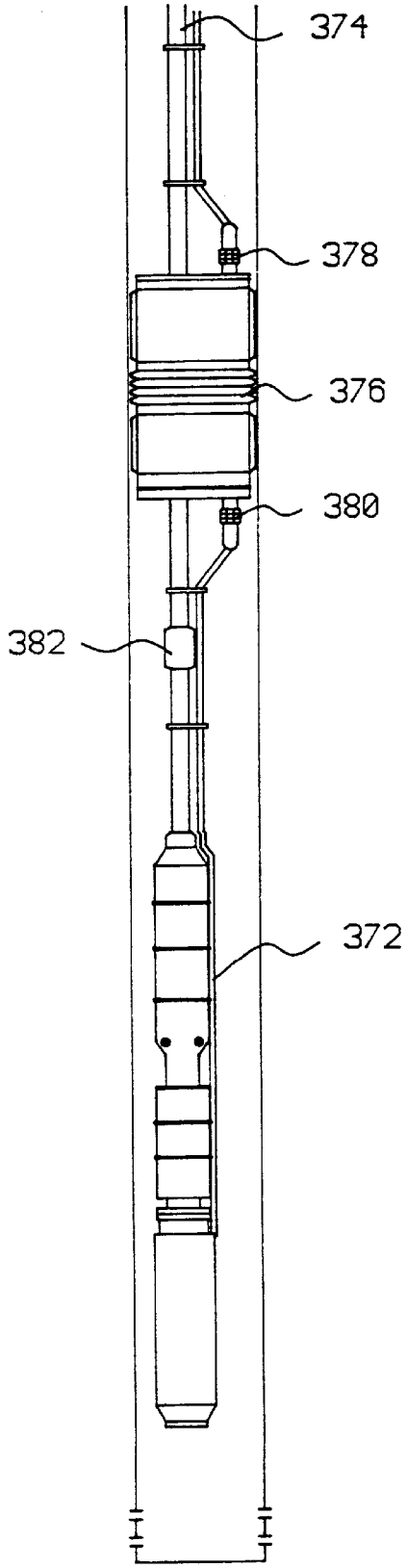
FIG. 3F depicts the combined use of an electrical submersible pump and a packer.

FIG. 3F depicts the utilization of a packer in combination with an electrical submersible pump. As is shown, an electrical submersible pump 372 is carried by tubing string 374. A packer 376 is positioned above electrical submersible pump 372. Electrical thread connections 378, 380 are provided to allow for the feed through of the electrical conductor which supplies power to electrical submersible pump 372. This configuration can be utilized to produce a dual zone without commingling fluids. Additionally, this configuration can be used to protect cables from damage due to gas saturation in a high pressure well. Adjustable union 382 is provided intermediate electrical submersible pump 372 and packer 376. It functions to remove the excess slack from the motor lead cable.

Figure 3G:
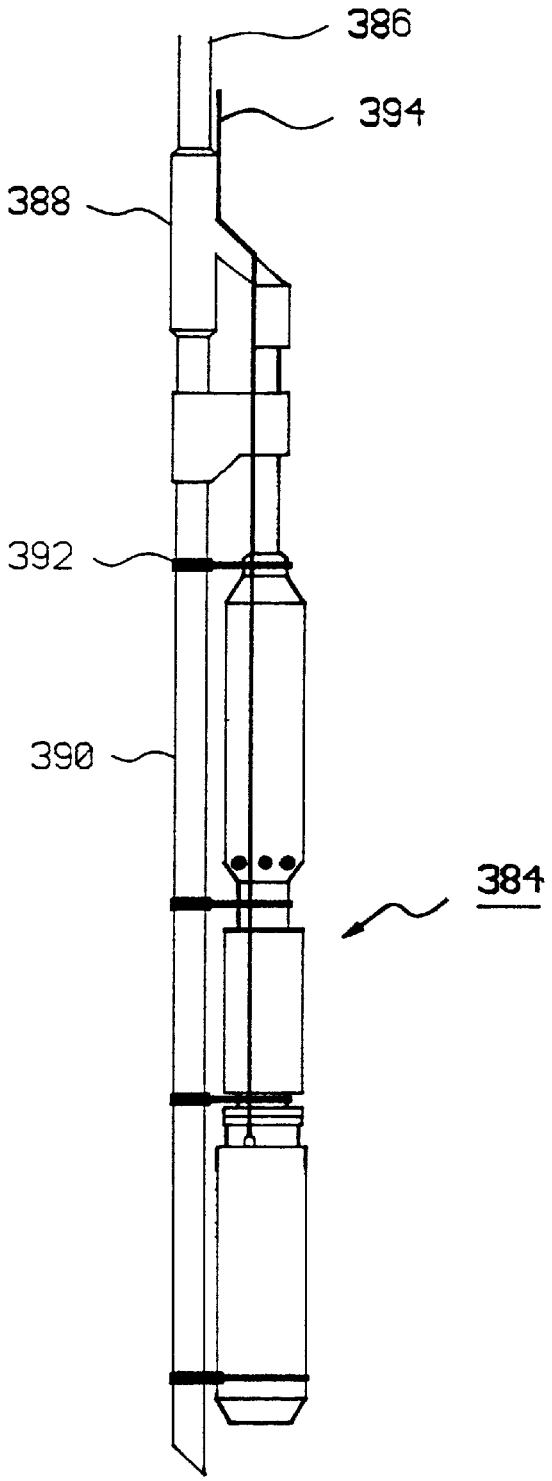
FIG. 3G depicts the combined use of an electrical submersible pump and a "Y" tool installation.

FIG. 3G depicts an electrical submersible pump 384 used in combination with a "Y" tool. The "Y" tool is utilized to allow downhole surveys to be taken with wireline equipment when an electrical submersible pump is in the well. As is shown, electrical submersible pump 384 is connected to production tubing string 386 by "Y" tool 388. The flat cable 394 passes over "Y" tool 388, and downward to the motor section of electrical submersible pump 384. Bypass tubing 390 is also connected to "Y" tool 388. Electrical submersible pump 384 is connected by cable clamps 392 to the exterior of by-pass tubing 390. A wireline may be lowered through production tubing string 386 and "Y" tool 388 through by-pass tubing 390 to make wireline measurements of the wellbore and surrounding formation.

USE FOR GAS COMPRESSION AND SUBSURFACE WASTE WATER INJECTION

Electrical submersible pumps are commonly used in oil wells. Electrical submersible pumps have found particular applications in wells which produce a large ratio of water relative to the oil, and wherein the formation pressure is not sufficient for the well to flow naturally. A typical electrical submersible pump is centrifugal, having a large number of stages of impellers and diffusers. The pump is mounted to a downhole electrical motor and the assembly is supported in the well on production tubing. A power cable extends alongside the tubing to the motor for supplying power from the surface.

In some instances, a well will also produce quantities of gas along with the liquid. Centrifugal pumps are designed for pumping incompressible liquids. If a sufficient amount of gas is present, the pump will lose efficiency because gas is compressible. Gas separators have been employed to reduce the amount of gas entering the centrifugal pump. A gas separator separates a mixture of liquid and gas by centrifugal force. The liquid flows through a central area into the intake of the pump. In the prior art, the gas is discharged out gas discharge ports into the annulus surrounding the pump. Gas in the annulus collects at the surface of the well and is often introduced through a check valve back into the production flowline at the surface.

Electrical submersible pumps cannot be employed if a well produces principally gas. Gas wells are normally produced by their own internal drive due to the formation pressure. In some instances, however, the gas flow is inadequate either due to poor permeability or low pressure. In these instances, generally the wells are not produced.

Gas compressors, of course, have been known in general in industry. Centrifugal gas compressors utilize stages of rotating impellers within stators or diffusers. However, the design is such that they will operate to compress gas, not pump a liquid. Generally, a centrifugal gas compressor must operate at a much higher rotational speed than a liquid pump.

In this invention, a downhole gas compressor may be employed for compressing gas produced in a well and for transferring the gas to a selected location. The gas compressor is a centrifugal type driven by a downhole electrical motor. The higher speed required by the gas compressor may be handled by the electrical motor itself, or it may be handled by a speed increasing transmission.

In one application, a well may be producing predominantly gas with small amounts of liquid. In that instance, a centrifugal pump may be mounted to the lower end of the same electrical motor that drives the gas compressor. The pump is mounted with its discharge facing downward. A packer seals the discharge from the intake of the pump. Disposal zone perforations are located below the packer. A mixture of liquid and gas flows in through the producing formation perforations into the well. Separation occurs due to gravity or by a gas separator, with the liquid flowing downward to the intake of the pump and the gas flowing upward to the intake of the gas compressor. The intake of the gas compressor is positioned above the liquid level.

In another instance, the well may be producing predominately liquid but with some gas. In that instance, repressurizing zone perforations may be located above the producing zone perforations. A straddle packer separates these perforations from the production perforations. An electrical submersible pump assembly is installed within the well and configured to discharge liquid into the tubing to flow to the surface. The electrical submersible pump assembly has a gas separator. The outlet ports to the gas separator discharge into the well. A gas compressor is mounted also in the well, with its intake located above the outlet of the gas separator. The outlet of the gas separator leads to the repressurization zone. The gas compressor and the pump would have separate motors in this instance. Operating both motors causes the gas separator to separate gas from the liquid, discharging gas to flow into the gas compressor. The gas compressor pressurizes the gas and transmits it to the repressurizing zone.

Figure 3H:
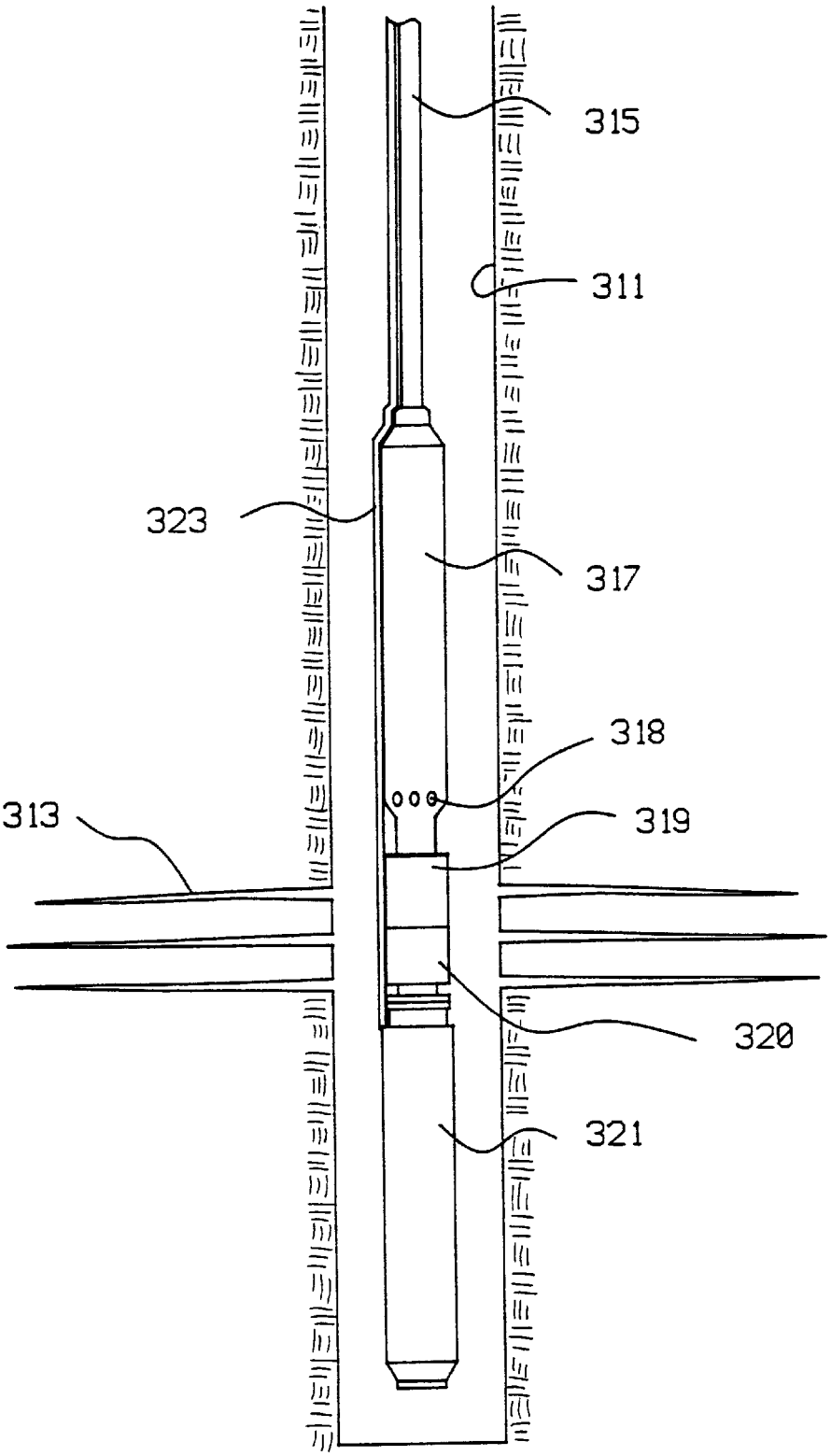
FIG. 3H is a schematic view of a well containing a gas compressor in accordance with this invention.

Referring to FIG. 3H, well 311 is a cased well having a set of producing formation perforations 313. Perforations 313 provide a path for gas contained in the earth formation to flow into well 311. A string of tubing 315extends from the surface into the well. A gas compressor 317 is supported on the lower end of tubing 315. Gas compressor 317 is of a centrifugal type, having a number of stages for compressing gas contained within the well 311. The outlet or discharge of gas compressor 317 connects to the tubing 315. Intake ports 318 are located at the lower end for drawing in gas flowing from perforations 313.

Gas compressor 317 is shown connected to a speed increasing transmission 319. Transmission 319 is connected on its lower end to a seal section 320 for a three-phase alternating current motor 321, which has a shaft that will drive the transmission 319. Seal section 320 is located at the upper end of motor 321 to seal the lubricant within motor 321 and may be considered a part of the electric motor assembly. Seal section 320 may also have a thrust bearing for handling downthrust created by gas compressor 317. A power cable 323 extends from the surface to motor 321 for supplying electrical power. The output shaft of transmission 319 will drive gas compressor 317 at a substantially higher speed than motor 321.

The speed desired for the gas compressor 317 will be much higher than typical speeds for centrifugal pumps used in oil wells. The speed required is generally proportional to the desired flow rate. Motor 321, if it is a two-pole motor, typically can be driven by the frequency of the power supplied to rotate in the range from 3500 to 10,500 rpm. For low flow rate production, such as 500 cubic meters per hour, the speed of rotation of gas compressor 317 must be at least 9000 rpm. Higher flow rates of 1500 to 2000 cubic meters per hour require speeds of 20,000 to 30,000 rpm. In FIG. 3H, transmission 319 provides the higher speeds, however, if only lower flow rates are desired, transmission 319 may be eliminated.

Figure 3J:
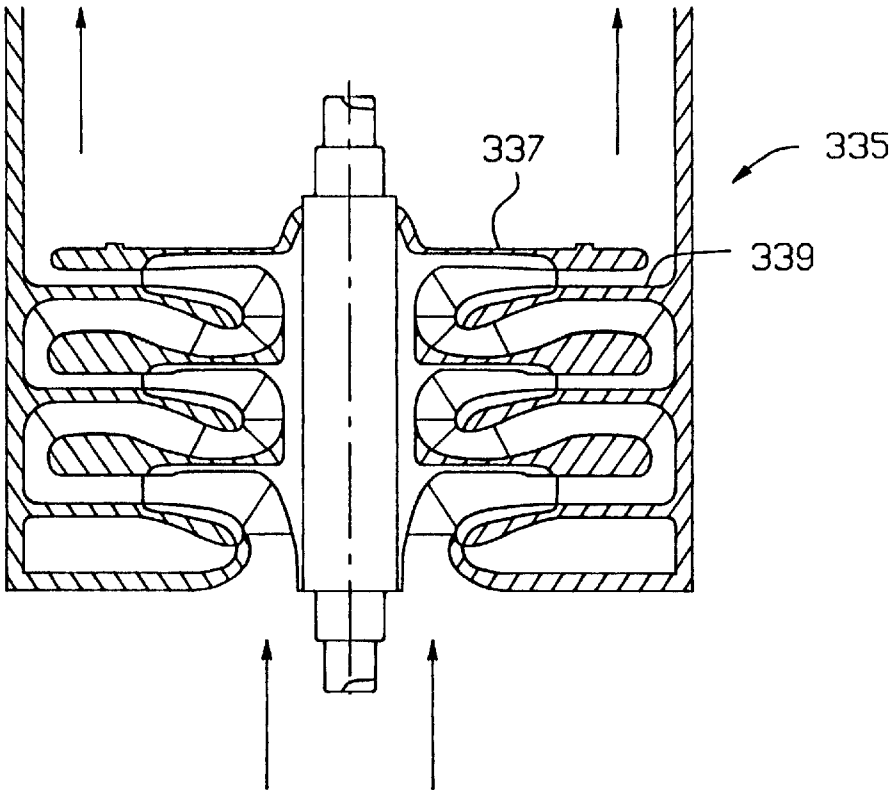
FIG. 3J is a sectional view of a portion of a radial flow gas compressor suitable for use with this invention.
Figure 3I:
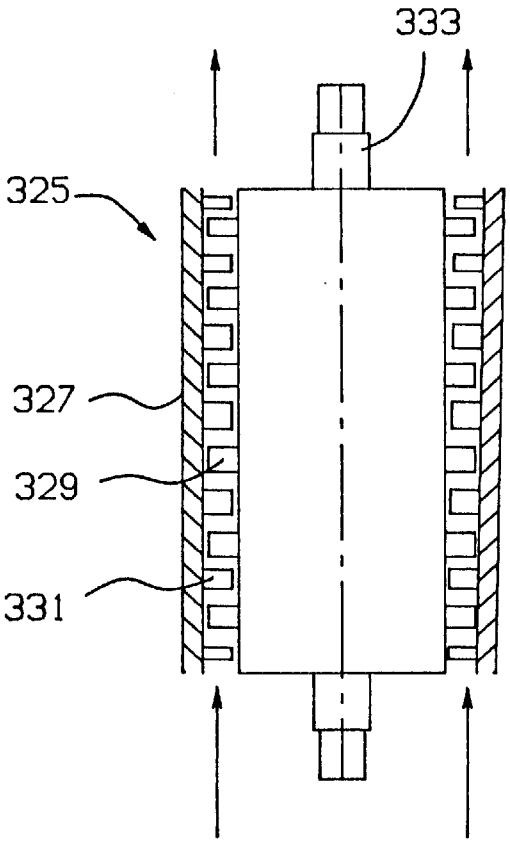
FIG. 3I is a sectional view of a portion of an axial flow gas compressor suitable for use with this invention.

FIG. 3I illustrates an axial flow compressor 325 which may be used for gas compressor 317 in FIG. 3H. Axial flow compressor 325 has a tubular housing 327 containing a large number of impellers 329. Impellers 329 are rotated within stator 331, which may be also referred to as a set of diffusers. A shaft 333 rotates impellers 329. Each stage of an impeller 329 and stator 331 results in a greater increase in pressure.

FIG. 3J illustrates a radial flow compressor 335 which may also be used for gas compressor 317 of FIG. 3H. Generally, a radial flow compressor, such as compressor 335, produces higher pressures, but at lesser flow rates than axial flow compressor 325. Radial flow compressor 335 has a plurality of impellers 337, each contained within a diffuser 339. The configuration is such that the flow has radial outward and inward components from one stage to the other. In the axial flow compressor 325 of FIG. 3I, the flow is principally in an axial direction, with very little outward and inward radial components.

Figure 3K:
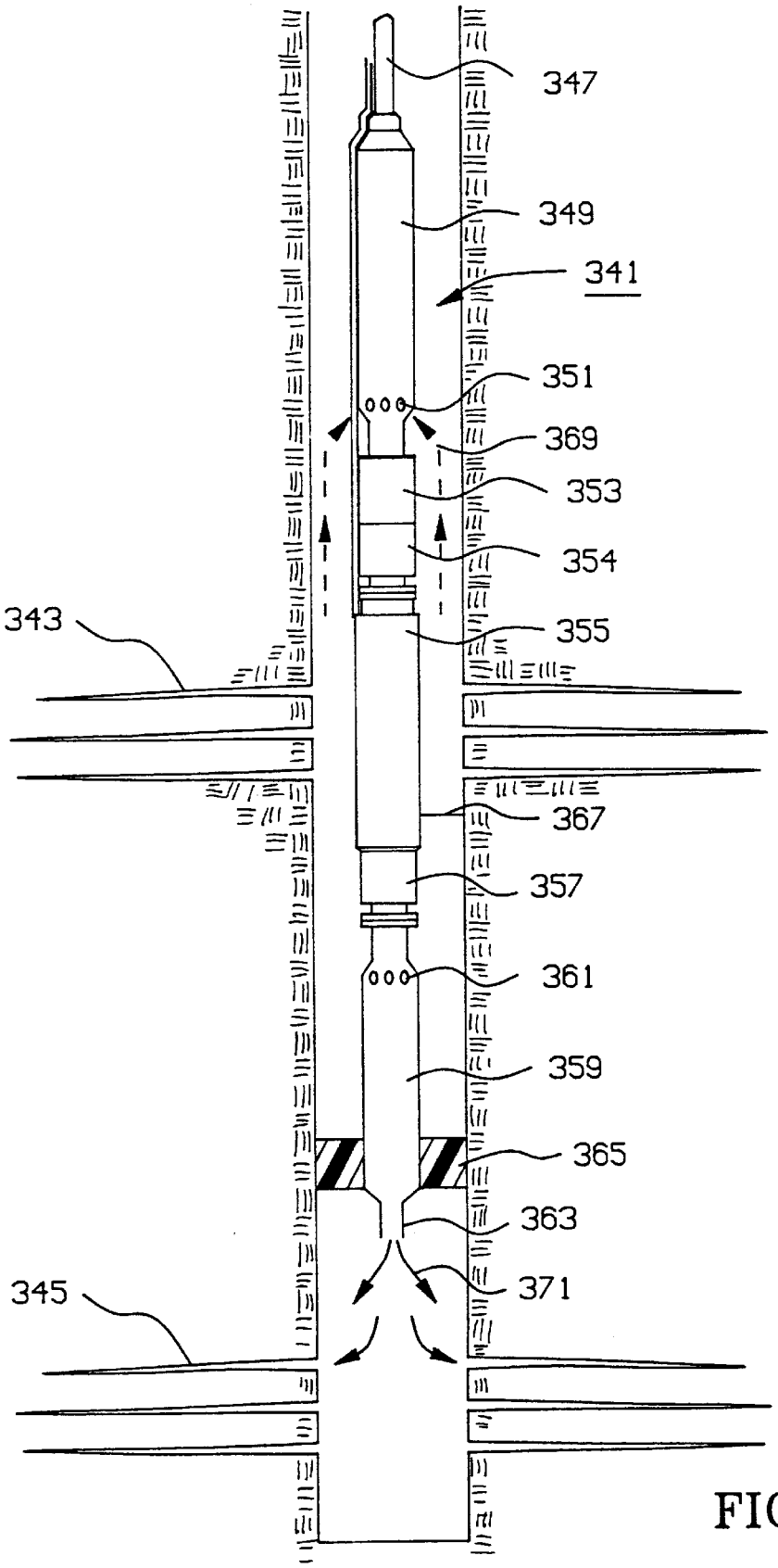
FIG. 3K is a sectional view of a second well having a gas compressor contained therein and also having a liquid pump for disposing of liquid produced along with the gas.

Referring to FIG. 3K, in this example, the well is expected to produce principally gas, although small amounts of liquid, usually water with a high salt content, will be produced along with it. In this example, the water is disposed of rather than brought to the surface. Well 341 has production zone perforations 343 which produce gas along with some water. Well 341 will have also disposal zone perforations 345 located below it. A string of tubing 347 extends from the surface into the well 341. A gas compressor 349 is connected to the lower end of tubing 347. Gas compressor 349 has inlet ports 351 which receive gas from the annulus contained within well 341.

A transmission 353 increases the speed of compressor 349 above that of the electrical motor 355. As part of the electric motor assembly, a seal section 354 is located at the upper end of motor 355 to seal lubricant within electrical motor 355. Seal section 354 may also have a thrust bearing for absorbing axial thrust created by gas compressor 349. A pump 359 is located on the lower end of a seal section 357 located at the lower end of motor 355. Seal section 357 seals the lower end of motor 355 against the egress of water and equalizes internal lubricant pressure with the hydrostatic pressure of the water. Seal section 357 also has a thrust bearing for absorbing axial thrust created by pump 359. Pump 359 has intake ports 361 on its upper end and a discharge 363 on its lower end. An isolation packer 365 seals pump 359 to the casing of well 341 between discharge 363 and intake ports 361. Pump 359 is a rotary pump which is operated by motor 355. Preferably, it is a conventional centrifugal pump, having a number of stages, each having an impeller and a diffuser.

In the operation of the well 341 of FIG. 3K, motor 355 will drive both pump 359 and gas compressor 349. The gas and liquid flowing through perforations 343 separates by gravity, with the water flowing downward in well 341 onto packer 365. Pump 359 is designed to allow a liquid level 367 to build up above intake port 361. Liquid level 367 will be below gas compressor intake ports 351, as entry of liquid into gas compressor 349 is detrimental. Pump 359 will pump liquid, as indicated by arrow 371, into the disposal perforations 345. The dotted arrows 369 indicate the flow of gas into gas compressor inlet 351. Gas compressor 349 compresses the gas and pumps it through tubing 347 to the surface for processing at the surface.

Figure 3L:
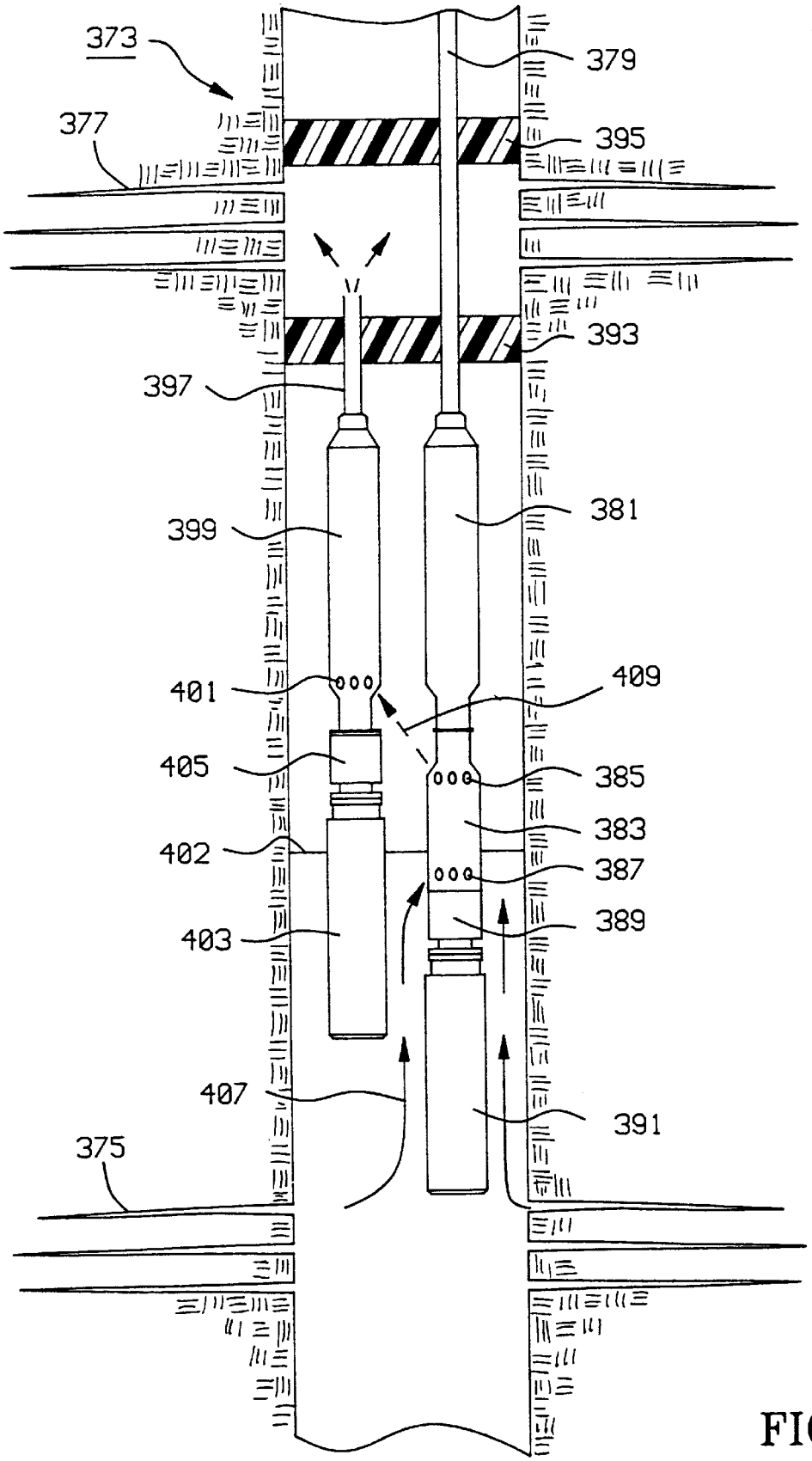
FIG. 3L is a schematic view of a third well containing a gas compressor and a liquid pump, with the gas compressor discharging into a repressurizing zone and the liquid pump discharging liquid to the surface.

In well 373 of FIG. 3L, the liquid is produced to the surface, as it will be containing commercial quantities of oil. In this instance, the gas is shown being utilized downhole for repressurizing purposes. However, the gas could also be produced to the surface if desired. Well 373 is similar to the wells previously mentioned, except that it will typically be of somewhat larger diameter. It will have production zone perforations 375. In this example, it will have repressurizing zone perforations 377 located above production zone perforation 375. A string of tubing 379 extends from the surface to a conventional electrical centrifugal submersible pump 381. Pump 381 is connected to a gas separator 383. Gas separator 383 may be of a conventional design such as shown in U.S. Pat. No. 5,207,810, which issued on May 4, 1993. Separator 383 has rotating components which through centrifugal force separate the heavier liquid from the lighter gas components. Liquid flows up a central area into the intake of pump 381. The gas flows out gas discharge ports 385 into well 373. Gas separator 383 has intake ports 387 on its lower end. As part of the motor assembly, seal section 389 is employed between gas separator 383 and motor 391. Seal section 389 is conventional and equalizes hydrostatic pressure on the outside of motor 391 with the pressure inside. Seal section 389 also has a thrust bearing for absorbing axial thrust created by pump 381.

A pair of packers 393, 395 isolate the repressurizing zone perforations 377. Tubing 379 extends sealingly through packers 393, 395. A discharge pipe 397 also extends through the lower packer 393, for discharging gas into the perforations 377 between the packers 393, 395. A gas compressor 399 is connected to discharge pipe 397. Gas compressor 399 has a lower intake 401 which is spaced above liquid level 402 in well 373. Intake 401 is also spaced above gas separator outlet ports 385 so that the gas will flow upward and into intake ports 401. An electrical motor 403 having a seal section 405 is connected to the lower end of gas compressor 399 for driving it in the same manner as previously described.

In the operation of the embodiment of FIG. 3L, gas and liquid flow in from producing perforations 375. As indicated by the arrows 407, the mixture flows upward and into gas separator intake ports 387. Gas separator 383 separates a substantial portion of the gas from the liquid, with arrows 409 indicating the gas discharged from gas discharge ports 385. The liquid flows into pump 381, and from there it is pumped to the surface through tubing 379. Gas compressor 399 pressurizes the separated gas and forces it into the repressurizing zone perforations 377 to repressurize the gas cap area of the earth formation. Some free gas from production zone 375 will flow directly into gas compressor intake 401, bypassing gas separator 383.

The invention has significant advantages. The use of a downhole gas compressor allows the recovery of gas which lacks sufficient natural drive to flow to the surface. Employing a pump with the gas compressor allows optionally the recovery of the gas and the disposal of liquid in one instance. In another instance, it allows the recovery of liquid with the gas being used downhole for repressurizing. USE OF ELECTRICAL SUBMERSIBLE PUMPS FOR THE DELIVERY OF PARTICULATE MATTER: In accordance with the present invention, electrical submersible pumps may be utilized as local booster pumps for the delivery of particulate matter, such as cements utilized during completion operations, and fracturing fluids and completion fluids, emulsifiers, and the like which are also utilized during completion operations. FIGS. 3K and 3L pictorially represent the utilization of electrical submersible pumps in accordance with the present invention for the delivery of particulate matter to remote wellbore locations.

Figure 3M:
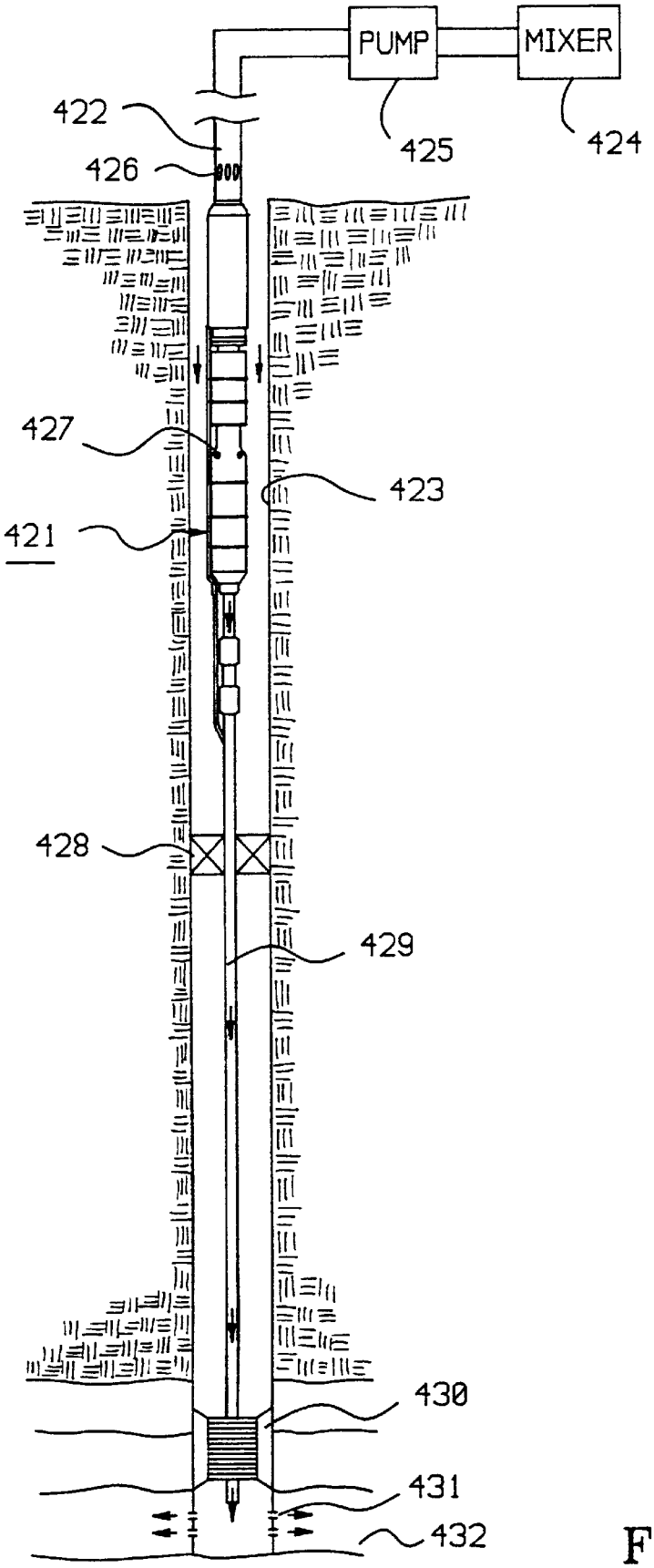
FIG. 3M is a simplified pictorial representation of the utilization of an electrical submersible pump during fracturing operations, in accordance with the present invention.

FIG. 3M depicts the utilization of electrical submersible pump 421 as a local booster pump for fracturing operations. As is shown, electrical submersible pump 421 is suspended on tubing string 422 within wellbore 423. A mixer 424 and surface pump 425 are connected to tubing string 422, and are utilized to mix and pump fracturing fluid down to the wellbore through tubing string 422. The fracturing fluid typically contains a large amount of particulate matter, such as sand, glass beads, or synthetic materials. During a fracturing operation, the mixture of fluid and the particulate matter (known as "proppant" material) are pumped at high pressures into the formation. The particulate matter wedges into and expands cracks in the formation. The formation may also be subjected to acidizing or other production enhancing chemical treatments during the fracturing operation. Emulsifiers and the like can be utilized to liberate hydrocarbons from formations and allow production. As is shown in FIG. 3M, the fracturing fluid exits through ports 426 in the tubing string, and accumulates in the annular region about electrical submersible pump 421. Packer 428 is provided to check the flow of fluid downward within the wellbore. The fluid accumulates in the annular regions surrounding electrical submersible pump 421, and is pulled into the pump at input ports 427. The fracturing fluid is pumped downward through the tubing string 429 through isolation packer 430. The fracturing fluid enters thorough perforations 431 into the formation 432 where the high pressures lodge the particulate matter into cracks, in order to expand the cracks and maintain them in an open condition.

This technique is superior to the prior art which merely utilizes surface pumping equipment to deliver the fracturing fluids including the proppants into the target formation. On offshore productions platforms, there is very little space available for equipment. Surface pumps are large and utilize a great deal of the surface area of the completion platform. The utilization of electrical submersible pump 421 within wellbore 423 to boost the fracturing fluid results in the ability to use fewer and smaller surface pumps in order to effectively fracture a formation. As is well known in the art, a great deal of power is required to overcome the friction losses in the delivery of fracturing fluids. With electrical submersible pump 421 located proximate the target formation for the fracturing operation, it may boost the pressure and effect better delivery of the fracturing fluids than can be accomplished in the prior art using merely surface pumping. Of course, the impellers and diffusers of the pumping equipment are hardened with conventional hard facing techniques (such as depicted and discussed in connection with FIG. 1K). After the fracturing operation is complete submersible pump 421 may be removed from the wellbore, and serviced in order to replace worn or damaged parts. Parts are likely to be damaged since the fracturing fluids contain an extremely high degree of particulate matter, and since they are pumped at such great forces. Even though the rehabilitation costs associated with refurbishing the electrical submersible pump 421 may be great, they are in all likelihood substantially less than the rental, transportation, and other costs associated with surface pumps. On balance, great cost savings can be obtained utilizing electrical submersible pumps in the delivery of particulate matter during fracturing operations.

Figure 3N:
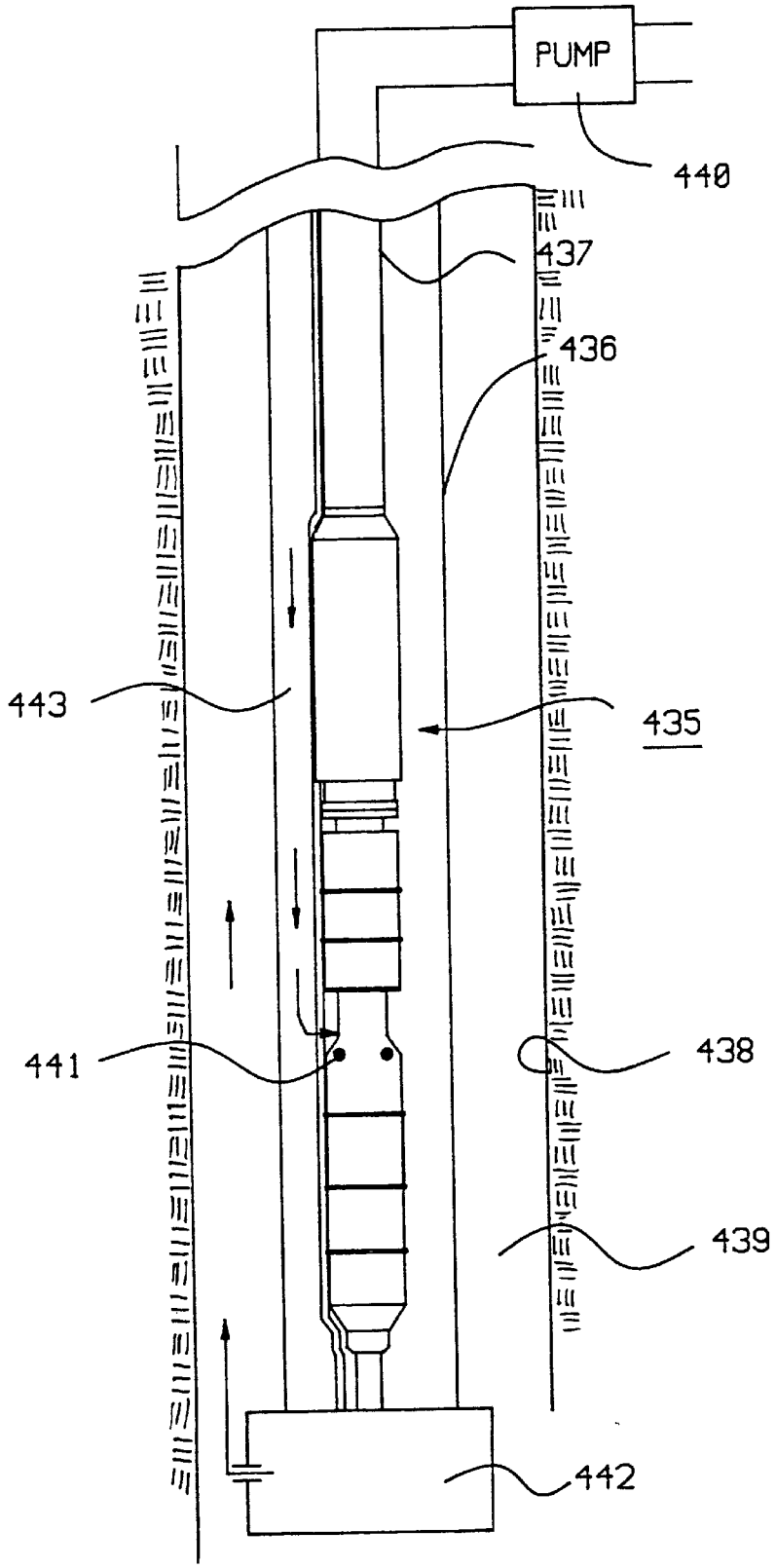
FIG. 3N is a simplified pictorial representation of the utilization of an electrical submersible pump during completion operations, and in particular during casing operations.
Figure 30:
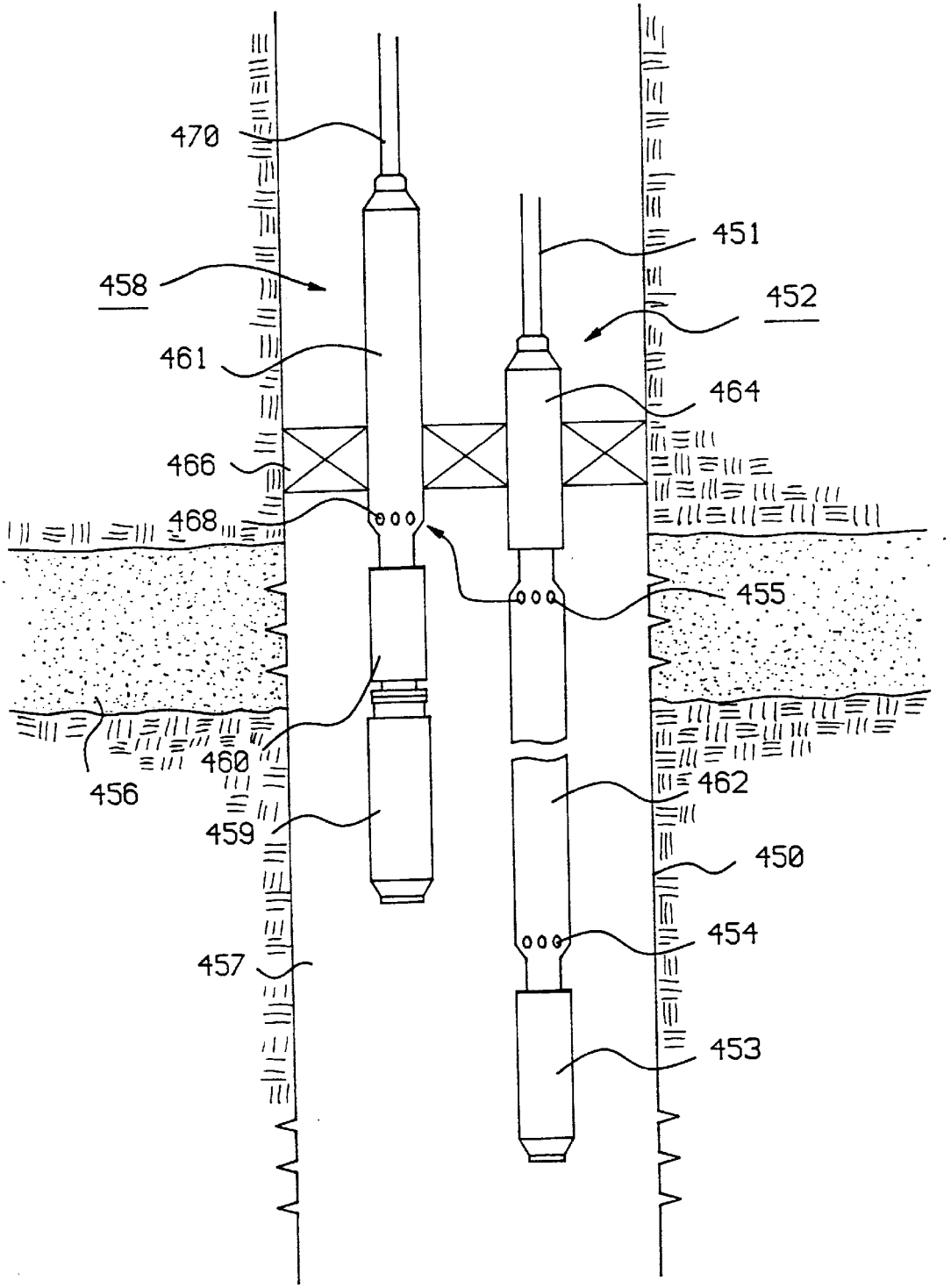

FIG. 3N depicts the utilization of an electrical submersible pump 435 in the delivery of cementitious material during completion operations. As is shown electrical submersible pump 435 is suspended on tubing string 437 within casing string 436. A space 439 exists between casing string 436 and the surround formation 438. The objective during completion operation is to fill the space 439 with cementitious material in order to secure casing string 436 in position relative to the formation. In the view of FIG. 3N, the space 439 between casing string 436 and formation 438 is shown in exaggerated form, and it will in fact be much smaller in relative diameter than that depicted. In accordance with the present invention, a surface pump 440 is utilized to deliver cementitious material into the annular region 443 between electrical submersible pump 435 and casing string 436. The flow of cementitious material in FIG. 3N is depicted by the arrows. The cementitious material is received by electrical submersible pump 435 at input ports 441, and pumped through until space 439 is filled. The cementitious material is pumped downward through crossover tool 442, and into the space 439 between casing string 436 and formation 438. In this manner, electrical submersible pump 435 may be utilized as a local driver or booster for the delivery of cementitious material during completion operations, and particularly during casing operations. Like the use of the present invention during fracturing operations, the cementitious material will excessively ware the components of electrical submersible pump 435; however, the costs associated with the refurbishing electrical submersible pump 435 is not great in comparison with the costs of transporting and operating surface pumping equipment. With the present invention, smaller and fewer surface pumps are required in order to deliver the cementitious material to a remote wellbore location. Since the electrical submersible pump 435 is located proximate to the intended delivery point, more effective delivery of the cementitious material may be obtained. USE OF ELECTRICAL SUBMERSIBLE PUMPS IN COMBINATION WITH LOCAL PROCESSORS AND CLUTCHES TO DYNAMICALLY ALTER COMPRESSION OPERATIONS: The present invention can also be utilized for gas compression in a wellbore in a manner which dynamically monitors and controls the compression operations. This process is shown with reference to FIG. 30. As is shown, electrical submersible pump 452 is suspended within a wellbore by tubing string 451 in close proximity to producing formation 456. Producing formation 456 produces both gas and wellbore fluids including water and oil. Electrical submersible pump 452 includes an electrical motor subassembly 453 and a gas separator subassembly 462. The gas separator subassembly 462 includes intake ports 454 and output ports 455. Electrical submersible pump 452 also includes a pump subassembly 464. Wellbore fluids 457 within wellbore 450 are drawn into separator subassembly 462 at input ports 454. There, as is conventional, the oil and water is separated from the free gas. The free gas is exhausted from separator subassembly 462 at output ports 455. The gas accumulates in the wellbore region above the wellbore fluid 457. The oil and water are lifted to the surface through use of pump section 464 through production tubing string 451. In accordance with the present invention, the free gas accumulates above the wellbore fluid 457, and is contained at its upper end by isolation devices 466, such as packers.

Figure 3P:
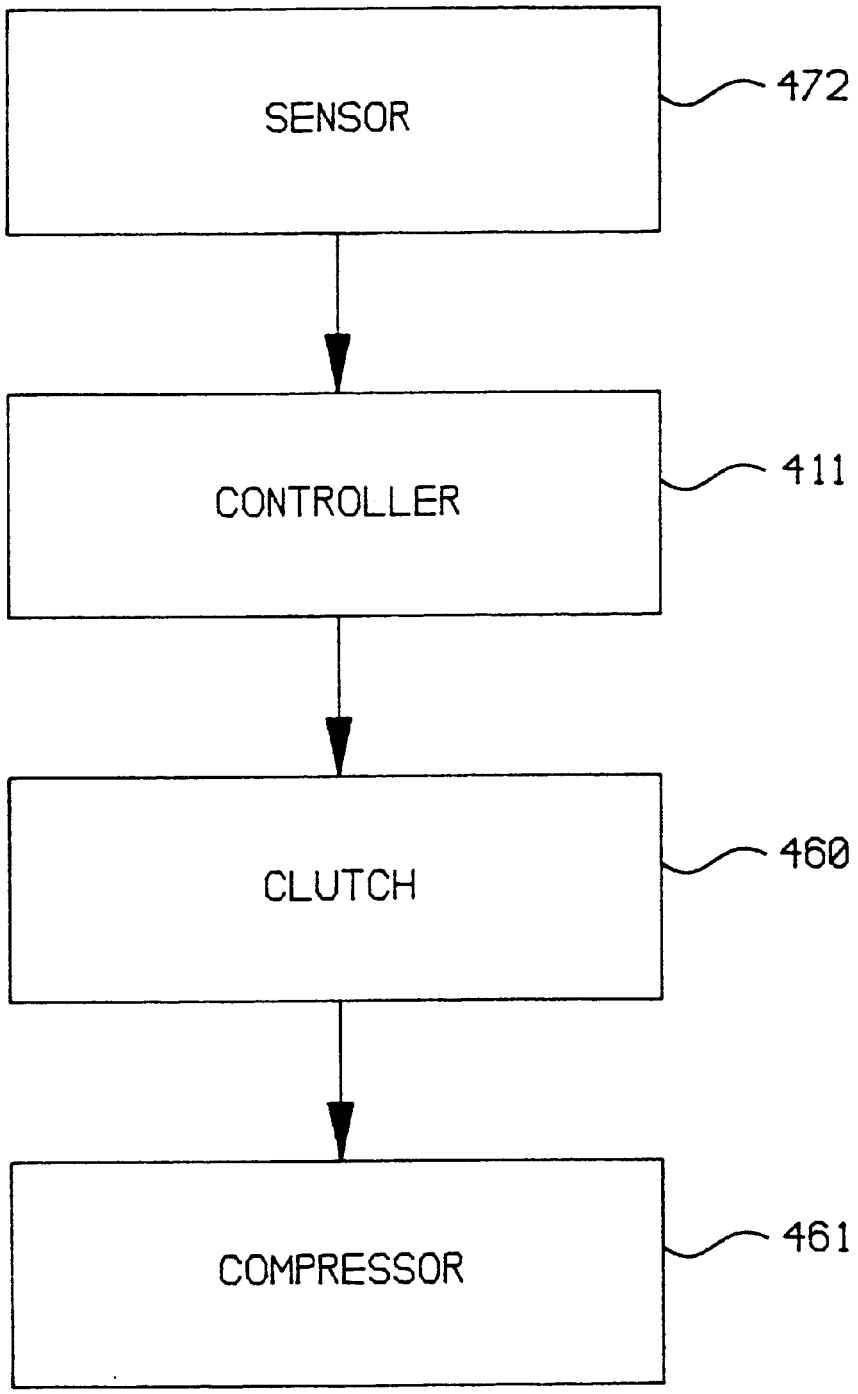
FIGS. 3P and 3Q depict in block diagram and flowchart form the data processing implemented operation of the clutch subassembly of a compression apparatus in order to vary the amount of compression.

Electrical submersible pump 458 is also contained within wellbore 450. It includes an electrical motor subassembly 459, a clutch subassembly 460, and a compressor subassembly 461. Preferably, the free gas trapped between wellbore fluid 457 and isolation devices 466 is drawn into intake ports 468 of compressor subassembly 461, where the gas is compressed and pushed up to the surface through production tubing string 470. Preferably, electrical submersible pump 458 includes sensors which detect the pressure of the free gas within the wellbore 450. The sensor input is monitored by controller 411 (not depicted in this view). The controller 411 determines whether or not compressor subassembly 461 should be operating, and if so, at what speed it should be operating. This relationship is shown in block diagram form in FIG. 3P, wherein sensor 472 (such as a pressure sensor) provides data to controller 411. Controller 411 actuates clutch 460 to vary the speed of compressor 461. The gas may be directed through production tubing 470 of FIG. 3O either directly to the surface, or it may be injected into another subterranean formation.

Figure 3Q:
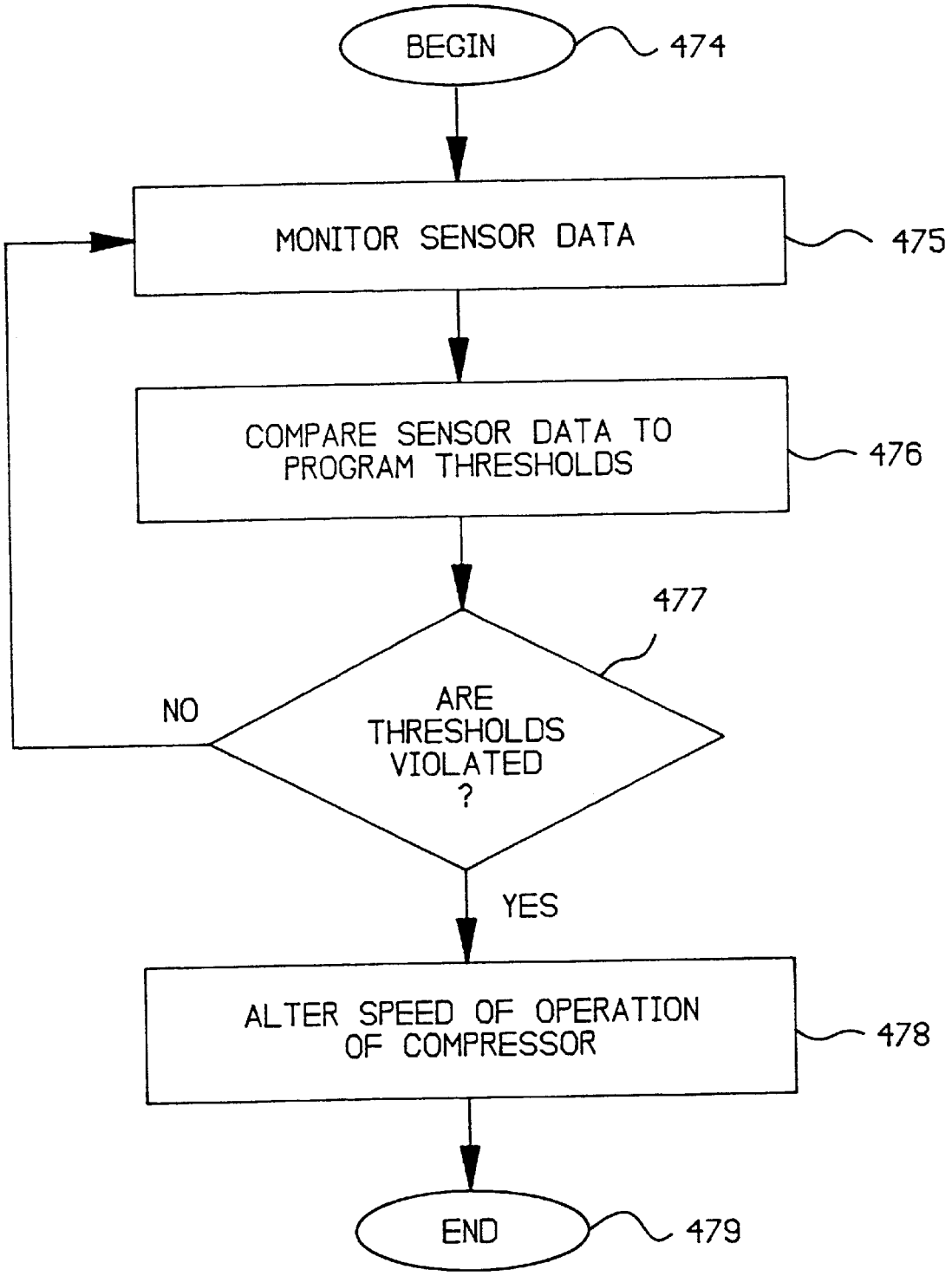
Figure 3R:
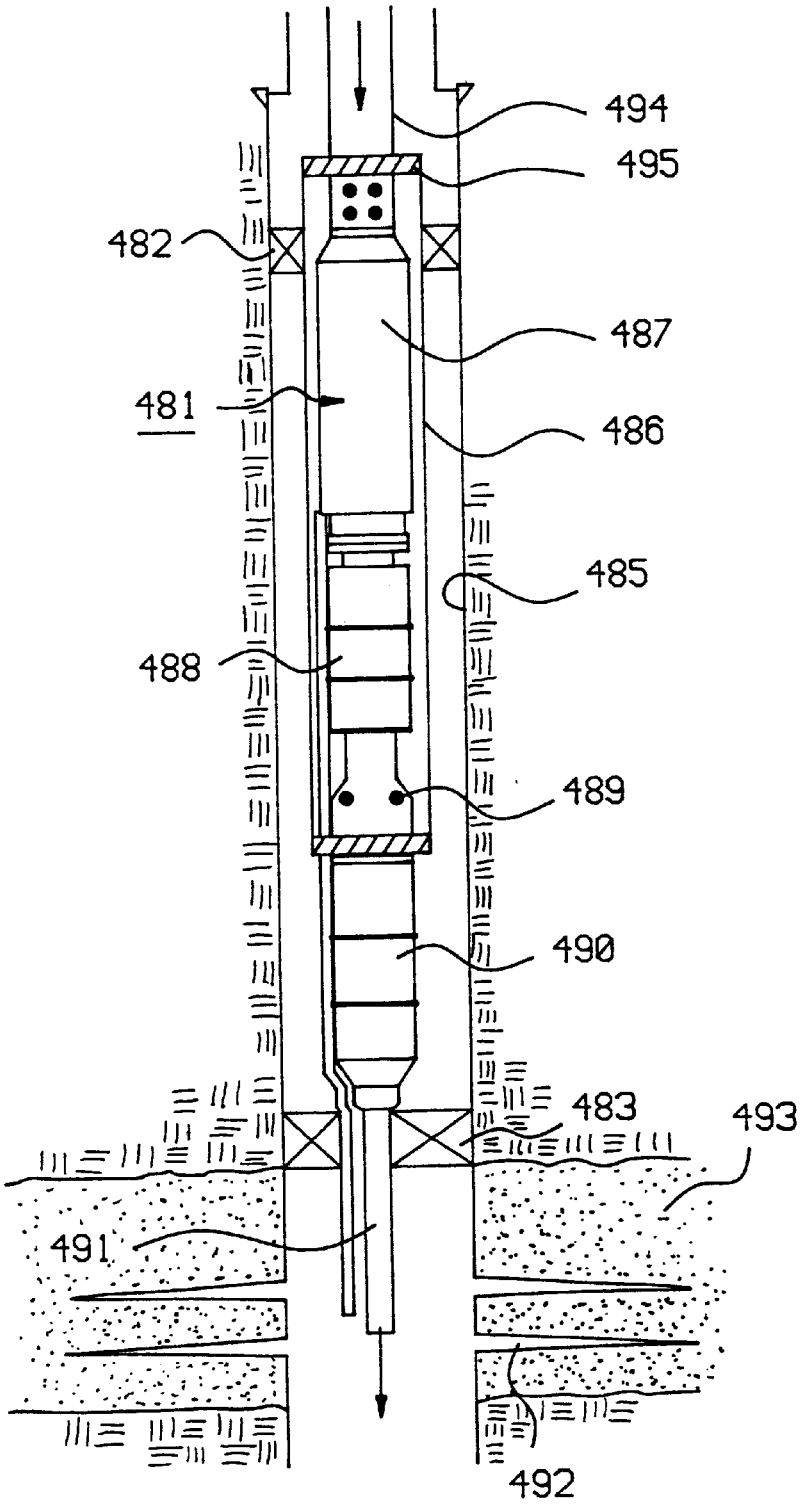
FIG. 3R is a simplified depiction of utilization of an electrical submersible pump for toxic and corrosive waste disposal operations.

FIG. 3Q is a flowchart representation of the data processing implemented steps of monitoring sensor data and varying the operation of the gas compressor in accordance with program instructions. The process begins at software block 474, and continues to software block 475, wherein controller 411 receives sensor data. Then, in accordance with software block 476, controller 411 compares the sensor data to program threshold. For example, if the sensor in question is a pressure sensor, one or more pressure thresholds may be established which map to particular compressor speeds. If the gas contained within the wellbore is under relatively low pressure, a greater amount of compression may be desired, and the clutch and compressor assembly may be electrically altered in order to provide for greater compression; however, if the gas within the wellbore is relatively high pressure, the clutch and compressor assembly may be operated at a relatively low speed in order to maintain a program prescribed "setpoint" of operation. In accordance with software block 477, controller 411 examines the thresholds to determine whether a violation exists; if no violation exists, monitoring operations continue in accordance with software block 475; however, if the one or more thresholds have been violated, the process continues at software block 478, wherein controller 411 alters the speed of operation of the compressor, primarily by acting through the clutch subassembly. The process ends at software block 479. USE OF ELECTRICAL SUBMERSIBLE PUMPS FOR WASTE DISPOSAL: The electrical submersible pump of the present invention may be utilized for the disposal of toxic or corrosive waste by injection of such materials into a remotely located formation. This process is depicted in simplified form in FIG. 3R. As is shown, electrical submersible pump 481 is located in position within wellbore 485 by packers 482, 483. Electrical submersible pump 481 includes shroud 486 which covers the motor subassembly 487, seal subassembly 488, and the intake 489 of centrifugal pump subassembly 490. The output of centrifugal pump subassembly 490 is exhausted through tubing 491 which extends through packer 483, and is communication through perforations 492 with disposal formation 493. In operation, a tubing string, such as fiberglass tubing string 494 is releasably connected through stinger subassembly 495 with shroud 486. Toxic or corrosive waste is delivered into shroud 486, where it is drawn through input ports 489 and pumped by centrifugal pump subassembly into the waste receiving formation 493.

4. COMPLEX CONTROL DURING COMPLETION AND PRODUCTION OPERATIONS IN ACCORDANCE WITH THE PRESENT INVENTION

The control of oil and gas production wells constitutes and on-going concern of the petroleum industry due, in part, to the enormous monetary expense involved as well as the risks associated with environmental and safety issues.

Production well control has become particularly important and more complex in view of the industry wide recognition that wells having multiple branches (i.e. ,multilateral wells) will be increasingly important and commonplace. Such multilateral wells include discrete production zones which produce fluid in either common or discrete production tubing. In either case, there is a need for controlling zone production, isolating specific zones and otherwise monitoring each zone in a particular well.

The first embodiment of the present invention generally comprises downhole sensors, downhole electromechanical devices, including the improved electrical submersible pump, and downhole computerized control electronics whereby the control electronics automatically control the electromechanical devices based on input from the downhole sensors. Thus, using the downhole sensors, the downhole computerized control system will monitor actual downhole parameters (such as pressure, temperature, flow, gas influx, or any other tool or wellbore parameter discussed above) and automatically execute control instructions when the monitored downhole parameters are outside a selected operating range (e.g., indicating an unsafe or undesirable condition). The automatic control instructions will then cause the improved electrical submersible pump of the present invention to actuate a suitable tool.

The downhole control system of this invention also includes transceivers for two-way communication with the surface as well as a telemetry device of communicating from the surface of the production well to a remote location.

The downhole control system is preferably located in each zone of a well such that a plurality of wells associated with one or more platforms will have a plurality of downhole control systems, one for each zone in each well. The downhole control systems have the ability to communicate with other downhole control systems in other zones in the same or different wells. In addition, as discussed in more detail with regard to the second embodiment of this invention, each downhole control system in a zone may also communicate with a surface control system. The downhole control system of this invention thus is extremely well suited of use in connection with multilateral wells which include multiple zones.

The selected operating range for each tool controlled by the downhole control system of this invention is programmed in a downhole memory either before or after the control system is lowered downhole. The aforementioned transceiver may be used to change the operating range or alter the programming of the control system from the surface of the well or from a remote location.

In contrast to prior art well control systems which consist either of computer systems located wholly at the surface or downhole computer systems which require an external (e.g., surface) initiation signal (as well as a surface control system), the downhole well production control system of this invention automatically operates based on downhole conditions sensed in real time without the need for a surface or other external signal(s). This important feature constitutes a significant advance in the field of production well control. For example, use of the downhole control system of this invention obviates the need for a surface platform (although such surface platforms may still be desirable in certain applications such as when a remote monitoring and control facility is desired as discussed below in connection with the second embodiment of this invention). The downhole control system of this invention is also inherently more reliable since no surface to downhole actuation signal is required and the associated risk that such an actuation signal will be compromised is therefore rendered moot. With regard to multilateral (i.e., multi-zone) wells, still another advantage of this invention is that, because the entire production well and its multiple zones are not controlled by a single surface controller, then the risk that an entire well including all of its discrete production zones will be shut-in simultaneously is greatly reduced.

In accordance with a second embodiment of the present invention, a system adapted for controlling and/or monitoring a plurality of production wells from a remote location is provided. This system is capable of controlling and/or monitoring:

(1) a plurality of zones in a single production well;

(2) a plurality of zones/wells in a single location (e.g.,a single platform); or (3) a plurality of zones/wells located at a plurality of locations (e.g., multiple platforms).

The multizone and/or multiwell control system of this invention is composed of multiple downhole electronically controlled electromechanical devices (sometimes referred to as downhole modules), and multiple computer based surface systems operated from multiple locations. Important functions for these systems include the ability to predict the future flow profile of multiple wells and to monitor and control the fluid or gas flow from either the formation into the wellbore, or from the wellbore to the surface. The control system of the second embodiment of this invention is also capable of receiving and transmitting data from multiple remote locations such as inside the borehole, to or from other platforms, or from a location away from any well site.

The downhole control devices interface to the surface system using either a wireless communication system or through an electrical hard wired connection or through a fiberoptic system. The downhole control systems in the wellbore can transmit and receive data and/or commands to/from the surface system. The data transmission from inside the wellbore can be done by allowing the surface system to poll each individual device in the hole, although individual devices will be allowed to take control of the communications during an emergency. The devices downhole may be programmed while in the wellbore by sending the proper command and data to adjust the parameters being monitored due to changes in borehole and flow conditions and/or to change its primary function in the wellbore.

The surface system may control the activities of the downhole modules by requesting data on a periodic basis, and commanding the modules to open or close the electromechanical control devices, and/or change monitoring parameters due to changes in long term borehole conditions. The surface system at one location will be capable of interfacing with a system in another location via phone lines, satellite communication or the communicating means. Preferably, a remote central control system controls and/or monitors all of the zones, wells and/or platforms form a single remote location.

In accordance with a third embodiment of the present invention, the downhole control systems may associated with permanent downhole formation evaluation sensors which remain downhole throughout production operations. These formation evaluation sensors for formations measurements may include, for example, gamma ray detection for formation evaluation, neutron porosity, resistivity, acoustic sensors and pulse neutron which can, in real time, sense and evaluate formation parameters including important information regarding water migrating from different zones. Significantly, this information can be obtained prior to the water actually entering the producing tubing and therefore corrective action (i.e., closing of a valve or sliding sleeve) or formation treatment can be taken prior to water being produced. This real time acquisition of formation data in the production well constitutes an important advance over current wireline techniques in that the present invention is far less costly and can anticipate and react to potential problems before they occur. In addition, the formation evaluation sensors themselves can be placed much closer to the actual formation (i.e.,adjacent the casing or downhole completion tool) than wireline devices which are restricted to the interior of the production tubing.

This invention relates to a system for controlling production wells from a remote location. In particular, in an embodiment of the present invention, a control and monitoring system is described for controlling and/or monitoring at least two zones in a single well from a remote location. The present invention also includes the remote control and/or monitoring of multiple wells at a single platform (or other location) and/or multiple wells located at multiple platforms or locations. Thus, the control system of the present invention has the ability or control individual zones in multiple wells on multiple platforms, all from a remote location. The control and/or monitoring system of this invention is comprised of a plurality of surface control systems or modules located at each well head and one or more down hole control systems or modules positioned within zones located in each well. These subsystems allow monitoring and control from a single remote location of activities in a different zones in a number of wells in near real time.

As will be discussed in some detail hereinafter in connection with the figures, in accordance with a referred embodiment of the present invention, the downhole control system is composed of downhole sensors, downhole control electronics and downhole electromechanical modules that can be placed in different locations (e.g.,zones) in a well, with each downhole control system having a unique electronics address. A number of wells can be outfitted with these downhole control devices. The surface control and monitoring system interfaces with all of the wells where the downhole control devices are located to poll each device for data related to the status of the downhole sensors attached to the module being polled. In general, the surface system allows the operator to control the position, status, and/or fluid flow in each zone of the well by sending a command to the device being controlled in the wellbore.

As will be discussed hereinafter, the downhole control modules for use in the multizone or multiwell control system of this invention may either be controlled using an external or surface command as is known in the art or the downhole control system may be actuated automatically in accordance with a novel control system which controls the activities in the wellbore by monitoring the well sensors connected to the data acquisition electronics. In the latter case, a downhole computer (e.g., microprocessor) will command a downhole tool such as a packer, sliding sleeve or valve to open, close, change state or do whatever other action is required if certain sensed parameters are outside the normal or preselected well zone operating range. This operating range may be programmed into the system either prior to being placed in the borehole or such programming may be effected by a command from the surface after the downhole control module has been positioned downhole in the wellbore.

Figure 4A:
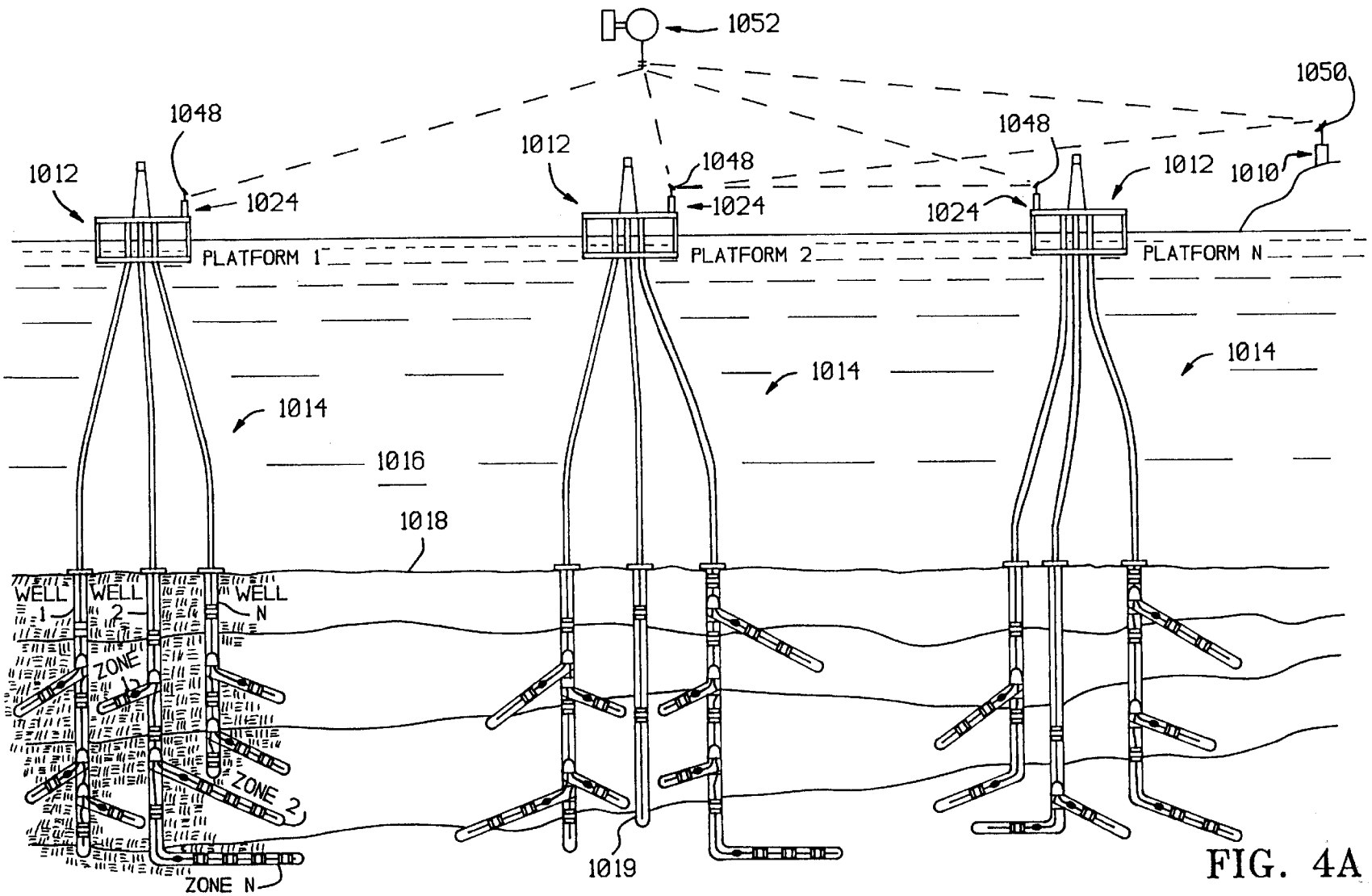
FIG. 4A is a diagrammatic view depicting the multiwell/multizone control system of the present invention for use in controlling a plurality of offshore well platforms.

Referring now to FIG. 4A, the multiwell/multizone monitoring and control system of the present invention may include a remote central control center 1010 which communicates either wirelessly or via telephone wires to a plurality of well platforms 1012. It will be appreciated that any number of well platforms may be encompassed by the control system of the present invention with three platforms namely, platform 1, platform 2, and platform N being shown in FIG. 4A. Each well platform has associated therewith a plurality of wells 1014 which extend from each platform 1012 through water 1016 to the surface of the ocean floor 1018 and then downwardly into formation under the ocean floor. It will be appreciated that while offshore platforms 1012 have been shown in FIG. 4A, the group of wells 1014 associated with each platform are analogous to groups of wells positioned together in an area of land; and the present invention therefore is also well suited for control of land based wells.

As mentioned, each platform 1012 is associated with a plurality of wells 1014. For purposes of illustration, three wells are depicted as being associated with platform number 1 with each well being identified as well number 1, well number 2 and well number N. As is known, a given well may be divided into a plurality of separate zones which are required to isolate specific areas of a well for purposes of producing selected fluid, preventing blowouts and preventing water intake. Such zones may be positioned in a single vertical well such as well 1019 associated with platform 2 shown in FIG. 4A or such zones can result when multiple wells are linked or otherwise joined together.

As discussed, the multiwell/multizone control system of the present invention is comprised of multiple downhole electronically controlled electromechanical devices, including the improved electrical submersible pump, and multiple computer based surface systems operated from multiple locations. An important function of these systems is to predict the future flow profile of multiple wells and monitor and control the fluid or gas flow from the formation into the wellbore and from the wellbore into the surface. The system is also capable of receiving and transmitting data from multiple locations such as inside the borehole, and to or from other platforms 1, 2 or N or from a location away from any well site such as central control center 1010.

Figure 4B:
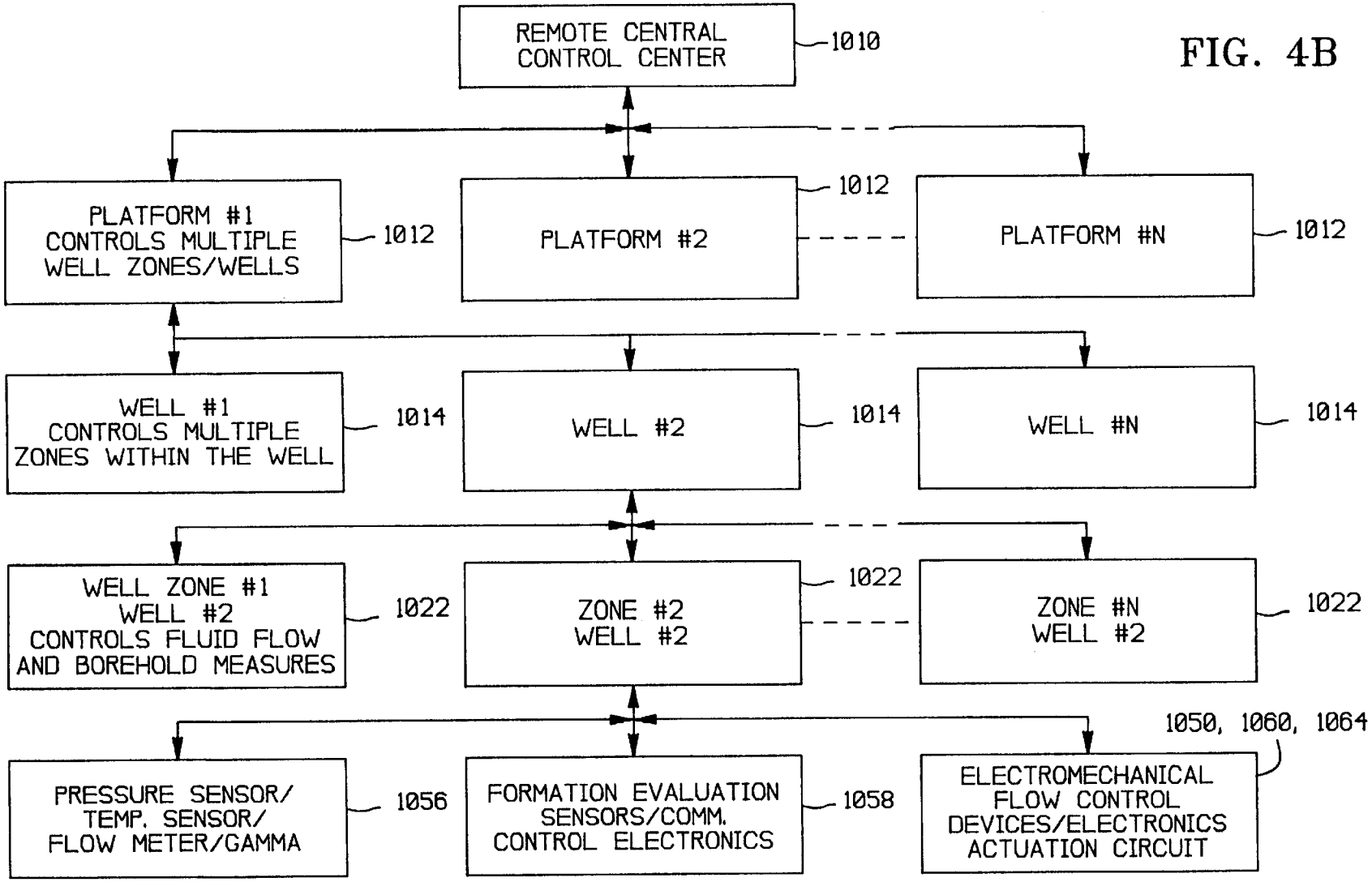
FIG. 4B is a block diagram depicting the multiwell/multizone control system in accordance with the present invention.
Figure 4C:
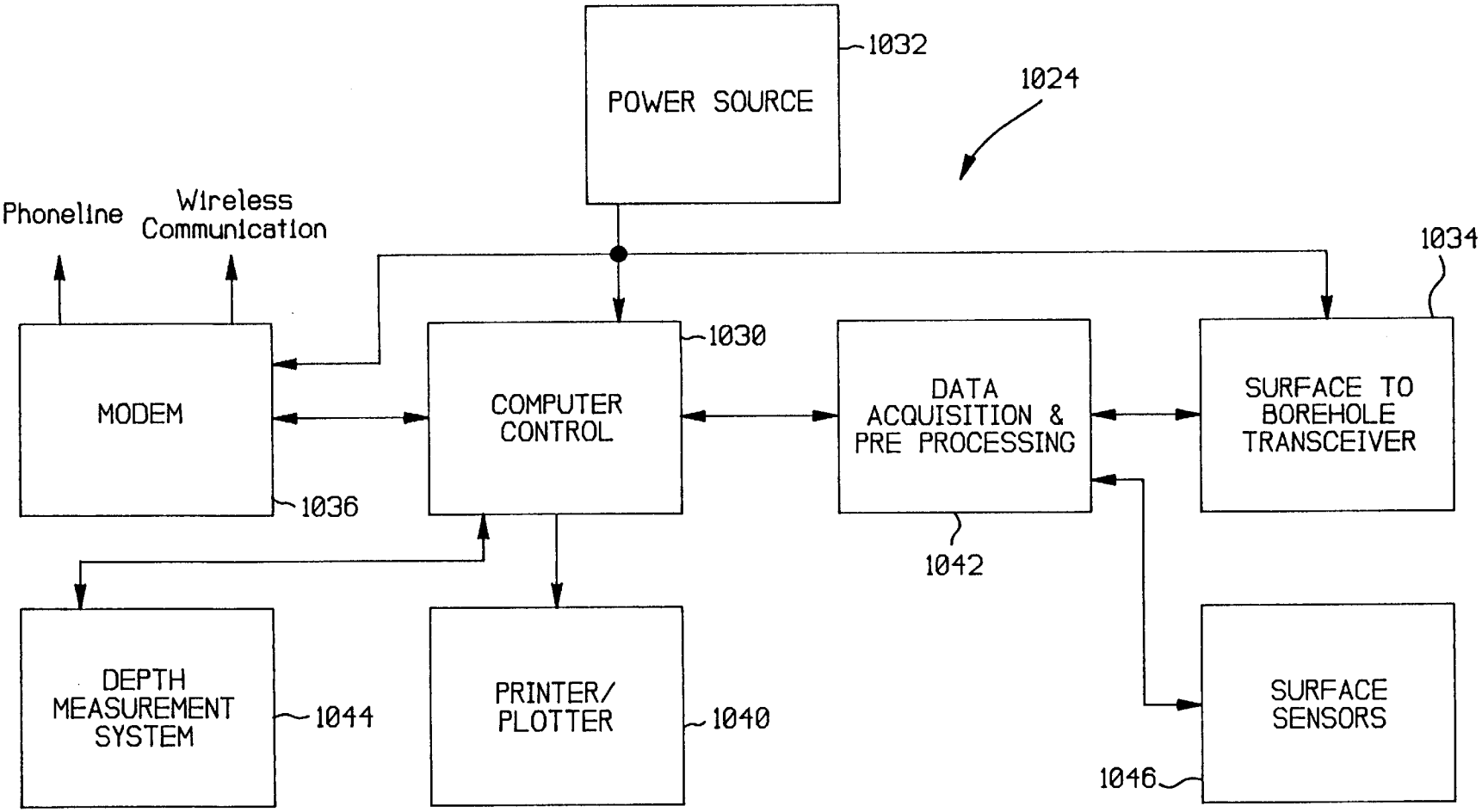
FIG. 4C is a block diagram depicting a surface control system for use with the multiwell/multizone control system of the present invention.

The downhole control systems 1022 (FIG. 4B) will interface to the surface system 1024 using a wireless communication system or through an electrical wire (i.e., hardwired) connection. The downhole systems in the wellbore can transmit and receive data and/or commands to or from the surface and/or to or from other devices in the borehole. Referring now to FIG. 4C, the surface system 1024 is composed of a computer system 1030 used for processing, storing and displaying the information acquired downhole and interfacing with the operator. Computer system 1030 may be comprised of a personal computer or a work station with a processor board, short term and long term storage media, video and sound capabilities as is well known. Computer control 1030 is powered by power source 1032 for providing energy necessary to operate the surface system 1024 as well as any downhole control system 1022 if the interface is accomplished using a wire or cable. Power will be regulated and converted to the appropriate values required to operate any surface sensors (as well as a downhole system if a wire connection between surface and downhole is available).

A surface to borehole transceiver 1034 is used for sending data downhole and for receiving the information transmitted from inside the wellbore to the surface. The transceiver converts the pulses received from downhole into signals compatible with the surface computer system and converts signals from the computer 1030 to an appropriate communications means for communicating downhole to downhole control system 1022. Communications downhole may be effected by a variety of known methods including hardwiring (as discussed above) and wireless communications techniques. One alternative technique transmits acoustic signals down a tubing string such as production tubing string 1038 or coiled tubing. Acoustical communication may include variations of signal frequencies, specific frequencies, or codes or acoustical signals or combinations of these. The acoustical transmission media may include the tubing string as illustrated in U.S. Pat. Nos. 4,375,239; 4,347,900 or 4,378,850, all of which are incorporated herein by reference. Alternatively, the acoustical transmission may be transmitted through the casing stream, electrical line, slick line, subterranean soil around the well, tubing fluid or arnulus fluid. A preferred acoustic transmitter is described in U.S. Pat. No. 5,222,049, all of the contents of which is incorporated herein by reference thereto, which discloses a ceramic piezoelectric based transceiver. The piezoelectric wafers that compose the transducer are stacked and compressed for proper coupling to the medium used to carry the data information to the sensors in the borehole. This transducer will generate a mechanical force when alternating current voltage is applied to the two power inputs of the transducer. the signal generated by stressing the piezoelectric wafers will travel along the axis of the borehole to the receivers located in the tool assembly where the signa is detected and processed. The transmission medium where the acoustic signals will travel in the borehole can be production tubing or coil tubing.

Communications can also be effected by sensed downhole pressure conditions which may be natural conditions or which may be a coded pressure pulse or the like introduced into the well at the surface by the operator of the well. Suitable systems describing in more detail the nature of such coded pressure pulses are described in U.S. Pat. Nos. 4,712,613 to Nieuwstad, 4,468,665 to Thawley, 3,233,674 to Leutwyler and 4,078,620 to Westlake; 5,226,494 to Rubbo et al and 5,343,963 to Bouldin et al.

Also, other suitable communications techniques include radio transmission from the surface location or from a subsurface location, with corresponding radio feedback from the downhole tools to the surface location or subsurface location; the use of microwave transmission and reception; the use of fiber optic communications through a fiber optic cable suspended from the surface to the downhole control package; the use of electrical signaling from a wire line suspended transmitter to the downhole control package with subsequent feedback from the control package to the wire line suspended transmitter/receiver. Communication may also consist of frequencies, amplitudes, codes or variations or combinations of these parameters or a transformer coupled technique which involves wire line conveyance of a partial transformer to a downhole tool. Either the primary or secondary of the transformer is conveyed on a wire line with the other half of the transformer residing within the downhole tool. When the two portions of the transformer are mated, data can be interchanged.

Referring again to FIG. 4C, the surface system 1024 further includes a printerlplotter 1040 which is used to create a paper record of the events occurring in the well. The hard copy generated by computer 1030 can be used to compare the status of different wells, compare previous events to events occurring in existing wells and to get formation evaluation logs. Also communicating with computer control 1030 is a data acquisition system 1042 which is used for interfacing the well transceiver 1034 to the computer 1030 for processing.

Still referring to FIG. 4C, the electrical pulses from the transceiver 1034 will be conditioned to fit within a range where the data can be digitized for processing by computer control 1030. Communicating with both computer control 1030 and transceiver 1034 is a previously mentioned modem 1036. Modem 1036 is available to surface system 1024 for transmission of the data from the well site to a remote location such as central control center 1010 or a different surface system 1024 located on, for example, platform 2 or platform N. This remote location, the data can be viewed and evaluated, or again, simply be communicated to other computers controlling other platforms. The central control center 1010 can take control over system 1024 interfacing with the downhole control systems 1022 and acquired data from the wellbore and/or control the status of the downhole devices and/or control the fluid flow from the well or from the formation. Also associated with the surface system 1024 is a depth measurement system 1044 which interfaces with computer control system 1030 for providing information related to the location of the tools in the borehole as the tool string is lowered into the ground. Finally, surface system 1024 also includes one or more surface sensors 1046 which are installed at the surface for monitoring well parameters such as pressure, connected to the surface system to provide the operator with additional information on the status of the well.

Surface system 1024 can control the activities of the downhole control systems 1022 by requesting data on a periodic basis and commanding the downhole modules to open, or close electromechanical devices and to change monitoring parameters due to changes in long term borehole conditions. As shown diagrammatically in FIG. 4A, surface system 1024, at one location such as platform 1, can interface with a surface system 1024 at a different location such as platforms 2 or N or the central control center 1010 via phone lines or via wireless transmission. For example, in FIG. 4A, each surface system 1024 is associated with an antenna 1048 for direct communication with each other (i.e., from platform 2 to platform N), for direct communication with an antenna 1050 located at central control system 1010 (i.e.,from platform 2 to control system 1010 ) or for indirect communication via a satellite 1052. Thus, each surface system 1024 includes the following functions:

1. Polls the downhole sensors for data information;
2. Processes the acquired information from the wellbore to provide the operator with formation, tools and flow status;
3. Interfaces with other surface systems for transfer of data and commands; and
4. Provides the interface between the operator and the downhole tools and sensors.

Thus, in accordance with an embodiment of this invention, the aforementioned remote central control center 1010, surface systems 1024 and downhole control systems 1022 all cooperate to provide one or more of the following functions:

1. Provide one or two-way communication between the surface system 1024 and a downhole tool via downhole control system 1022;
2. Acquire, process, display and/ore store at the surface data transmitted from downhole relating to the wellbore fluids, gases and tool status parameters acquired by sensors in the wellbore;
3. Provide an operator with the ability to control tools downhole by sending a specific address and command information from the central control center 1010 or from an individual surface system 1024 down into the wellbore;
4. Control multiple tools in multiple zones within any single well by a single remote surface system 1024 or the remote central control center 1010;
5. Monitor and/or control multiple wells with a central control center 1010 or surface system 1024;
6. Monitor multiple platforms from a single or multiple surface system working together through a remote communications link or working individually;
7. Acquire, process and transmit to the surface from inside the wellbore multiple parameters related to the well status, fluid condition and flow, tool state and geological evaluation;
8. Monitor the well gas and fluid parameters and perform functions automatically such as interrupting the fluid flow to the surface, opening or closing of valves when certain acquired downhole parameters such as pressure, flow, temperature or fluid content are determined to be outside the normal ranges stored in the systems' memory (as described below with respect to FIGS. 4D and 4E);
9. Provide operator to system and system to operator interface at the surface using a computer control surface control system; and
10. Provide data and control information among systems in the wellbore.

Figure 4D:
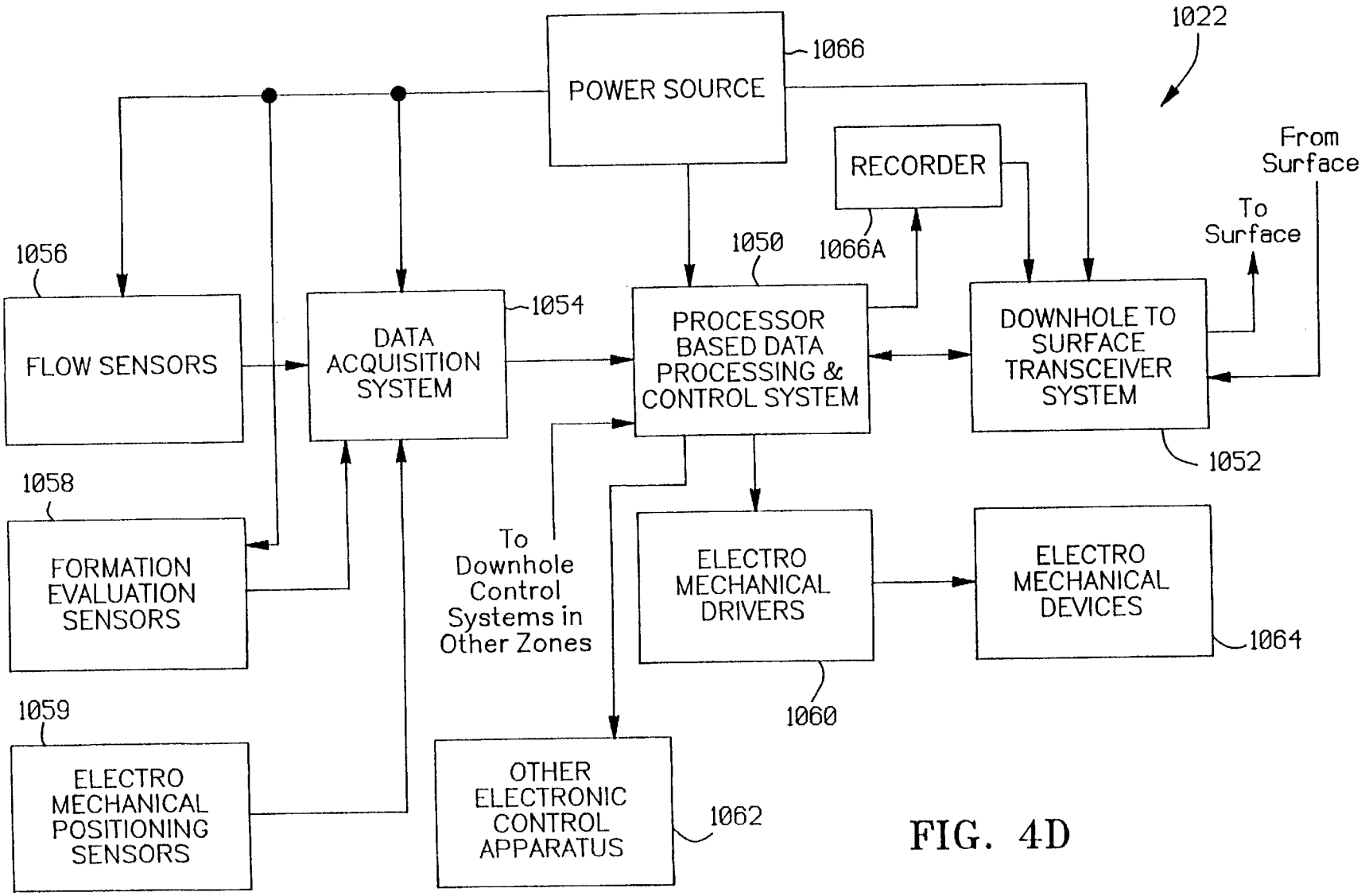
FIG. 4D is a block diagram depicting a downhole production well control system in accordance with the present invention.

In a preferred embodiment and in accordance with an important feature of the present invention, rather than using a downhole control system of the type described in the aforementioned patents wherein the downhole activities are only actuated by surface commands, the present invention utilizes a downhole control system which automatically controls downhole tools in response to sensed selected downhole parameters without the need for an initial control signal from the surface or from some other external source. As depicted in FIG. 4D, this downhole computer based control system includes a microprocessor based data processing and control system 1050. Electronics control system 1050 acquires and processes data sent from the surface as received from transceiver system 1052 and also transmits downhole sensor information as received from the data acquisition system 1054 to the surface. Data acquisition system 1054 will preprocess the analog and digital sensor data by sampling the data periodically and formatting it for transfer to processor 1050. Included among this data is data from flow sensors 1056, formation evaluation sensors 1058 and electromechanical position sensor 1059 (these latter sensors 1059 provide information on position, orientation and the like of downhole tools). The formation evaluation data is processed for the determination of reservoir parameters related to the well production zone being monitored by the downhole control module. The flow sensor data is processed and evaluated against parameters stored in the downhole module's memory to determine if a condition exists which requires the intervention of the processor electronics 1050 to automatically control the electromechanical devices. It will be appreciated that in accordance with an important feature of this invention, the automatic control executed by processor 1050 is initiated without the need for a initiation or control signal from the surface or from some other external source. Instead, the processor 1050 simply evaluates parameters existing in real time in the borehole as sensed by flow sensors 1056 and/or formation evaluations sensors 1058 and then automatically executes instructions for appropriate control. Note that while such automatic initiation is an important feature of this invention, in certain situations an operator from the surface may also send control instructions downwardly from the surface to the transceiver system 1052 and into the processor 1050 for executing control of downhole tools and other electronic equipment. As a result of this control, the control system 1050 may initiate or stop the fluid/gas flow from the geological formation into the borehole or from the borehole to the surface.

The downhole sensors associated with flow sensors 1056 and formation evaluations sensors 1058 may include, but are not limited to, sensors for sensing pressure, flow, temperature, oil/water content, geological formation, gamma ray detectors and formation evaluation sensors which utilize acoustic, nuclear, resistivity and electromagnetic technology. It will be appreciated that typically, the pressure, flow, temperature and fluid/gas content sensors will be used for monitoring the production of hydrocarbons while the formation evaluation sensors will measure, among other things, the movement of hydrocarbons and water in the formation. The downhole computer (processor 1050 ) may automatically execute instructions for actuating electromechanical drivers 1060 or other electronic control apparatus 1062. In turn, the electromechanical driver 1060 will actuate an electromechanical device for controlling a downhole tool such as a sliding sleeve, shut off device, valve, variable choke, penetrator, perf valve or gas lift tool. As mentioned, downhole computer 1050 may also control other electronic control apparatus such as apparatus that may effect flow characteristics of the fluids in the well.

In addition, downhole computer 1050 is capable of recording downhole data acquired by flow sensors 1056, formation evaluation sensors 1058 and electromechanical position sensors 1059. This downhole data is recorded in recorder 1066 A. Information stored in recorder 1066 A may either be retrieved from the surface at some later date when the control system is brought to the surface or detain the recorder may be sent to the transceiver system 1052 and then communicated to the surface.

The borehole transmitter/receiver 1052 transfers data from downhole to the surface and receives commands and data from the surface and between other downhole modules. Transceiver assembly 1052 may consist of any known and suitable transceiver mechanism and preferably includes a device that can be used to transmit as well s to receive the data in half duplex communication mode, such as an acoustic piezoelectric device (i.e.,disclosed in aforementioned patent 5,222,049),or individual receivers such as accelerometers for full duplex communications where data can be transmitted and received by the downhole tools simultaneously. Electronics drivers may be used to control the electric power delivered to the transceiver during data transmission.

It will be appreciated that the downhole control system 1022 requires a power source 1066 for operation of the system. Power source 1066 can be generated in the borehole, at the surface or it can be supplied by energy storage devices such as batteries. Power is used to provide electrical voltage and current to the electronics and electromechanical devices connected to a particular sensor in the borehole. Power for the power source may come from the surface through hardwiring or may be provided in the borehole such as by using a turbine. Other power sources include chemical reactions, flow control, thermal, conventional batteries, borehole electrical potential differential, solids production or hydraulic power methods.

Figure 4E:
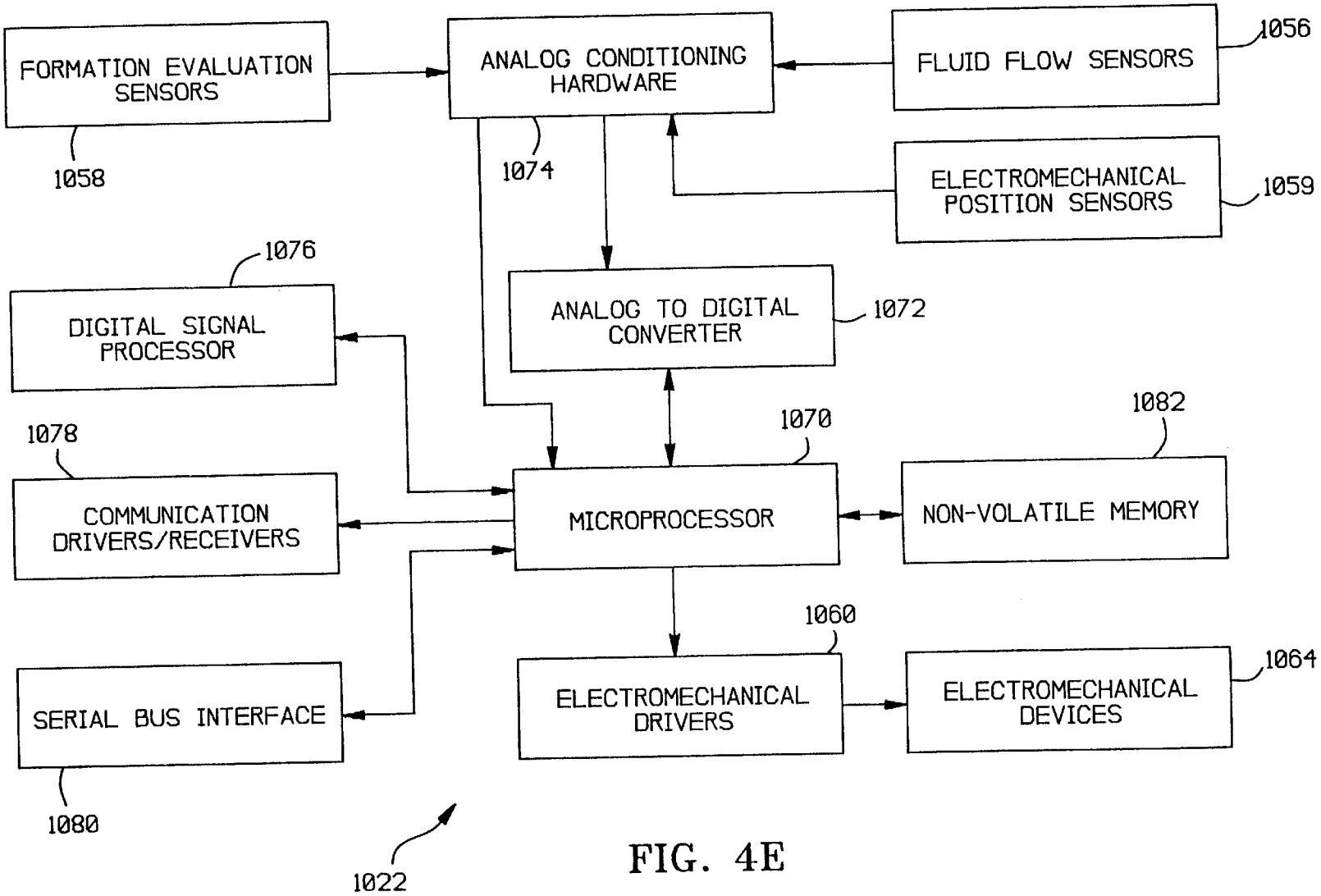
FIG. 4E is an electrical schematic of the downhole production well control system of FIG. 4D.

Referring to FIG. 4E, an electrical schematic of downhole controller 1022 is shown. As discussed in detail above, the downhole electronics system will control the electromechanical systems, monitor formation and flow parameters, process data acquired in the borehole, and transmit and receive commands and data to and from other modules and the surface systems. The electronics controller is composed of a microprocessor 1070, analog to digital converter 1072, analog conditioning hardware 1074, digital signal processor 1076, communications interface 1078, serial bus interface 1080, non-volatile solid state memory 1082 and electromechanical drivers 1060.

The microprocessor 1070 provides the control and processing capabilities of the system. The processor will control the data acquisition, the data processing, and the evaluation of the data for determination if it is within the proper operating ranges. The controller will also prepare the data for transmission to the surface, and drive the transmitter to send the information to the surface. The processor also has the responsibility of controlling the electromechanical devices 1064.

The analog to digital converter 1072 transforms the data from the conditioner circuitry into a binary number. That binary number relates to an electrical current or voltage value used to designate a physical parameter acquired from the geological formation, the fluid flow, or status of the electromechanical devices. The analog conditioning hardware processes the signals from the sensors into voltage values that are at the range required by the analog to digital converter.

The digital signal processor 1076 provides the capability of exchanging data with the microprocessor 1070 to support the evaluation of the acquired downhole information, as well as to encode/decode data for transmitter 1052. The microprocessor 1070 also provides the control and timing for the drivers 1078.

The communication drivers 1078 are electronic switches used to control the flow of electrical power to the transmitter 1052. The microprocessor 1070 provides the control and timing for the drivers 1078.

The serial bus interface 1080 allows the microprocessor 1070 to interact with the surface data acquisition and control system 1042 (see FIG. 4C). The serial bus 1080 allows the surface system 1074 to transfer codes and set parameters to the microprocessor 1070 to execute its functions downhole.

The electromechanical drivers 1060 control the flow of electrical power to the electromechanical devices 1064 used for operation of the sliding sleeves, packers, safety valves, plugs and any other fluid control device downhole. The drivers are operated by the microprocessor 1070.

The non-volatile memory 1082 stores the code commands used by the micro controller 1070 to perform its functions downhole. The memory 1082 also holds the variables used by the processor 1070 to determine if the acquired parameters are in the proper operating range.

It will be appreciated that downhole valves are used for opening and closing of devices used in the control of fluid flow in the wellbore. Such electromechanical downhole valve devices will be actuated by downhole computer 1050 either in the event that a borehole sensor valve is determined to be outside a safe to operate range set by the operator or if a command is sent from the surface. As has been discussed, it is a particularly significant feature of this invention that the downhole control system 1022 permits automatic control of downhole tools and other downhole electronic control apparatus without requiring an initiation or actuation signal from the surface or from some other external source. This is in distinct contrast to prior art control systems wherein control is either actuated from the surface or is actuated by a downhole control device which requires an actuation signal from the surface as discussed above. It will be appreciated that the novel downhole control system of this invention whereby the control of electro-mechanical devices and/or electronic control apparatus is accomplished automatically without the requirement for a surface or other external actuation signal can be used separately from the remote well production control scheme shown in FIG. 4A.

Downhole control systems 1022 in each of the zones of interest have the ability not only to control the electromechanical devices associated with each of the downhole tools, but also have the ability to control other electronic control apparatus which may be associated with, for example, valving for additional fluid control. The downhole control systems 1022 further have the ability to communicate with each other (for example through hard wiring) so that actions in one zone may be used to effect the actions is another zone. This zone to zone communication constitutes still another important feature of the present invention. In addition, not only can the downhole computers 1050 in each of control systems 1022 communicate with each other, but the computers 1050 also have ability (via transceiver system 1052) to communicate through the surface control system 1024 and thereby communicate with other surface control systems 1024 at other well platforms (i.e., platforms 2 or N), at a remote central control center such as shown at 1010 in FIG. 4A, or each of the processors 1050 in each downhole control system 1022 in each zone 1, 2 or N can have the ability to communicate through its transceiver system 1052 to other downhole computers 1050 in other wells. For example, the downhole computer system 1022 in zone 1 of well 2 in platform 1 may communicate with a downhole control system on platform 2 located in one of the zones or one of the wells associated therewith. Thus, the downhole control system of the present invention permits communication between computers in different wellbores, communication between computers in different zones and communication between computers from one specific zone to a central remote location.

Information sent from the surface to transceiver 1052 may consist of actual control information, or may consist of data which is used to reprogram the memory in processor 1050 for initiating of automatic control based on sensor information. In addition to reprogramming information, the information sent from the surface may also be used to recalibrate a particular sensor. Processor 1050 in turn may not only send raw data and status information to the surface through transceiver 1052, but may also process data downhole using appropriate algorithms and other methods so that the information sent to the surface constitutes derived data in a form well suited for analysis.

As mentioned above, in the prior art, formation evaluation in production wells was accomplished using expensive and time consuming wire line devices which was positioned through the production tubing. The only sensors permanently positioned in a production well were those used to measure temperature, pressure and fluid flow. In contrast the present invention permanently locates formation evaluation sensors downhole in the production well. The permanently positioned formation evaluation sensors of the present invention will monitor both fluid flow and, more importantly, will measure formation parameters so that changing conditions in the formation will be sensed before problems occur. For example, water in the formation can be measured prior to such water reaching the borehole and therefore water will be prevented from being produced in the borehole. At present, water is sensed only after it enters the production tubing.

The formation evaluation sensors may be of the type described above including density, porosity and resistivity types. These sensors measure formation geology, formation saturation, formation porosity, gas influx, water content, petroleum content and formation chemical elements such as potassium, uranium and thorium. Examples of suitable sensors are described in commonly assigned U.S. Pat. Nos. 5,278,758 (porosity), 5,134,285 (density) nd 5,001,675 (electromagnetic resistivity), all of the contents of each patent being incorporated herein by reference.

The formation evaluation sensors of this invention are located closer to the formation as compared to wireline sensors in the production tubing and will therefore provide more accurate results. Since the formation evaluation data will constantly be available in real or near real time, there will be no need to periodically shut in the well and perform costly wireline evaluations.

For purposes of the United States national application only:

The present application, when filed as a United States national application will be a continuation-in-part of the following pending United States patent application, which is incorporated herein by reference as if fully set forth, and for which priority is claimed under 35 USC §120:

U.S. patent application Ser. No. 08/497,197, entitled "Down Hole Gas Compressor", filed Jun. 20, 1995, Docket No. 104-8249-US;

The present application claims priority under 35 USC §120 for the following pending United States provisional patent application, which is incorporated herein by reference as if fully set forth:

U.S. Provisional patent application Ser. No. 60/002,895 entitled "Method and Apparatus for Enhanced Utilization of Electrical Submersible Pumps in the Completion and Production of Wellbores", filed Aug. 30, 1995, Docket No. 104-6455-US.

The present application has some technical disclosure which is common with the following patent application which is incorporated herein by reference as if fully set forth:

U.S. patent application Ser. No. 08/386,504, entitled "Method and Apparatus for the Remote Control and Monitoring of Production Wells", filed Jun. 2, 1995, Docket No. 284-8007-US.

What is claimed is:

1. An improved pump for use in transporting fluids within a wellbore, comprising:

(a) a pump member, including an inlet for receiving fluid and an outlet for discharging fluid, disposed within said wellbore and including at least one moveable member for moving said fluids;

(b) an electrically-powered motor located in a remote downhole location within said wellbore mechanically coupled to said at least one moveable member of said pump member for selectively actuating said at least one moveable member;

(c) at least one sensor for detecting at least one of:
(1) an operating attribute of said improved pump;
(2) a subsurface condition;
(3) a fluid flow attribute; and
(4) a fluid attribute;

(d) at least one programmable controller carried in a remote location within said wellbore and communicatively coupled to at least said at least one sensor; and (e) at least one program composed of instructions executable by said at least one programmable controller for:
(1) receiving data from said at least one sensor;
(2) monitoring at least one of:
(a) an operating attribute of said improved pump;
(b) a subsurface condition;
(c) a fluid flow attribute; and
(d) a fluid attribute; and independent of communications with a surface control system, altering an operating condition of said improved electrical submersible pump based on measurements of said improved pump operating attribute, said subsurface condition; said fluid flow attribute, or said fluid attribute.

2. An improved pump according to claim 1, further comprising:

(f) a communication member communicatively coupled to said at least one programmable controller for performing at least one of (1) transmitting information, and (2) receiving information; and (g) wherein said at least one program further includes executable instructions for additionally performing at least one of the following:
(1) communicating data to a well head system at a well head of said wellbore;
(2) receiving data from said well head system;
(3) communicating commands to said pump member independent of communications with said well head system;
(4) receiving commands from said well head system;
(5) communicating program instructions; and (6) receiving program instructions.

3. An improved pump according to claim 1, further comprising:

(f) a housing adapted for connection to wellbore tubulars, which includes an inlet for receiving said fluids and an outlet for discharging said fluids.

4. An improved pump according to claim 1, wherein said pump member comprises an electrical submersible pump with a plurality of pump stages coupled together, each including at least one rotatable impeller for moving said fluids.

5. An improved pump according to claim 1, further comprising:

(f) an electrical conductor member extending from a remote surface location to said improved pump for providing electrical power to said electrically-powered motor.

6. An improved pump according to claim 5, further comprising:

(g) a communication member communicatively coupled to said at least one programmable controller for performing at least one of (1) transmitting information over said electrical conductor member, and (2) receiving information over said electrical conductor member.

7. An improved pump according to claim 1, wherein said at least one sensor comprises at least one sensor for detecting at least one of the following operating attributes of said improved pump:

(a) vibration of at least one rotary component of said improved pump;

(b) temperature of at least one bearing coupling of said improved pump;

(c) temperature of a clean fluid surrounding said electrically-powered motor;

(d) pressure of a clean fluid surrounding said electrically-powered motor;

(e) an electrical attribute of a clean fluid surrounding said electrically-powered motor;

(f) an electrical attribute of electrical power supplied to said electrically-powered motor;

(g) the speed of rotation of at least one rotary component of said improved pump; and (h) the strength of electrical resistance of at least one selected insulator within said improved pump.

8. An improved pump according to claim 1, wherein said at least one sensor comprises at least one sensor for detecting at least one of the following subsurface conditions:

(a) ambient wellbore temperature; and (b) ambient wellbore pressure.

9. An improved pump according to claim 1, wherein said at least one sensor comprises at least one sensor for detecting at least one of the following fluid flow attributes:

(a) fluid flow rates; and (b) fluid flow volumes.

10. An improved pump according to claim 1, wherein said at least one sensor comprises at least one sensor for detecting at least one of the following fluid attributes:

(a) fluid temperature;

(b) fluid pressure;

(c) fluid viscosity;

(d) fluid specific gravity;

(e) fluid spectrometer data; and (f) an electrical attribute of said fluids.

11. An improved pump according to claim 1, further comprising:

(f) at least one memory member, carried in said wellbore, for recording in memory data from said at least one sensor.

12. An improved pump according to claim 1, wherein said at least one sensor additionally detects at least one of the following:

(5) an operating condition of another wellbore tool; and wherein said at least one program composed of instructions executable by said at least one programmable controller includes instructions for monitoring said operating condition of said another wellbore tool.

13. An improved pump according to claim 1, wherein said at least one program is further composed of instructions executable by said at least one programmable controller for:

(4) comparing data to at least one pre-established threshold.

14. An improved pump according to claim 1, wherein said at least one program includes executable instructions for altering an operating condition of said improved electrical submersible pump based on communications with said surface control system.

15. An improved method of transporting fluids within a wellbore, comprising:

(a) providing a pump member, disposed in a remote wellbore location within said wellbore, including at least one moveable member for moving said fluids;

(b) providing an electrically-powered motor disposed in a remote wellbore location within said wellbore and mechanically coupled to said at least one moveable member of said pump member for selectively actuating said at least one moveable member;

(c) providing at least one sensor for detecting at least one of:

(1) an operating attribute of said improved pump;

(2) a subsurface condition;

(3) a fluid flow attribute; and (4) a fluid attribute;

(d) providing at least one programmable controller carried within said wellbore, and communicatively coupled to at least said at least one sensor;

(e) receiving data from said at least one sensor at said at least one programmable controller for executing at least one program which is composed of executable instructions;

(f) utilizing said at least one programmable controller for monitoring at least one of:

(1) an operating attribute of said improved pump;

(2) a subsurface condition;

(3) a fluid flow attribute; and (4) a fluid attribute;

independent of communications with a surface control system, altering an operating condition of said improved pump based on measurements of the improved pump operating attribute, the subsurface condition, the fluid flow attribute, and the fluid attribute.

16. An improved method of transporting fluids according to claim 15, further comprising:

(h) providing a communication member communicatively coupled to said at least one programmable controller for performing at least one of (1) transmitting information, and (2) receiving information; and (i) utilizing said at least one programmable controller for additionally performing at least one of the following:

(1) communicating data;
(2) receiving data;
(3) communicating commands;
(4) receiving commands;
(5) communicating program instructions; and
(6) receiving program instructions.

17. An improved method of transporting fluids according to claim 15, further comprising:

(h) providing an electrical conductor member extending from a remote location to said improved pump for providing electrical power to said electrically-powered motor.

18. An improved method of transporting fluids according to claim 17, further comprising:

(i) providing a communication member communicatively coupled to said at least one programmable controller and utilizing said communication member for performing at least one of (1) transmitting information over said electrical conductor member, and (2) receiving information over said electrical conductor member.

19. An improved method of transporting fluids according to claim 15, wherein said at least one sensor comprises at least one sensor for detecting at least one of the following operating attributes of said improved electrical submersible pump:

(a) vibration of at least one rotary component of said pump member;
(b) temperature of at least one bearing coupling of said pump member;
(c) temperature of a clean fluid surrounding said electrically- powered motor;
(d) pressure of a clean fluid surrounding said electrically-powered motor;
(e) an electrical attribute of a clean fluid surrounding said electrically-powered motor;
(f) an electrical attribute of electrical power supplied to said electrically-powered motor;
(g) the speed of rotation of at least one rotary component of said pump member; and
(h) the strength of electrical resistance of at least one selected insulator within said pump member.

20. An improved method of transporting fluids according to claim 15, wherein said at least one sensor comprises at least one sensor for detecting at least one of the following subsurface conditions:

(a) ambient wellbore temperature; and
(b) ambient wellbore pressure.

21. An improved method of transporting fluids according to claim 15, wherein said at least one sensor comprises at least one sensor for detecting at least one of the following fluid flow attributes:

(a) fluid flow rates; and
(b) fluid flow volumes.

22. An improved method of transporting fluids according to claim 15, wherein said at least one sensor comprises at least one sensor for detecting at least one of the following fluid attributes:

(a) fluid temperature;
(b) fluid pressure;
(c) fluid viscosity;
(d) fluid specific gravity;
(e) fluid spectrometer data; and
(f) an electrical attribute of said fluids.

23. An improved method according to claim 15:

wherein said at least one sensor additionally detects at least one of the following:

(5) an operating condition of another wellbore tool; and wherein said at least one program composed of instructions executable by said at least one programmable controller includes instructions for monitoring said operating condition of said another wellbore tool.

24. An improved method according to claim 15, wherein said at least one program is further composed of instructions executable by said at least one programmable controller for:

(4) comparing data to at least one pre-established threshold.

25. An method of transporting fluids according to claim 5, wherein said step of utilizing said programmable controller further comprises:

utilizing said programmable controller based on communications with said surface control system to alter an operating condition of said improved pump.

26. An apparatus for handling gas and liquid produced by a well, comprising:

(a) a centrifugal gas compressor located within the well, the gas compressor having an intake for receiving gas in the well, compressing the gas and delivering the gas out a discharge to a selected gas delivery location;
(b) a downhole electric motor assembly connected to the gas compressor for rotating the gas compressor;
(c) a liquid pump located in the well for pumping liquid in the well to a selected liquid delivery location; and
(d) a data processing system within the well for controlling operations, independent of communications with a surface control system, of at least one of (1) said centrifugal gas compressor, (2) said downhole electric motor assembly, and (3) said liquid pump.

27. The apparatus according to claim 26, further comprising:

(e) a gas separator mounted below the pump, the gas separator having a lower intake for receiving liquid and gas from the well, for separating a substantial portion of the gas from the liquid, for delivering the separated liquid to the intake of the pump, and for delivering the separated gas to the intake of the compressor; and
(f) wherein said data processing system is utilized for controlling at least one of (1) said centrifugal gas compressor, (2) said downhole electric motor assembly, (3) said liquid pump, and (4 ) said gas separator.

28. An apparatus for handling gas and liquid according to claim 26, further comprising:

(e) at least one sensor member for monitoring at least one wellbore condition and communicating data to said processing system;
(f) a member for varying operating of said centrifugal gas compressor which is under control of said processing system in order to vary compression.

29. An apparatus for handling gas and liquid according to claim 26, further comprising:

(f) providing at least one sensor member for monitoring at least one wellbore condition and communicating data to said processing system;
(g) providing a control member for varying operating of said centrifugal gas compressor;
(h) utilizing said processing system and said control member in order to vary compression.

30. An apparatus for handling gas and liquid produced by a well according to claim 12, wherein said data processing system controls operations of said at least one of (1) said centrifugal gas compressor, (2) said downhole electric motor assembly, and (3) said liquid pump based on communications iwth said surface control system.

31. A method of handling gas and liquid produced by a well, comprising:

(a) providing a centrifugal gas compressor located within the well, the gas compressor having an intake for receiving gas in the well, compressing the gas and delivering the gas out a discharge to a selected gas delivery location;

(b) providing a downhole electric motor assembly connected to the gas compressor for rotating the gas compressor;

(c) providing a liquid pump located in the well for pumping liquid in the well to a selected liquid delivery location; and (d) providing a data processing system within the well for controlling operations, independent of communications with a surface control system, of at least one of (1) said centrifugal gas compressor, (2) said downhole electric motor assembly, and (3) said liquid pump.

32. The method of transport according to claim 31, further comprising:

(f) providing a gas separator mounted below the pump, the gas separator having a lower intake for receiving liquid and gas from the well, for separating a substantial portion of the gas from the liquid, for delivering the separated liquid to the intake of the pump, and for delivering the separated gas to the intake of the compressor; and (g) utilizing said data processing system for controlling at least one of (1) said centrifugal gas compressor, (2) said downhole electric motor assembly, (3) said liquid pump, and (4) said gas separator.

33. A method of handling gas and liquid produced by a well according to claim 31, further comprising:

utilizing said data processing system to control said at least one of (1) said centrifugal gas compressor, (2) said downhole electric motor assembly, and (3) said liquid pump based on communications with said surface control system.

34. A method in a wellbore of delivering fluids, which include a high concentration of particulate material, to a selected wellbore location, comprising:

(a) coupling at least one electrical submersible pump in to a tubular conduit;

(b) lowering said tubular conduit into said wellbore to locate said at least one electrical submersible pump in a desired position relative to said wellbore location;

(c) providing at lease one surface pump located externally of said wellbore;

(d) utilizing said at least one surface pump to pass said fluids, which include a high concentration of particulate material, to said at least one electrical submersible pump; and (e) utilizing said at least one electrical submersible pump to assist said at least one surface pump to pass said fluids, which include a high concentration of particulate material, to said selected wellbore location.

35. A method according to claim 34, wherein said fluids comprise at least one of:

(a) fracturing fluids;

(b) cementitious material; and (c) completion fluids.

* * * * *